US007392661B2

(12) United States Patent
Alles

(10) Patent No.: US 7,392,661 B2
(45) Date of Patent: Jul. 1, 2008

(54) ENERGY USAGE ESTIMATION FOR CLIMATE CONTROL SYSTEM

(75) Inventor: Harold Gene Alles, Lake Oswego, OR (US)

(73) Assignee: Home Comfort Zones, Inc., Beaverton, OR (US)

( * ) Notice: Subject to any disclaimer, the term of this patent is extended or adjusted under 35 U.S.C. 154(b) by 508 days.

(21) Appl. No.: 11/029,932

(22) Filed: Jan. 4, 2005

(65) Prior Publication Data

US 2005/0194455 A1 Sep. 8, 2005

Related U.S. Application Data

(63) Continuation-in-part of application No. 10/873,921, filed on Jun. 22, 2004, now Pat. No. 7,188,779, which is a continuation-in-part of application No. 10/249,198, filed on Mar. 21, 2003, now Pat. No. 6,983,889.

(51) Int. Cl.
*F25B 49/00* (2006.01)
*G05D 23/00* (2006.01)

(52) U.S. Cl. ..... 62/127; 62/157; 62/231; 236/94; 700/291

(58) Field of Classification Search ..... 62/127, 62/256, 126, 129, 157, 231; 236/94; 700/291, 700/295, 296
See application file for complete search history.

(56) References Cited

U.S. PATENT DOCUMENTS

| | | | |
|---|---|---|---|
| 3,796,367 | A | 3/1974 | Rifkin |
| 3,806,027 | A | 4/1974 | Ginn et al. |
| 4,018,160 | A | 4/1977 | Cunningham et al. |
| 4,071,745 | A | 1/1978 | Hall |
| 4,077,310 | A | 3/1978 | McCabe, Jr. et al. |
| 4,089,462 | A | 5/1978 | Bradford |
| 4,102,494 | A | 7/1978 | Coleman et al. |
| 4,176,690 | A | 12/1979 | Clark et al. |
| 4,238,071 | A | 12/1980 | Post |
| 4,298,164 | A | 11/1981 | Post |
| 4,324,358 | A | 4/1982 | Tulowiecki et al. |
| 4,522,116 | A | 6/1985 | Tartaglino |

(Continued)

FOREIGN PATENT DOCUMENTS

| | | |
|---|---|---|
| EP | 0079087 | 5/1983 |

(Continued)

OTHER PUBLICATIONS

"7679P002 Notice of Allowance Mailed Jan. 28, 2005 for U.S. Appl. No. 10/249,198".

(Continued)

*Primary Examiner*—Marc E Norman
(74) *Attorney, Agent, or Firm*—Blakely Sokoloff Taylor & Zafman

(57) ABSTRACT

An HVAC system controller which estimates the energy cost or savings incurred due to a user-instigated change in a climate control schedule. The HVAC system controller is adapted to operate a multi-zone climate control system in a building, and is especially adapted to operate a retrofit zone climate control system in a residence. The HVAC controller displays the estimated cost or savings to the homeowner, enabling him to make an informed decision about whether to keep the change in the climate control schedule.

19 Claims, 33 Drawing Sheets

U.S. PATENT DOCUMENTS

| | | | | |
|---|---|---|---|---|
| 4,531,573 | A | 7/1985 | Clark et al. | |
| 4,545,524 | A | 10/1985 | Zelczer | |
| 5,143,287 | A | 9/1992 | Jardinier | |
| 5,245,835 | A | 9/1993 | Cohen et al. | |
| 5,400,852 | A | 3/1995 | Nakae et al. | |
| 5,717,609 | A * | 2/1998 | Packa et al. | 702/130 |
| 5,810,245 | A | 9/1998 | Heitman et al. | |
| 6,145,328 | A * | 11/2000 | Choi | 62/127 |
| 6,378,317 | B1 | 4/2002 | Ribo | |
| 6,415,617 | B1 | 7/2002 | Seem | |
| 6,428,680 | B1 | 8/2002 | Kreichauf | |
| 6,782,945 | B1 | 8/2004 | Eisenhour | |
| 6,983,210 | B2 * | 1/2006 | Matsubayashi et al. | 702/60 |
| 7,017,827 | B2 | 3/2006 | Shah et al. | |
| 2004/0254686 | A1 * | 12/2004 | Matsui et al. | 700/291 |
| 2005/0096797 | A1 * | 5/2005 | Matsubara et al. | 700/291 |

FOREIGN PATENT DOCUMENTS

| | | |
|---|---|---|
| GB | 2065333 | 6/1981 |

OTHER PUBLICATIONS

"7679P002 OA Mailed Nov. 10, 2004 for U.S. Appl. No. 10/249,198".
"7679P008 Notice of Allowance Mailed Sep. 27, 2006 for U.S. Appl. No. 10/873,921".
"7679P008 Office Action Mailed Apr. 27, 2006 for U.S. Appl. No. 10/873,921".
"7679P008 Restriction Requirement mailed Mar. 30, 2006 for U.S. Appl. No. 10/873,921".

* cited by examiner

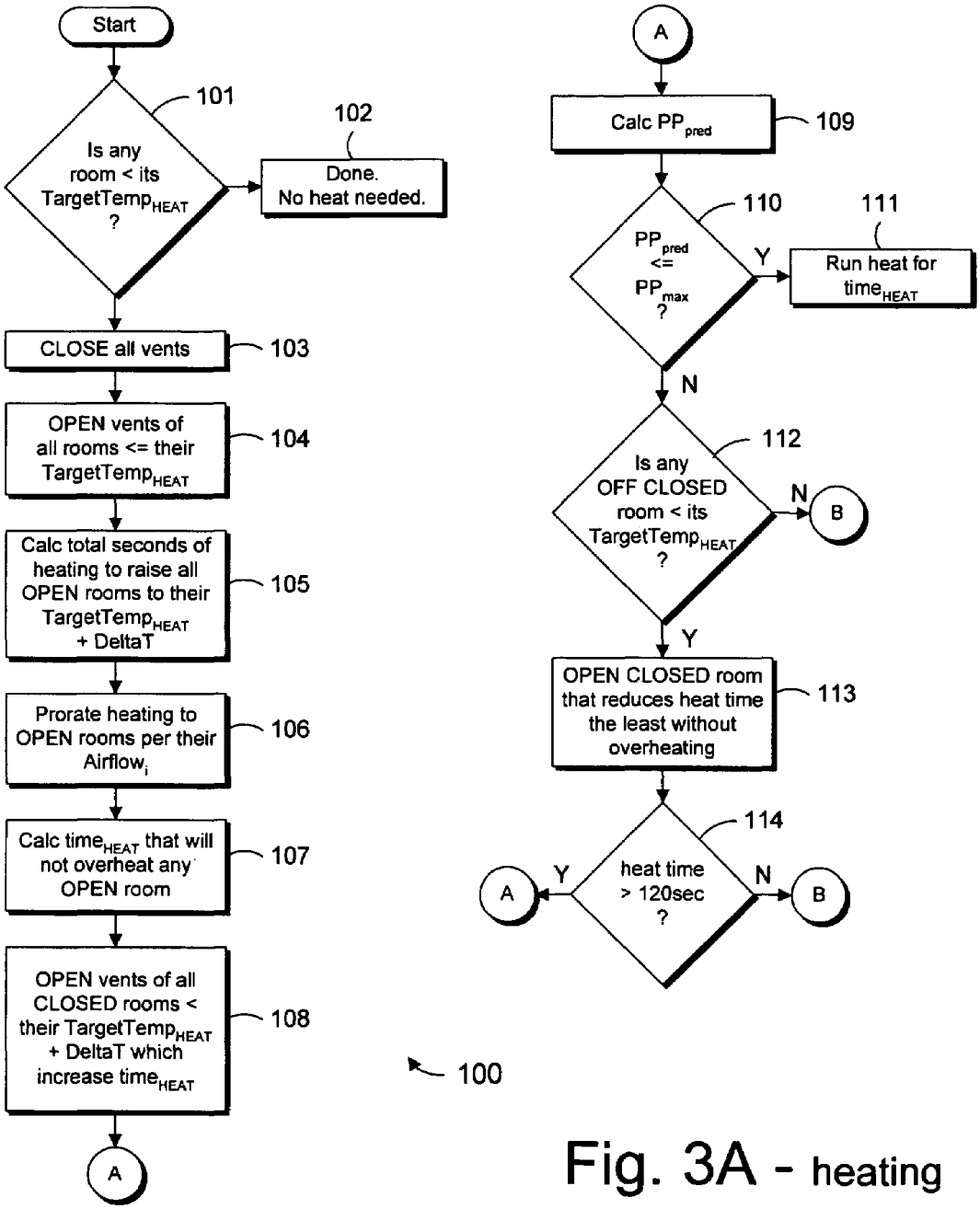
Fig. 3A - heating

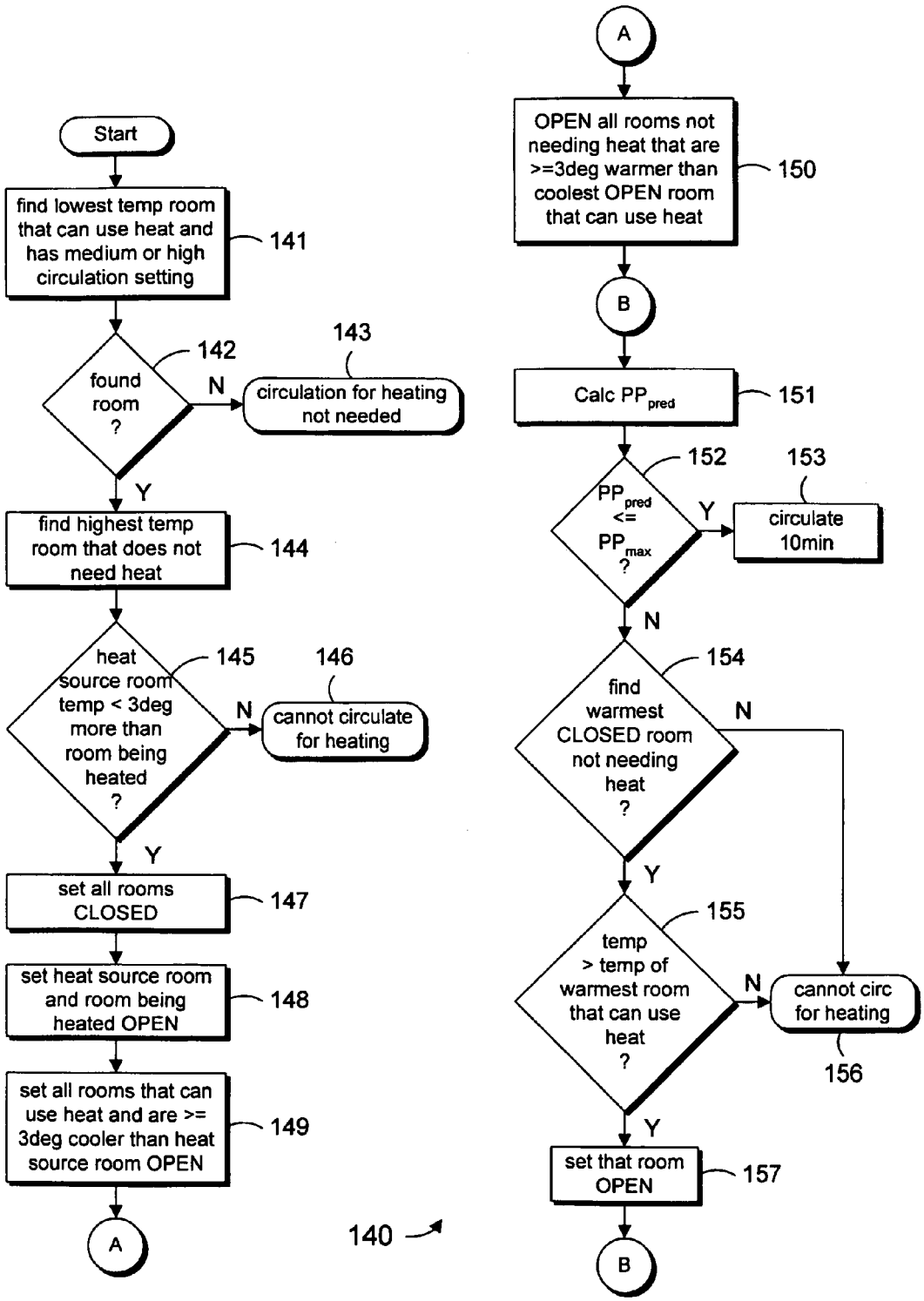
Fig. 4 - circulation for heating

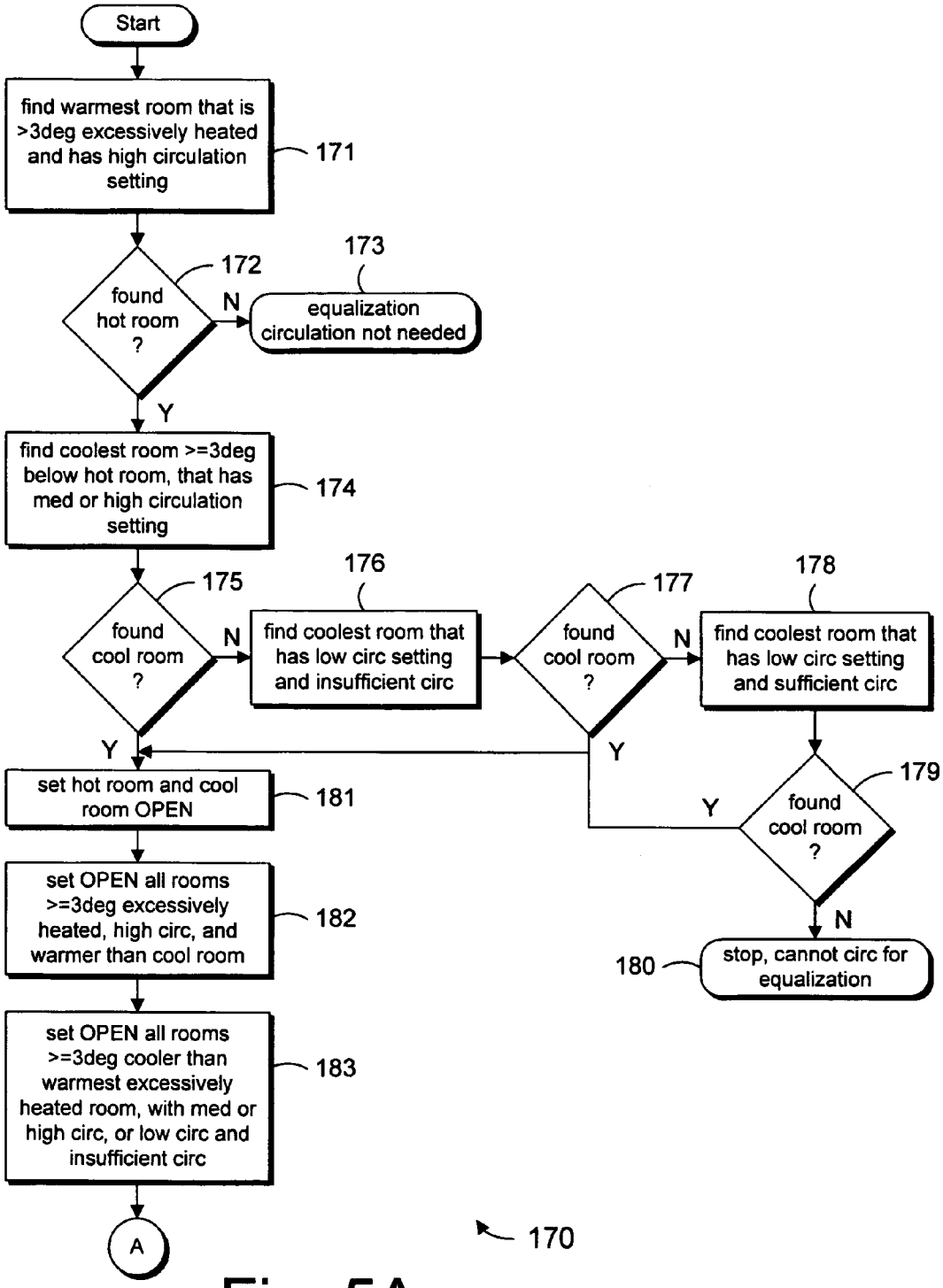
Fig. 5A - circulation for equalization

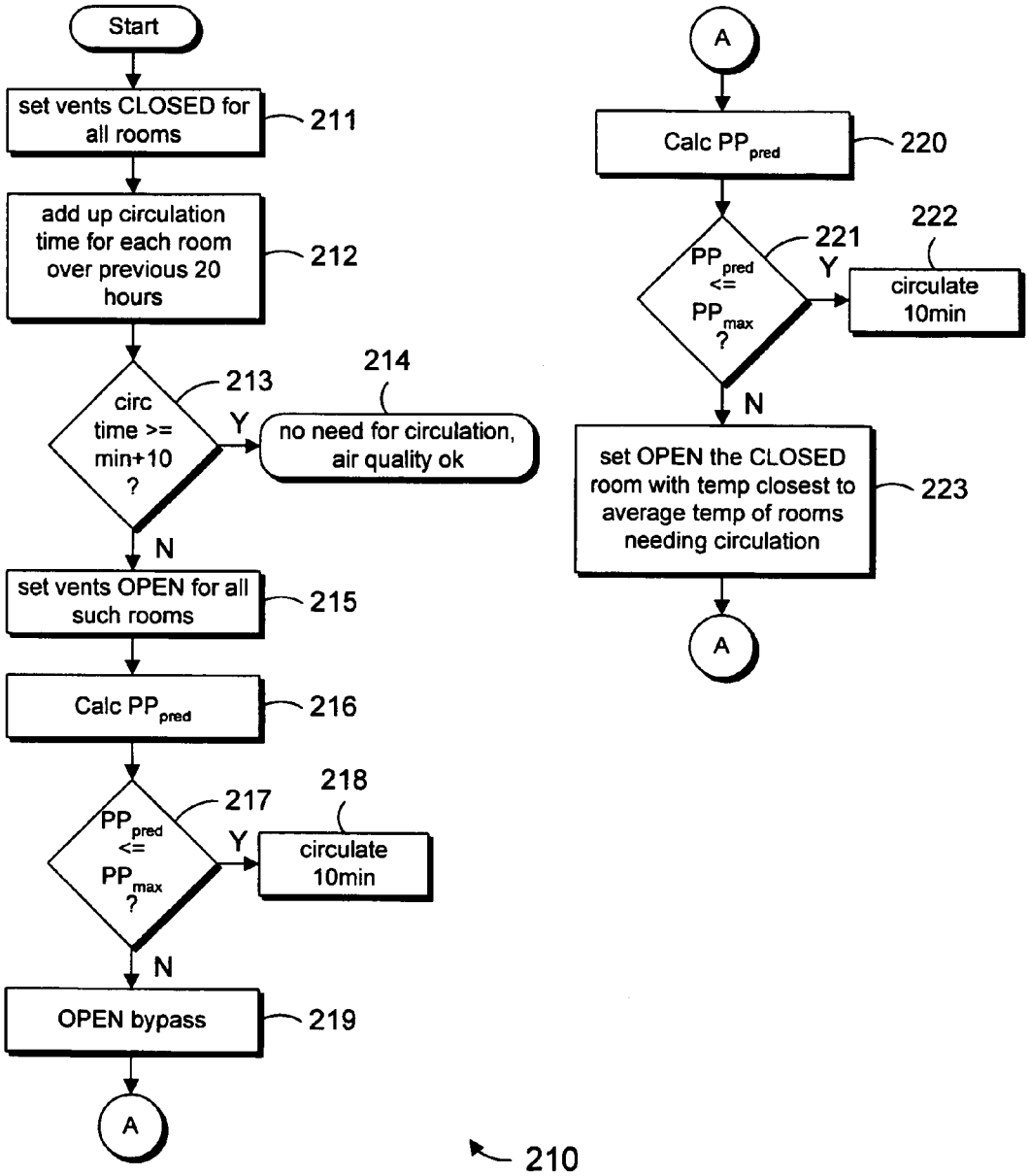
210
Fig. 6 - circulation for air quality

| National Weather Service - High Temperature Above Probability - Portland, Oregon | | | | | | | | | | | | |
|---|---|---|---|---|---|---|---|---|---|---|---|---|
| temp | Jan | Feb | Mar | Apr | May | Jun | Jul | Aug | Sep | Oct | Nov | Dec |
| 105 | 0.0 | 0.0 | 0.0 | 0.0 | 0.0 | 0.0 | 0.2 | 0.2 | 0.1 | 0.0 | 0.0 | 0.0 |
| 100 | 0.0 | 0.0 | 0.0 | 0.0 | 0.0 | 0.1 | 0.1 | 1.5 | 0.1 | 0.0 | 0.0 | 0.0 |
| 95 | 0.0 | 0.0 | 0.0 | 0.0 | 0.2 | 1.1 | 4.5 | 4.4 | 0.9 | 0.0 | 0.0 | 0.0 |
| 90 | 0.0 | 0.0 | 0.0 | 0.2 | 1.1 | 4.4 | 11.6 | 12.3 | 4.5 | 0.2 | 0.0 | 0.0 |
| 85 | 0.0 | 0.0 | 0.0 | 0.6 | 5.0 | 12.1 | 26.9 | 25.9 | 12.8 | 1.0 | 0.0 | 0.0 |
| 80 | 0.0 | 0.0 | 0.1 | 2.2 | 11.4 | 23.4 | 47.4 | 44.5 | 25.4 | 2.7 | 0.0 | 0.0 |
| 75 | 0.0 | 0.0 | 0.5 | 7.6 | 21.9 | 39.3 | 70.0 | 70.2 | 43.6 | 9.1 | 0.0 | 0.0 |
| 70 | 0.0 | 0.1 | 4.0 | 17.9 | 36.9 | 61.9 | 89.5 | 90.4 | 66.1 | 20.7 | 0.2 | 0.0 |
| 65 | 0.1 | 1.1 | 11.0 | 31.1 | 55.7 | 85.0 | 98.4 | 98.5 | 87.6 | 42.4 | 2.4 | 0.0 |
| 60 | 1.3 | 7.2 | 25.7 | 52.1 | 81.0 | 97.4 | 100.0 | 99.9 | 98.2 | 71.3 | 12.7 | 1.7 |
| 55 | 8.5 | 23.3 | 51.6 | 80.5 | 96.6 | 99.8 | 100.0 | 100.0 | 99.8 | 91.3 | 39.9 | 9.9 |
| 50 | 26.9 | 54.7 | 82.5 | 96.3 | 99.9 | 100.0 | 100.0 | 100.0 | 100.0 | 98.7 | 70.4 | 32.2 |
| 45 | 54.7 | 82.3 | 96.5 | 99.7 | 100.0 | 100.0 | 100.0 | 100.0 | 100.0 | 99.7 | 89.8 | 61.3 |
| 40 | 76.6 | 93.0 | 99.4 | 99.9 | 100.0 | 100.0 | 100.0 | 100.0 | 100.0 | 99.9 | 97.5 | 86.6 |
| 35 | 88.2 | 97.0 | 99.9 | 100.0 | 100.0 | 100.0 | 100.0 | 100.0 | 100.0 | 100.0 | 99.1 | 95.4 |
| 30 | 95.5 | 99.0 | 99.9 | 100.0 | 100.0 | 100.0 | 100.0 | 100.0 | 100.0 | 100.0 | 99.4 | 98.0 |
| 25 | 98.4 | 99.6 | 100.0 | 100.0 | 100.0 | 100.0 | 100.0 | 100.0 | 100.0 | 100.0 | 100.0 | 99.0 |
| 20 | 99.8 | 99.8 | 100.0 | 100.0 | 100.0 | 100.0 | 100.0 | 100.0 | 100.0 | 100.0 | 100.0 | 99.6 |
| 15 | 100.0 | 100.0 | 100.0 | 100.0 | 100.0 | 100.0 | 100.0 | 100.0 | 100.0 | 100.0 | 100.0 | 99.9 |

Table 1

| National Weather Service - Low Temperature Above Probability - Portland, Oregon | | | | | | | | | | | | |
|---|---|---|---|---|---|---|---|---|---|---|---|---|
| temp | Jan | Feb | Mar | Apr | May | Jun | Jul | Aug | Sep | Oct | Nov | Dec |
| 70 | 0.0 | 0.0 | 0.0 | 0.0 | 0.0 | 0.0 | 0.5 | 0.0 | 0.0 | 0.0 | 0.0 | 0.0 |
| 65 | 0.0 | 0.0 | 0.0 | 0.0 | 0.0 | 0.4 | 2.5 | 1.7 | 0.1 | 0.1 | 0.0 | 0.0 |
| 60 | 0.0 | 0.0 | 0.0 | 0.1 | 0.6 | 6.1 | 19.4 | 24.3 | 5.6 | 0.4 | 0.1 | 0.1 |
| 55 | 0.0 | 0.1 | 0.2 | 0.9 | 7.8 | 38.2 | 72.5 | 73.9 | 36.2 | 5.9 | 0.5 | 0.2 |
| 50 | 0.9 | 1.2 | 2.0 | 9.5 | 33.2 | 79.4 | 96.1 | 95.3 | 71.6 | 29.1 | 5.6 | 1.4 |
| 45 | 6.5 | 8.3 | 15.8 | 33.1 | 74.1 | 98.2 | 99.9 | 99.8 | 91.8 | 60.7 | 25.7 | 8.3 |
| 40 | 23.8 | 33.6 | 48.7 | 69.2 | 95.1 | 99.9 | 100.0 | 100.0 | 98.6 | 85.0 | 54.5 | 31.2 |
| 35 | 50.3 | 63.3 | 79.3 | 92.8 | 99.5 | 100.0 | 100.0 | 100.0 | 99.9 | 96.8 | 78.9 | 61.3 |
| 30 | 74.9 | 85.8 | 95.0 | 99.9 | 99.9 | 100.0 | 100.0 | 100.0 | 100.0 | 99.6 | 92.1 | 83.4 |
| 25 | 87.4 | 95.1 | 99.4 | 100.0 | 100.0 | 100.0 | 100.0 | 100.0 | 100.0 | 100.0 | 98.1 | 94.2 |
| 20 | 93.8 | 97.9 | 99.9 | 100.0 | 100.0 | 100.0 | 100.0 | 100.0 | 100.0 | 100.0 | 99.5 | 97.6 |
| 15 | 97.8 | 99.4 | 100.0 | 100.0 | 100.0 | 100.0 | 100.0 | 100.0 | 100.0 | 100.0 | 99.9 | 99.0 |
| 10 | 99.5 | 99.7 | 100.0 | 100.0 | 100.0 | 100.0 | 100.0 | 100.0 | 100.0 | 100.0 | 100.0 | 99.7 |
| 5 | 99.9 | 99.8 | 100.0 | 100.0 | 100.0 | 100.0 | 100.0 | 100.0 | 100.0 | 100.0 | 100.0 | 100.0 |
| 0 | 99.9 | 99.9 | 100.0 | 100.0 | 100.0 | 100.0 | 100.0 | 100.0 | 100.0 | 100.0 | 100.0 | 100.0 |
| -5 | 100.0 | 100.0 | 100.0 | 100.0 | 100.0 | 100.0 | 100.0 | 100.0 | 100.0 | 100.0 | 100.0 | 100.0 |

Table 2

| | Low Temperature Below Probability | | | | | | | | | | | |
|---|---|---|---|---|---|---|---|---|---|---|---|---|
| temp | Jan | Feb | Mar | Apr | May | Jun | Jul | Aug | Sep | Oct | Nov | Dec |
| 100 | 100.0 | 100.0 | 100.0 | 100.0 | 100.0 | 100.0 | 100.0 | 100.0 | 100.0 | 100.0 | 100.0 | 100.0 |
| 95 | 100.0 | 100.0 | 100.0 | 100.0 | 100.0 | 100.0 | 100.0 | 100.0 | 100.0 | 100.0 | 100.0 | 100.0 |
| 90 | 100.0 | 100.0 | 100.0 | 100.0 | 100.0 | 100.0 | 100.0 | 100.0 | 100.0 | 100.0 | 100.0 | 100.0 |
| 85 | 100.0 | 100.0 | 100.0 | 100.0 | 100.0 | 100.0 | 100.0 | 100.0 | 100.0 | 100.0 | 100.0 | 100.0 |
| 80 | 100.0 | 100.0 | 100.0 | 100.0 | 100.0 | 100.0 | 100.0 | 100.0 | 100.0 | 100.0 | 100.0 | 100.0 |
| 75 | 100.0 | 100.0 | 100.0 | 100.0 | 100.0 | 100.0 | 100.0 | 100.0 | 100.0 | 100.0 | 100.0 | 100.0 |
| 70 | 100.0 | 100.0 | 100.0 | 100.0 | 100.0 | 100.0 | 99.5 | 100.0 | 100.0 | 100.0 | 100.0 | 100.0 |
| 65 | 100.0 | 100.0 | 100.0 | 100.0 | 100.0 | 99.6 | 97.5 | 98.3 | 99.9 | 99.9 | 100.0 | 100.0 |
| 60 | 100.0 | 100.0 | 100.0 | 99.9 | 99.4 | 93.9 | 80.6 | 75.7 | 94.4 | 99.6 | 99.9 | 99.9 |
| 55 | 100.0 | 99.9 | 99.8 | 99.1 | 92.2 | 61.8 | 27.5 | 26.1 | 63.8 | 94.1 | 99.5 | 99.8 |
| 50 | 99.1 | 98.8 | 98.0 | 90.5 | 66.8 | 20.6 | 3.9 | 4.7 | 28.4 | 70.9 | 94.4 | 98.6 |
| 45 | 93.5 | 91.7 | 84.2 | 66.9 | 25.9 | 1.8 | 0.1 | 0.2 | 8.2 | 39.3 | 74.3 | 91.7 |
| 40 | 76.2 | 66.4 | 51.3 | 30.8 | 4.9 | 0.1 | 0.0 | 0.0 | 1.4 | 15.0 | 45.5 | 68.8 |
| 35 | 49.7 | 36.7 | 20.7 | 7.2 | 0.5 | 0.0 | 0.0 | 0.0 | 0.1 | 3.2 | 21.1 | 38.7 |
| 30 | 25.1 | 14.2 | 5.0 | 0.1 | 0.1 | 0.0 | 0.0 | 0.0 | 0.0 | 0.4 | 7.9 | 16.6 |
| 25 | 12.6 | 4.9 | 0.6 | 0.0 | 0.0 | 0.0 | 0.0 | 0.0 | 0.0 | 0.0 | 1.9 | 5.8 |
| 20 | 6.2 | 2.1 | 0.1 | 0.0 | 0.0 | 0.0 | 0.0 | 0.0 | 0.0 | 0.0 | 0.5 | 2.4 |
| 15 | 2.2 | 0.6 | 0.0 | 0.0 | 0.0 | 0.0 | 0.0 | 0.0 | 0.0 | 0.0 | 0.1 | 1.0 |
| 10 | 0.5 | 0.3 | 0.0 | 0.0 | 0.0 | 0.0 | 0.0 | 0.0 | 0.0 | 0.0 | 0.0 | 0.3 |
| 5 | 0.1 | 0.2 | 0.0 | 0.0 | 0.0 | 0.0 | 0.0 | 0.0 | 0.0 | 0.0 | 0.0 | 0.0 |
| 0 | 0.1 | 0.1 | 0.0 | 0.0 | 0.0 | 0.0 | 0.0 | 0.0 | 0.0 | 0.0 | 0.0 | 0.0 |
| -5 | 0.0 | 0.0 | 0.0 | 0.0 | 0.0 | 0.0 | 0.0 | 0.0 | 0.0 | 0.0 | 0.0 | 0.0 |

Table 3

| National Weather Service - Average Monthly Temperatures - Portland, Oregon | | | | | | | | | | | | |
|---|---|---|---|---|---|---|---|---|---|---|---|---|
| | Jan | Feb | Mar | Apr | May | Jun | Jul | Aug | Sep | Oct | Nov | Dec |
| High | 45.4 | 51.0 | 56.0 | 60.6 | 67.1 | 74.0 | 79.9 | 80.3 | 74.6 | 64.0 | 52.6 | 45.6 |
| Low | 33.7 | 36.1 | 38.6 | 41.3 | 47.0 | 52.9 | 56.5 | 56.9 | 52.0 | 44.9 | 33.9 | 34.8 |

Table 4

| Average Monthly Spread | | | | | | | | | | | |
|---|---|---|---|---|---|---|---|---|---|---|---|
| Jan | Feb | Mar | Apr | May | Jun | Jul | Aug | Sep | Oct | Nov | Dec |
| 12.0 | 15.0 | 17.0 | 19.0 | 20.0 | 21.0 | 23.0 | 23.0 | 23.0 | 19.0 | 19.0 | 11.0 |

Table 5

| Cooling Season Daily Local Climate Pattern Portland, Oregon | |
|---|---|
| Hour | Value |
| 0 | 0.42 |
| 1 | 0.35 |
| 2 | 0.27 |
| 3 | 0.20 |
| 4 | 0.13 |
| 5 | 0.05 |
| 6 | 0.03 |
| 7 | 0.13 |
| 8 | 0.23 |
| 9 | 0.34 |
| 10 | 0.44 |
| 11 | 0.55 |
| 12 | 0.65 |
| 13 | 0.75 |
| 14 | 0.86 |
| 15 | 0.96 |
| 16 | 1.00 |
| 17 | 0.93 |
| 18 | 0.85 |
| 19 | 0.78 |
| 20 | 0.71 |
| 21 | 0.64 |
| 22 | 0.56 |
| 23 | 0.49 |

Table 6

| Heating Season Daily Local Climate Pattern Portland, Oregon | |
|---|---|
| Hour | Value |
| 0 | 0.42 |
| 1 | 0.36 |
| 2 | 0.30 |
| 3 | 0.25 |
| 4 | 0.19 |
| 5 | 0.13 |
| 6 | 0.07 |
| 7 | 0.01 |
| 8 | 0.12 |
| 9 | 0.27 |
| 10 | 0.43 |
| 11 | 0.59 |
| 12 | 0.74 |
| 13 | 0.90 |
| 14 | 1.00 |
| 15 | 0.94 |
| 16 | 0.88 |
| 17 | 0.83 |
| 18 | 0.77 |
| 19 | 0.71 |
| 20 | 0.65 |
| 21 | 0.59 |
| 22 | 0.54 |
| 23 | 0.48 |

Table 7

| 1deg High Temperature Above Probability | | | | | | | | | | | | |
|---|---|---|---|---|---|---|---|---|---|---|---|---|
| temp | Jan | Feb | Mar | Apr | May | Jun | Jul | Aug | Sep | Oct | Nov | Dec |
| 105 | 0.0 | 0.0 | 0.0 | 0.0 | 0.0 | 0.0 | 0.2 | 0.2 | 0.1 | 0.0 | 0.0 | 0.0 |
| 104 | 0.0 | 0.0 | 0.0 | 0.0 | 0.0 | 0.0 | 0.2 | 0.5 | 0.1 | 0.0 | 0.0 | 0.0 |
| 103 | 0.0 | 0.0 | 0.0 | 0.0 | 0.0 | 0.0 | 0.2 | 0.7 | 0.1 | 0.0 | 0.0 | 0.0 |
| 102 | 0.0 | 0.0 | 0.0 | 0.0 | 0.0 | 0.1 | 0.1 | 1.0 | 0.1 | 0.0 | 0.0 | 0.0 |
| 101 | 0.0 | 0.0 | 0.0 | 0.0 | 0.0 | 0.1 | 0.1 | 1.2 | 0.1 | 0.0 | 0.0 | 0.0 |
| 100 | 0.0 | 0.0 | 0.0 | 0.0 | 0.0 | 0.1 | 0.1 | 1.5 | 0.1 | 0.0 | 0.0 | 0.0 |
| 99 | 0.0 | 0.0 | 0.0 | 0.0 | 0.0 | 0.3 | 1.0 | 2.1 | 0.3 | 0.0 | 0.0 | 0.0 |
| 98 | 0.0 | 0.0 | 0.0 | 0.0 | 0.1 | 0.5 | 1.9 | 2.7 | 0.4 | 0.0 | 0.0 | 0.0 |
| 97 | 0.0 | 0.0 | 0.0 | 0.0 | 0.1 | 0.7 | 2.7 | 3.2 | 0.6 | 0.0 | 0.0 | 0.0 |
| 96 | 0.0 | 0.0 | 0.0 | 0.0 | 0.2 | 0.9 | 3.6 | 3.8 | 0.7 | 0.0 | 0.0 | 0.0 |
| 95 | 0.0 | 0.0 | 0.0 | 0.0 | 0.2 | 1.1 | 4.5 | 4.4 | 0.9 | 0.0 | 0.0 | 0.0 |
| 94 | 0.0 | 0.0 | 0.0 | 0.0 | 0.4 | 1.8 | 5.9 | 6.0 | 1.6 | 0.0 | 0.0 | 0.0 |
| 93 | 0.0 | 0.0 | 0.0 | 0.1 | 0.6 | 2.4 | 7.3 | 7.6 | 2.3 | 0.1 | 0.0 | 0.0 |
| 92 | 0.0 | 0.0 | 0.0 | 0.1 | 0.7 | 3.1 | 8.8 | 9.1 | 3.1 | 0.1 | 0.0 | 0.0 |
| 91 | 0.0 | 0.0 | 0.0 | 0.2 | 0.9 | 3.7 | 10.2 | 10.7 | 3.8 | 0.2 | 0.0 | 0.0 |
| 90 | 0.0 | 0.0 | 0.0 | 0.2 | 1.1 | 4.4 | 11.6 | 12.3 | 4.5 | 0.2 | 0.0 | 0.0 |
| 89 | 0.0 | 0.0 | 0.0 | 0.3 | 1.9 | 5.9 | 14.7 | 15.0 | 6.2 | 0.4 | 0.0 | 0.0 |
| 88 | 0.0 | 0.0 | 0.0 | 0.4 | 2.7 | 7.5 | 17.7 | 17.7 | 7.8 | 0.5 | 0.0 | 0.0 |
| 87 | 0.0 | 0.0 | 0.0 | 0.4 | 3.4 | 9.0 | 20.8 | 20.5 | 9.5 | 0.7 | 0.0 | 0.0 |
| 86 | 0.0 | 0.0 | 0.0 | 0.5 | 4.2 | 10.6 | 23.8 | 23.2 | 11.1 | 0.8 | 0.0 | 0.0 |
| 85 | 0.0 | 0.0 | 0.0 | 0.6 | 5.0 | 12.1 | 26.9 | 25.9 | 12.8 | 1.0 | 0.0 | 0.0 |
| 84 | 0.0 | 0.0 | 0.0 | 0.9 | 6.3 | 14.4 | 31.0 | 29.6 | 15.3 | 1.3 | 0.0 | 0.0 |
| 83 | 0.0 | 0.0 | 0.0 | 1.2 | 7.6 | 16.6 | 35.1 | 33.3 | 17.8 | 1.7 | 0.0 | 0.0 |
| 82 | 0.0 | 0.0 | 0.1 | 1.6 | 8.8 | 18.9 | 39.2 | 37.1 | 20.4 | 2.0 | 0.0 | 0.0 |
| 81 | 0.0 | 0.0 | 0.1 | 1.9 | 10.1 | 21.1 | 43.3 | 40.8 | 22.9 | 2.4 | 0.0 | 0.0 |
| 80 | 0.0 | 0.0 | 0.1 | 2.2 | 11.4 | 23.4 | 47.4 | 44.5 | 25.4 | 2.7 | 0.0 | 0.0 |
| 79 | 0.0 | 0.0 | 0.2 | 3.3 | 13.5 | 26.6 | 51.9 | 49.6 | 29.0 | 4.0 | 0.0 | 0.0 |
| 78 | 0.0 | 0.0 | 0.3 | 4.4 | 15.6 | 29.8 | 56.4 | 54.8 | 32.7 | 5.3 | 0.0 | 0.0 |
| 77 | 0.0 | 0.0 | 0.3 | 5.4 | 17.7 | 32.9 | 61.0 | 59.9 | 36.3 | 6.5 | 0.0 | 0.0 |
| 76 | 0.0 | 0.0 | 0.4 | 6.5 | 19.8 | 36.1 | 65.5 | 65.1 | 40.0 | 7.8 | 0.0 | 0.0 |
| 75 | 0.0 | 0.0 | 0.5 | 7.6 | 21.9 | 39.3 | 70.0 | 70.2 | 43.6 | 9.1 | 0.0 | 0.0 |
| 74 | 0.0 | 0.0 | 1.2 | 9.7 | 24.9 | 43.8 | 73.9 | 74.2 | 48.1 | 11.4 | 0.0 | 0.0 |
| 73 | 0.0 | 0.0 | 1.9 | 11.7 | 27.9 | 48.3 | 77.8 | 78.3 | 52.6 | 13.7 | 0.1 | 0.0 |
| 72 | 0.0 | 0.1 | 2.6 | 13.8 | 30.9 | 52.9 | 81.7 | 82.3 | 57.1 | 16.1 | 0.1 | 0.0 |
| 71 | 0.0 | 0.1 | 3.3 | 15.8 | 33.9 | 57.4 | 85.6 | 86.4 | 61.6 | 18.4 | 0.2 | 0.0 |
| 70 | 0.0 | 0.1 | 4.0 | 17.9 | 36.9 | 61.9 | 89.5 | 90.4 | 66.1 | 20.7 | 0.2 | 0.0 |
| 69 | 0.0 | 0.3 | 5.4 | 20.5 | 40.7 | 66.5 | 91.3 | 92.0 | 70.4 | 25.0 | 0.6 | 0.0 |
| 68 | 0.0 | 0.5 | 6.8 | 23.2 | 44.4 | 71.1 | 93.1 | 93.6 | 74.7 | 29.4 | 1.1 | 0.0 |
| 67 | 0.1 | 0.7 | 8.2 | 25.8 | 48.2 | 75.8 | 94.8 | 95.3 | 79.0 | 33.7 | 1.5 | 0.0 |
| 66 | 0.1 | 0.9 | 9.6 | 28.5 | 51.9 | 80.4 | 96.6 | 96.9 | 83.3 | 38.1 | 2.0 | 0.0 |
| 65 | 0.1 | 1.1 | 11.0 | 31.1 | 55.7 | 85.0 | 98.4 | 98.5 | 87.6 | 42.4 | 2.4 | 0.0 |
| 64 | 0.3 | 2.3 | 13.9 | 35.3 | 60.8 | 87.5 | 98.7 | 98.8 | 89.7 | 48.2 | 4.5 | 0.3 |
| 63 | 0.6 | 3.5 | 16.9 | 39.5 | 65.8 | 90.0 | 99.0 | 99.1 | 91.8 | 54.0 | 6.5 | 0.7 |
| 62 | 0.8 | 4.8 | 19.8 | 43.7 | 70.9 | 92.4 | 99.4 | 99.3 | 94.0 | 59.7 | 8.6 | 1.0 |
| 61 | 1.1 | 6.0 | 22.8 | 47.9 | 75.9 | 94.9 | 99.7 | 99.6 | 96.1 | 65.5 | 10.6 | 1.4 |

Table 8A

| 1deg High Temperature Above Probability | | | | | | | | | | | | |
|---|---|---|---|---|---|---|---|---|---|---|---|---|
| temp | Jan | Feb | Mar | Apr | May | Jun | Jul | Aug | Sep | Oct | Nov | Dec |
| 60 | 1.3 | 7.2 | 25.7 | 52.1 | 81.0 | 97.4 | 100.0 | 99.9 | 98.2 | 71.3 | 12.7 | 1.7 |
| 59 | 2.7 | 10.4 | 30.9 | 57.8 | 84.1 | 97.9 | 100.0 | 99.9 | 98.5 | 75.3 | 18.1 | 3.3 |
| 58 | 4.2 | 13.6 | 36.1 | 63.5 | 87.2 | 98.4 | 100.0 | 99.9 | 98.8 | 79.3 | 23.6 | 5.0 |
| 57 | 5.6 | 16.9 | 41.2 | 69.1 | 90.4 | 98.8 | 100.0 | 100.0 | 99.2 | 83.3 | 29.0 | 6.6 |
| 56 | 7.1 | 20.1 | 46.4 | 74.8 | 93.5 | 99.3 | 100.0 | 100.0 | 99.5 | 87.3 | 34.5 | 8.3 |
| 55 | 8.5 | 23.3 | 51.6 | 80.5 | 96.6 | 99.8 | 100.0 | 100.0 | 99.8 | 91.3 | 39.9 | 9.9 |
| 54 | 12.2 | 29.6 | 57.8 | 83.7 | 97.3 | 99.8 | 100.0 | 100.0 | 99.8 | 92.8 | 46.0 | 14.4 |
| 53 | 15.9 | 35.9 | 64.0 | 86.8 | 97.9 | 99.9 | 100.0 | 100.0 | 99.9 | 94.3 | 52.1 | 18.8 |
| 52 | 19.5 | 42.1 | 70.1 | 90.0 | 98.6 | 99.9 | 100.0 | 100.0 | 99.9 | 95.7 | 58.2 | 23.3 |
| 51 | 23.2 | 48.4 | 76.3 | 93.1 | 99.2 | 100.0 | 100.0 | 100.0 | 100.0 | 97.2 | 64.3 | 27.7 |
| 50 | 26.9 | 54.7 | 82.5 | 96.3 | 99.9 | 100.0 | 100.0 | 100.0 | 100.0 | 98.7 | 70.4 | 32.2 |
| 49 | 32.5 | 60.2 | 85.3 | 97.0 | 99.9 | 100.0 | 100.0 | 100.0 | 100.0 | 98.9 | 74.3 | 38.0 |
| 48 | 38.0 | 65.7 | 88.1 | 97.7 | 99.9 | 100.0 | 100.0 | 100.0 | 100.0 | 99.1 | 78.2 | 43.8 |
| 47 | 43.6 | 71.3 | 90.9 | 98.3 | 100.0 | 100.0 | 100.0 | 100.0 | 100.0 | 99.3 | 82.0 | 49.7 |
| 46 | 49.1 | 76.8 | 93.7 | 99.0 | 100.0 | 100.0 | 100.0 | 100.0 | 100.0 | 99.5 | 85.9 | 55.5 |
| 45 | 54.7 | 82.3 | 96.5 | 99.7 | 100.0 | 100.0 | 100.0 | 100.0 | 100.0 | 99.7 | 89.8 | 61.3 |
| 44 | 59.1 | 84.4 | 97.1 | 99.7 | 100.0 | 100.0 | 100.0 | 100.0 | 100.0 | 99.7 | 91.3 | 66.4 |
| 43 | 63.5 | 86.6 | 97.7 | 99.8 | 100.0 | 100.0 | 100.0 | 100.0 | 100.0 | 99.8 | 92.9 | 71.4 |
| 42 | 67.8 | 88.7 | 98.2 | 99.8 | 100.0 | 100.0 | 100.0 | 100.0 | 100.0 | 99.8 | 94.4 | 76.5 |
| 41 | 72.2 | 90.9 | 98.8 | 99.9 | 100.0 | 100.0 | 100.0 | 100.0 | 100.0 | 99.9 | 96.0 | 81.5 |
| 40 | 76.6 | 93.0 | 99.4 | 99.9 | 100.0 | 100.0 | 100.0 | 100.0 | 100.0 | 99.9 | 97.5 | 86.6 |
| 39 | 78.9 | 93.8 | 99.5 | 99.9 | 100.0 | 100.0 | 100.0 | 100.0 | 100.0 | 99.9 | 97.8 | 88.4 |
| 38 | 81.2 | 94.6 | 99.6 | 99.9 | 100.0 | 100.0 | 100.0 | 100.0 | 100.0 | 99.9 | 98.1 | 90.1 |
| 37 | 83.6 | 95.4 | 99.7 | 100.0 | 100.0 | 100.0 | 100.0 | 100.0 | 100.0 | 100.0 | 98.5 | 91.9 |
| 36 | 85.9 | 96.2 | 99.8 | 100.0 | 100.0 | 100.0 | 100.0 | 100.0 | 100.0 | 100.0 | 98.8 | 93.6 |
| 35 | 88.2 | 97.0 | 99.9 | 100.0 | 100.0 | 100.0 | 100.0 | 100.0 | 100.0 | 100.0 | 99.1 | 95.4 |
| 34 | 89.7 | 97.4 | 99.9 | 100.0 | 100.0 | 100.0 | 100.0 | 100.0 | 100.0 | 100.0 | 99.2 | 95.9 |
| 33 | 91.1 | 97.8 | 99.9 | 100.0 | 100.0 | 100.0 | 100.0 | 100.0 | 100.0 | 100.0 | 99.2 | 96.4 |
| 32 | 92.6 | 98.2 | 99.9 | 100.0 | 100.0 | 100.0 | 100.0 | 100.0 | 100.0 | 100.0 | 99.3 | 97.0 |
| 31 | 94.0 | 98.6 | 99.9 | 100.0 | 100.0 | 100.0 | 100.0 | 100.0 | 100.0 | 100.0 | 99.3 | 97.5 |
| 30 | 95.5 | 99.0 | 99.9 | 100.0 | 100.0 | 100.0 | 100.0 | 100.0 | 100.0 | 100.0 | 99.4 | 98.0 |
| 29 | 96.1 | 99.1 | 99.9 | 100.0 | 100.0 | 100.0 | 100.0 | 100.0 | 100.0 | 100.0 | 99.5 | 98.2 |
| 28 | 96.7 | 99.2 | 99.9 | 100.0 | 100.0 | 100.0 | 100.0 | 100.0 | 100.0 | 100.0 | 99.6 | 98.4 |
| 27 | 97.2 | 99.4 | 100.0 | 100.0 | 100.0 | 100.0 | 100.0 | 100.0 | 100.0 | 100.0 | 99.8 | 98.6 |
| 26 | 97.8 | 99.5 | 100.0 | 100.0 | 100.0 | 100.0 | 100.0 | 100.0 | 100.0 | 100.0 | 99.9 | 98.8 |
| 25 | 98.4 | 99.6 | 100.0 | 100.0 | 100.0 | 100.0 | 100.0 | 100.0 | 100.0 | 100.0 | 100.0 | 99.0 |
| 24 | 98.7 | 99.6 | 100.0 | 100.0 | 100.0 | 100.0 | 100.0 | 100.0 | 100.0 | 100.0 | 100.0 | 99.1 |
| 23 | 99.0 | 99.7 | 100.0 | 100.0 | 100.0 | 100.0 | 100.0 | 100.0 | 100.0 | 100.0 | 100.0 | 99.2 |
| 22 | 99.2 | 99.7 | 100.0 | 100.0 | 100.0 | 100.0 | 100.0 | 100.0 | 100.0 | 100.0 | 100.0 | 99.4 |
| 21 | 99.5 | 99.8 | 100.0 | 100.0 | 100.0 | 100.0 | 100.0 | 100.0 | 100.0 | 100.0 | 100.0 | 99.5 |
| 20 | 99.8 | 99.8 | 100.0 | 100.0 | 100.0 | 100.0 | 100.0 | 100.0 | 100.0 | 100.0 | 100.0 | 99.6 |
| 19 | 99.8 | 99.8 | 100.0 | 100.0 | 100.0 | 100.0 | 100.0 | 100.0 | 100.0 | 100.0 | 100.0 | 99.7 |
| 18 | 99.9 | 99.9 | 100.0 | 100.0 | 100.0 | 100.0 | 100.0 | 100.0 | 100.0 | 100.0 | 100.0 | 99.7 |
| 17 | 99.9 | 99.9 | 100.0 | 100.0 | 100.0 | 100.0 | 100.0 | 100.0 | 100.0 | 100.0 | 100.0 | 99.8 |
| 16 | 100.0 | 100.0 | 100.0 | 100.0 | 100.0 | 100.0 | 100.0 | 100.0 | 100.0 | 100.0 | 100.0 | 99.8 |
| 15 | 100.0 | 100.0 | 100.0 | 100.0 | 100.0 | 100.0 | 100.0 | 100.0 | 100.0 | 100.0 | 100.0 | 99.9 |

Table 8B

| 1deg Low Temperature Below Probability | | | | | | | | | | | | |
|---|---|---|---|---|---|---|---|---|---|---|---|---|
| temp | Jan | Feb | Mar | Apr | May | Jun | Jul | Aug | Sep | Oct | Nov | Year |
| 100 | 100.0 | 100.0 | 100.0 | 100.0 | 100.0 | 100.0 | 100.0 | 100.0 | 100.0 | 100.0 | 100.0 | 100.0 |
| 99 | 100.0 | 100.0 | 100.0 | 100.0 | 100.0 | 100.0 | 100.0 | 100.0 | 100.0 | 100.0 | 100.0 | 100.0 |
| 98 | 100.0 | 100.0 | 100.0 | 100.0 | 100.0 | 100.0 | 100.0 | 100.0 | 100.0 | 100.0 | 100.0 | 100.0 |
| 97 | 100.0 | 100.0 | 100.0 | 100.0 | 100.0 | 100.0 | 100.0 | 100.0 | 100.0 | 100.0 | 100.0 | 100.0 |
| 96 | 100.0 | 100.0 | 100.0 | 100.0 | 100.0 | 100.0 | 100.0 | 100.0 | 100.0 | 100.0 | 100.0 | 100.0 |
| 95 | 100.0 | 100.0 | 100.0 | 100.0 | 100.0 | 100.0 | 100.0 | 100.0 | 100.0 | 100.0 | 100.0 | 100.0 |
| 94 | 100.0 | 100.0 | 100.0 | 100.0 | 100.0 | 100.0 | 100.0 | 100.0 | 100.0 | 100.0 | 100.0 | 100.0 |
| 93 | 100.0 | 100.0 | 100.0 | 100.0 | 100.0 | 100.0 | 100.0 | 100.0 | 100.0 | 100.0 | 100.0 | 100.0 |
| 92 | 100.0 | 100.0 | 100.0 | 100.0 | 100.0 | 100.0 | 100.0 | 100.0 | 100.0 | 100.0 | 100.0 | 100.0 |
| 91 | 100.0 | 100.0 | 100.0 | 100.0 | 100.0 | 100.0 | 100.0 | 100.0 | 100.0 | 100.0 | 100.0 | 100.0 |
| 90 | 100.0 | 100.0 | 100.0 | 100.0 | 100.0 | 100.0 | 100.0 | 100.0 | 100.0 | 100.0 | 100.0 | 100.0 |
| 89 | 100.0 | 100.0 | 100.0 | 100.0 | 100.0 | 100.0 | 100.0 | 100.0 | 100.0 | 100.0 | 100.0 | 100.0 |
| 88 | 100.0 | 100.0 | 100.0 | 100.0 | 100.0 | 100.0 | 100.0 | 100.0 | 100.0 | 100.0 | 100.0 | 100.0 |
| 87 | 100.0 | 100.0 | 100.0 | 100.0 | 100.0 | 100.0 | 100.0 | 100.0 | 100.0 | 100.0 | 100.0 | 100.0 |
| 86 | 100.0 | 100.0 | 100.0 | 100.0 | 100.0 | 100.0 | 100.0 | 100.0 | 100.0 | 100.0 | 100.0 | 100.0 |
| 85 | 100.0 | 100.0 | 100.0 | 100.0 | 100.0 | 100.0 | 100.0 | 100.0 | 100.0 | 100.0 | 100.0 | 100.0 |
| 84 | 100.0 | 100.0 | 100.0 | 100.0 | 100.0 | 100.0 | 100.0 | 100.0 | 100.0 | 100.0 | 100.0 | 100.0 |
| 83 | 100.0 | 100.0 | 100.0 | 100.0 | 100.0 | 100.0 | 100.0 | 100.0 | 100.0 | 100.0 | 100.0 | 100.0 |
| 82 | 100.0 | 100.0 | 100.0 | 100.0 | 100.0 | 100.0 | 100.0 | 100.0 | 100.0 | 100.0 | 100.0 | 100.0 |
| 81 | 100.0 | 100.0 | 100.0 | 100.0 | 100.0 | 100.0 | 100.0 | 100.0 | 100.0 | 100.0 | 100.0 | 100.0 |
| 80 | 100.0 | 100.0 | 100.0 | 100.0 | 100.0 | 100.0 | 100.0 | 100.0 | 100.0 | 100.0 | 100.0 | 100.0 |
| 79 | 100.0 | 100.0 | 100.0 | 100.0 | 100.0 | 100.0 | 100.0 | 100.0 | 100.0 | 100.0 | 100.0 | 100.0 |
| 78 | 100.0 | 100.0 | 100.0 | 100.0 | 100.0 | 100.0 | 100.0 | 100.0 | 100.0 | 100.0 | 100.0 | 100.0 |
| 77 | 100.0 | 100.0 | 100.0 | 100.0 | 100.0 | 100.0 | 100.0 | 100.0 | 100.0 | 100.0 | 100.0 | 100.0 |
| 76 | 100.0 | 100.0 | 100.0 | 100.0 | 100.0 | 100.0 | 100.0 | 100.0 | 100.0 | 100.0 | 100.0 | 100.0 |
| 75 | 100.0 | 100.0 | 100.0 | 100.0 | 100.0 | 100.0 | 100.0 | 100.0 | 100.0 | 100.0 | 100.0 | 100.0 |
| 74 | 100.0 | 100.0 | 100.0 | 100.0 | 100.0 | 100.0 | 99.9 | 100.0 | 100.0 | 100.0 | 100.0 | 100.0 |
| 73 | 100.0 | 100.0 | 100.0 | 100.0 | 100.0 | 100.0 | 99.8 | 100.0 | 100.0 | 100.0 | 100.0 | 100.0 |
| 72 | 100.0 | 100.0 | 100.0 | 100.0 | 100.0 | 100.0 | 99.7 | 100.0 | 100.0 | 100.0 | 100.0 | 100.0 |
| 71 | 100.0 | 100.0 | 100.0 | 100.0 | 100.0 | 100.0 | 99.6 | 100.0 | 100.0 | 100.0 | 100.0 | 100.0 |
| 70 | 100.0 | 100.0 | 100.0 | 100.0 | 100.0 | 100.0 | 99.5 | 100.0 | 100.0 | 100.0 | 100.0 | 100.0 |
| 69 | 100.0 | 100.0 | 100.0 | 100.0 | 100.0 | 99.9 | 99.1 | 99.7 | 100.0 | 100.0 | 100.0 | 100.0 |
| 68 | 100.0 | 100.0 | 100.0 | 100.0 | 100.0 | 99.8 | 98.7 | 99.3 | 100.0 | 100.0 | 100.0 | 100.0 |
| 67 | 100.0 | 100.0 | 100.0 | 100.0 | 100.0 | 99.8 | 98.3 | 99.0 | 99.9 | 99.9 | 100.0 | 100.0 |
| 66 | 100.0 | 100.0 | 100.0 | 100.0 | 100.0 | 99.7 | 97.9 | 98.6 | 99.9 | 99.9 | 100.0 | 100.0 |
| 65 | 100.0 | 100.0 | 100.0 | 100.0 | 100.0 | 99.6 | 97.5 | 98.3 | 99.9 | 99.9 | 100.0 | 100.0 |
| 64 | 100.0 | 100.0 | 100.0 | 100.0 | 99.9 | 98.5 | 94.1 | 93.8 | 98.8 | 99.8 | 100.0 | 100.0 |
| 63 | 100.0 | 100.0 | 100.0 | 100.0 | 99.8 | 97.3 | 90.7 | 89.3 | 97.7 | 99.8 | 100.0 | 100.0 |
| 62 | 100.0 | 100.0 | 100.0 | 99.9 | 99.6 | 96.2 | 87.4 | 84.7 | 96.6 | 99.7 | 99.9 | 99.9 |
| 61 | 100.0 | 100.0 | 100.0 | 99.9 | 99.5 | 95.0 | 84.0 | 80.2 | 95.5 | 99.7 | 99.9 | 99.9 |
| 60 | 100.0 | 100.0 | 100.0 | 99.9 | 99.4 | 93.9 | 80.6 | 75.7 | 94.4 | 99.6 | 99.9 | 99.9 |
| 59 | 100.0 | 100.0 | 100.0 | 99.7 | 98.0 | 87.5 | 70.0 | 65.8 | 88.3 | 98.5 | 99.8 | 99.9 |
| 58 | 100.0 | 100.0 | 99.9 | 99.6 | 96.5 | 81.1 | 59.4 | 55.9 | 82.2 | 97.4 | 99.7 | 99.9 |
| 57 | 100.0 | 99.9 | 99.9 | 99.4 | 95.1 | 74.6 | 48.7 | 45.9 | 76.0 | 96.3 | 99.7 | 99.8 |
| 56 | 100.0 | 99.9 | 99.8 | 99.3 | 93.6 | 68.2 | 38.1 | 36.0 | 69.9 | 95.2 | 99.6 | 99.8 |

Table 9A

| 1deg Low Temperature Below Probability | | | | | | | | | | | | |
|---|---|---|---|---|---|---|---|---|---|---|---|---|
| temp | Jan | Feb | Mar | Apr | May | Jun | Jul | Aug | Sep | Oct | Nov | Dec |
| 55 | 100.0 | 99.9 | 99.8 | 99.1 | 92.2 | 61.8 | 27.5 | 26.1 | 63.8 | 94.1 | 99.5 | 99.8 |
| 54 | 99.8 | 99.7 | 99.4 | 97.4 | 87.1 | 53.6 | 22.8 | 21.8 | 56.7 | 89.5 | 98.5 | 99.6 |
| 53 | 99.6 | 99.5 | 99.1 | 95.7 | 82.0 | 45.3 | 18.1 | 17.5 | 49.6 | 84.8 | 97.5 | 99.3 |
| 52 | 99.5 | 99.2 | 98.7 | 93.9 | 77.0 | 37.1 | 13.3 | 13.3 | 42.6 | 80.2 | 96.4 | 99.1 |
| 51 | 99.3 | 99.0 | 98.4 | 92.2 | 71.9 | 28.8 | 8.6 | 9.0 | 35.5 | 75.5 | 95.4 | 98.8 |
| 50 | 99.1 | 98.8 | 98.0 | 90.5 | 66.8 | 20.6 | 3.9 | 4.7 | 28.4 | 70.9 | 94.4 | 98.6 |
| 49 | 98.0 | 97.4 | 95.2 | 85.8 | 58.6 | 16.8 | 3.1 | 3.8 | 24.4 | 64.6 | 90.4 | 97.2 |
| 48 | 96.9 | 96.0 | 92.5 | 81.1 | 50.4 | 13.1 | 2.4 | 2.9 | 20.3 | 58.3 | 86.4 | 95.8 |
| 47 | 95.7 | 94.5 | 89.7 | 76.3 | 42.3 | 9.3 | 1.6 | 2.0 | 16.3 | 51.9 | 82.3 | 94.5 |
| 46 | 94.6 | 93.1 | 87.0 | 71.6 | 34.1 | 5.6 | 0.9 | 1.1 | 12.2 | 45.6 | 78.3 | 93.1 |
| 45 | 93.5 | 91.7 | 84.2 | 66.9 | 25.9 | 1.8 | 0.1 | 0.2 | 8.2 | 39.3 | 74.3 | 91.7 |
| 44 | 90.0 | 86.6 | 77.6 | 59.7 | 21.7 | 1.5 | 0.1 | 0.2 | 6.8 | 34.4 | 68.5 | 87.1 |
| 43 | 86.6 | 81.6 | 71.0 | 52.5 | 17.5 | 1.1 | 0.1 | 0.1 | 5.5 | 29.6 | 62.8 | 82.5 |
| 42 | 83.1 | 76.5 | 64.5 | 45.2 | 13.3 | 0.8 | 0.0 | 0.1 | 4.1 | 24.7 | 57.0 | 78.0 |
| 41 | 79.7 | 71.5 | 57.9 | 38.0 | 9.1 | 0.4 | 0.0 | 0.0 | 2.8 | 19.9 | 51.3 | 73.4 |
| 40 | 76.2 | 66.4 | 51.3 | 30.8 | 4.9 | 0.1 | 0.0 | 0.0 | 1.4 | 15.0 | 45.5 | 68.8 |
| 39 | 70.9 | 60.5 | 45.2 | 26.1 | 4.0 | 0.1 | 0.0 | 0.0 | 1.1 | 12.6 | 40.6 | 62.8 |
| 38 | 65.6 | 54.5 | 39.1 | 21.4 | 3.1 | 0.1 | 0.0 | 0.0 | 0.9 | 10.3 | 35.7 | 56.8 |
| 37 | 60.3 | 48.6 | 32.9 | 16.6 | 2.3 | 0.0 | 0.0 | 0.0 | 0.6 | 7.9 | 30.9 | 50.7 |
| 36 | 55.0 | 42.6 | 26.8 | 11.9 | 1.4 | 0.0 | 0.0 | 0.0 | 0.4 | 5.6 | 26.0 | 44.7 |
| 35 | 49.7 | 36.7 | 20.7 | 7.2 | 0.5 | 0.0 | 0.0 | 0.0 | 0.1 | 3.2 | 21.1 | 38.7 |
| 34 | 44.8 | 32.2 | 17.6 | 5.8 | 0.4 | 0.0 | 0.0 | 0.0 | 0.1 | 2.6 | 18.5 | 34.3 |
| 33 | 39.9 | 27.7 | 14.4 | 4.4 | 0.3 | 0.0 | 0.0 | 0.0 | 0.1 | 2.1 | 15.8 | 29.9 |
| 32 | 34.9 | 23.2 | 11.3 | 2.9 | 0.3 | 0.0 | 0.0 | 0.0 | 0.0 | 1.5 | 13.2 | 25.4 |
| 31 | 30.0 | 18.7 | 8.1 | 1.5 | 0.2 | 0.0 | 0.0 | 0.0 | 0.0 | 1.0 | 10.5 | 21.0 |
| 30 | 25.1 | 14.2 | 5.0 | 0.1 | 0.1 | 0.0 | 0.0 | 0.0 | 0.0 | 0.4 | 7.9 | 16.6 |
| 29 | 22.6 | 12.3 | 4.1 | 0.1 | 0.1 | 0.0 | 0.0 | 0.0 | 0.0 | 0.3 | 6.7 | 14.4 |
| 28 | 20.1 | 10.5 | 3.2 | 0.1 | 0.1 | 0.0 | 0.0 | 0.0 | 0.0 | 0.2 | 5.5 | 12.3 |
| 27 | 17.6 | 8.6 | 2.4 | 0.0 | 0.0 | 0.0 | 0.0 | 0.0 | 0.0 | 0.2 | 4.3 | 10.1 |
| 26 | 15.1 | 6.8 | 1.5 | 0.0 | 0.0 | 0.0 | 0.0 | 0.0 | 0.0 | 0.1 | 3.1 | 8.0 |
| 25 | 12.6 | 4.9 | 0.6 | 0.0 | 0.0 | 0.0 | 0.0 | 0.0 | 0.0 | 0.0 | 1.9 | 5.8 |
| 24 | 11.3 | 4.3 | 0.5 | 0.0 | 0.0 | 0.0 | 0.0 | 0.0 | 0.0 | 0.0 | 1.6 | 5.1 |
| 23 | 10.0 | 3.8 | 0.4 | 0.0 | 0.0 | 0.0 | 0.0 | 0.0 | 0.0 | 0.0 | 1.3 | 4.4 |
| 22 | 8.8 | 3.2 | 0.3 | 0.0 | 0.0 | 0.0 | 0.0 | 0.0 | 0.0 | 0.0 | 1.1 | 3.8 |
| 21 | 7.5 | 2.7 | 0.2 | 0.0 | 0.0 | 0.0 | 0.0 | 0.0 | 0.0 | 0.0 | 0.8 | 3.1 |
| 20 | 6.2 | 2.1 | 0.1 | 0.0 | 0.0 | 0.0 | 0.0 | 0.0 | 0.0 | 0.0 | 0.5 | 2.4 |
| 19 | 5.4 | 1.8 | 0.1 | 0.0 | 0.0 | 0.0 | 0.0 | 0.0 | 0.0 | 0.0 | 0.4 | 2.1 |
| 18 | 4.6 | 1.5 | 0.1 | 0.0 | 0.0 | 0.0 | 0.0 | 0.0 | 0.0 | 0.0 | 0.3 | 1.8 |
| 17 | 3.8 | 1.2 | 0.0 | 0.0 | 0.0 | 0.0 | 0.0 | 0.0 | 0.0 | 0.0 | 0.3 | 1.6 |
| 16 | 3.0 | 0.9 | 0.0 | 0.0 | 0.0 | 0.0 | 0.0 | 0.0 | 0.0 | 0.0 | 0.2 | 1.3 |
| 15 | 2.2 | 0.6 | 0.0 | 0.0 | 0.0 | 0.0 | 0.0 | 0.0 | 0.0 | 0.0 | 0.1 | 1.0 |
| 14 | 1.9 | 0.5 | 0.0 | 0.0 | 0.0 | 0.0 | 0.0 | 0.0 | 0.0 | 0.0 | 0.1 | 0.9 |
| 13 | 1.5 | 0.5 | 0.0 | 0.0 | 0.0 | 0.0 | 0.0 | 0.0 | 0.0 | 0.0 | 0.1 | 0.7 |
| 12 | 1.2 | 0.4 | 0.0 | 0.0 | 0.0 | 0.0 | 0.0 | 0.0 | 0.0 | 0.0 | 0.0 | 0.6 |
| 11 | 0.8 | 0.4 | 0.0 | 0.0 | 0.0 | 0.0 | 0.0 | 0.0 | 0.0 | 0.0 | 0.0 | 0.4 |

Table 9B

| 1deg Low Temperature Below Probability | | | | | | | | | | | | |
|---|---|---|---|---|---|---|---|---|---|---|---|---|
| temp | Jan | Feb | Mar | Apr | May | Jun | Jul | Aug | Sep | Oct | Nov | Dec |
| 10 | 0.5 | 0.3 | 0.0 | 0.0 | 0.0 | 0.0 | 0.0 | 0.0 | 0.0 | 0.0 | 0.0 | 0.3 |
| 9 | 0.4 | 0.3 | 0.0 | 0.0 | 0.0 | 0.0 | 0.0 | 0.0 | 0.0 | 0.0 | 0.0 | 0.2 |
| 8 | 0.3 | 0.3 | 0.0 | 0.0 | 0.0 | 0.0 | 0.0 | 0.0 | 0.0 | 0.0 | 0.0 | 0.2 |
| 7 | 0.3 | 0.2 | 0.0 | 0.0 | 0.0 | 0.0 | 0.0 | 0.0 | 0.0 | 0.0 | 0.0 | 0.1 |
| 6 | 0.2 | 0.2 | 0.0 | 0.0 | 0.0 | 0.0 | 0.0 | 0.0 | 0.0 | 0.0 | 0.0 | 0.1 |
| 5 | 0.1 | 0.2 | 0.0 | 0.0 | 0.0 | 0.0 | 0.0 | 0.0 | 0.0 | 0.0 | 0.0 | 0.0 |
| 4 | 0.1 | 0.2 | 0.0 | 0.0 | 0.0 | 0.0 | 0.0 | 0.0 | 0.0 | 0.0 | 0.0 | 0.0 |
| 3 | 0.1 | 0.2 | 0.0 | 0.0 | 0.0 | 0.0 | 0.0 | 0.0 | 0.0 | 0.0 | 0.0 | 0.0 |
| 2 | 0.1 | 0.1 | 0.0 | 0.0 | 0.0 | 0.0 | 0.0 | 0.0 | 0.0 | 0.0 | 0.0 | 0.0 |
| 1 | 0.1 | 0.1 | 0.0 | 0.0 | 0.0 | 0.0 | 0.0 | 0.0 | 0.0 | 0.0 | 0.0 | 0.0 |
| 0 | 0.1 | 0.1 | 0.0 | 0.0 | 0.0 | 0.0 | 0.0 | 0.0 | 0.0 | 0.0 | 0.0 | 0.0 |
| -1 | 0.1 | 0.1 | 0.0 | 0.0 | 0.0 | 0.0 | 0.0 | 0.0 | 0.0 | 0.0 | 0.0 | 0.0 |
| -2 | 0.1 | 0.1 | 0.0 | 0.0 | 0.0 | 0.0 | 0.0 | 0.0 | 0.0 | 0.0 | 0.0 | 0.0 |
| -3 | 0.0 | 0.0 | 0.0 | 0.0 | 0.0 | 0.0 | 0.0 | 0.0 | 0.0 | 0.0 | 0.0 | 0.0 |
| -4 | 0.0 | 0.0 | 0.0 | 0.0 | 0.0 | 0.0 | 0.0 | 0.0 | 0.0 | 0.0 | 0.0 | 0.0 |
| -5 | 0.0 | 0.0 | 0.0 | 0.0 | 0.0 | 0.0 | 0.0 | 0.0 | 0.0 | 0.0 | 0.0 | 0.0 |

Table 9C

| | Monthly Days with High Temp Above - for Cooling | | | | | | | | | | | |
|---|---|---|---|---|---|---|---|---|---|---|---|---|
| temp | Jan | Feb | Mar | Apr | May | Jun | Jul | Aug | Sep | Oct | Nov | Dec |
| 105 | 0.0 | 0.0 | 0.0 | 0.0 | 0.0 | 0.0 | 0.1 | 0.1 | 0.0 | 0.0 | 0.0 | 0.0 |
| 104 | 0.0 | 0.0 | 0.0 | 0.0 | 0.0 | 0.0 | 0.1 | 0.1 | 0.0 | 0.0 | 0.0 | 0.0 |
| 103 | 0.0 | 0.0 | 0.0 | 0.0 | 0.0 | 0.0 | 0.0 | 0.2 | 0.0 | 0.0 | 0.0 | 0.0 |
| 102 | 0.0 | 0.0 | 0.0 | 0.0 | 0.0 | 0.0 | 0.0 | 0.3 | 0.0 | 0.0 | 0.0 | 0.0 |
| 101 | 0.0 | 0.0 | 0.0 | 0.0 | 0.0 | 0.0 | 0.0 | 0.4 | 0.0 | 0.0 | 0.0 | 0.0 |
| 100 | 0.0 | 0.0 | 0.0 | 0.0 | 0.0 | 0.0 | 0.0 | 0.5 | 0.0 | 0.0 | 0.0 | 0.0 |
| 99 | 0.0 | 0.0 | 0.0 | 0.0 | 0.0 | 0.1 | 0.3 | 0.6 | 0.1 | 0.0 | 0.0 | 0.0 |
| 98 | 0.0 | 0.0 | 0.0 | 0.0 | 0.0 | 0.2 | 0.6 | 0.8 | 0.1 | 0.0 | 0.0 | 0.0 |
| 97 | 0.0 | 0.0 | 0.0 | 0.0 | 0.0 | 0.2 | 0.8 | 1.0 | 0.2 | 0.0 | 0.0 | 0.0 |
| 96 | 0.0 | 0.0 | 0.0 | 0.0 | 0.0 | 0.3 | 1.1 | 1.2 | 0.2 | 0.0 | 0.0 | 0.0 |
| 95 | 0.0 | 0.0 | 0.0 | 0.0 | 0.1 | 0.3 | 1.4 | 1.4 | 0.3 | 0.0 | 0.0 | 0.0 |
| 94 | 0.0 | 0.0 | 0.0 | 0.0 | 0.1 | 0.5 | 1.8 | 1.9 | 0.5 | 0.0 | 0.0 | 0.0 |
| 93 | 0.0 | 0.0 | 0.0 | 0.0 | 0.2 | 0.7 | 2.3 | 2.3 | 0.7 | 0.0 | 0.0 | 0.0 |
| 92 | 0.0 | 0.0 | 0.0 | 0.0 | 0.2 | 0.9 | 2.7 | 2.8 | 0.9 | 0.0 | 0.0 | 0.0 |
| 91 | 0.0 | 0.0 | 0.0 | 0.0 | 0.3 | 1.1 | 3.2 | 3.3 | 1.1 | 0.0 | 0.0 | 0.0 |
| 90 | 0.0 | 0.0 | 0.0 | 0.1 | 0.3 | 1.3 | 3.6 | 3.8 | 1.4 | 0.1 | 0.0 | 0.0 |
| 89 | 0.0 | 0.0 | 0.0 | 0.1 | 0.6 | 1.8 | 4.5 | 4.7 | 1.8 | 0.1 | 0.0 | 0.0 |
| 88 | 0.0 | 0.0 | 0.0 | 0.1 | 0.8 | 2.2 | 5.5 | 5.5 | 2.3 | 0.2 | 0.0 | 0.0 |
| 87 | 0.0 | 0.0 | 0.0 | 0.1 | 1.1 | 2.7 | 6.4 | 6.3 | 2.8 | 0.2 | 0.0 | 0.0 |
| 86 | 0.0 | 0.0 | 0.0 | 0.2 | 1.3 | 3.2 | 7.4 | 7.2 | 3.3 | 0.3 | 0.0 | 0.0 |
| 85 | 0.0 | 0.0 | 0.0 | 0.2 | 1.6 | 3.6 | 8.3 | 8.0 | 3.8 | 0.3 | 0.0 | 0.0 |
| 84 | 0.0 | 0.0 | 0.0 | 0.3 | 1.9 | 4.3 | 9.6 | 9.2 | 4.6 | 0.4 | 0.0 | 0.0 |
| 83 | 0.0 | 0.0 | 0.0 | 0.4 | 2.3 | 5.0 | 10.9 | 10.3 | 5.4 | 0.5 | 0.0 | 0.0 |
| 82 | 0.0 | 0.0 | 0.0 | 0.5 | 2.7 | 5.7 | 12.2 | 11.5 | 6.1 | 0.6 | 0.0 | 0.0 |
| 81 | 0.0 | 0.0 | 0.0 | 0.6 | 3.1 | 6.3 | 13.4 | 12.6 | 6.9 | 0.7 | 0.0 | 0.0 |
| 80 | 0.0 | 0.0 | 0.0 | 0.7 | 3.5 | 7.0 | 14.7 | 13.8 | 7.6 | 0.8 | 0.0 | 0.0 |
| 79 | 0.0 | 0.0 | 0.1 | 1.0 | 4.2 | 8.0 | 16.1 | 15.4 | 8.7 | 1.2 | 0.0 | 0.0 |
| 78 | 0.0 | 0.0 | 0.1 | 1.3 | 4.8 | 8.9 | 17.5 | 17.0 | 9.8 | 1.6 | 0.0 | 0.0 |
| 77 | 0.0 | 0.0 | 0.1 | 1.6 | 5.5 | 9.9 | 18.9 | 18.6 | 10.9 | 2.0 | 0.0 | 0.0 |
| 76 | 0.0 | 0.0 | 0.1 | 2.0 | 6.1 | 10.8 | 20.3 | 20.2 | 12.0 | 2.4 | 0.0 | 0.0 |
| 75 | 0.0 | 0.0 | 0.2 | 2.3 | 6.8 | 11.8 | 21.7 | 21.8 | 13.1 | 2.8 | 0.0 | 0.0 |
| 74 | 0.0 | 0.0 | 0.4 | 2.9 | 7.7 | 13.1 | 22.9 | 23.0 | 14.4 | 3.5 | 0.0 | 0.0 |
| 73 | 0.0 | 0.0 | 0.6 | 3.5 | 8.6 | 14.5 | 24.1 | 24.3 | 15.8 | 4.3 | 0.0 | 0.0 |
| 72 | 0.0 | 0.0 | 0.8 | 4.1 | 9.6 | 15.9 | 25.3 | 25.5 | 17.1 | 5.0 | 0.0 | 0.0 |
| 71 | 0.0 | 0.0 | 1.0 | 4.8 | 10.5 | 17.2 | 26.5 | 26.8 | 18.5 | 5.7 | 0.0 | 0.0 |
| 70 | 0.0 | 0.0 | 1.2 | 5.4 | 11.4 | 18.6 | 27.7 | 28.0 | 19.8 | 6.4 | 0.1 | 0.0 |
| 69 | 0.0 | 0.1 | 1.7 | 6.2 | 12.6 | 20.0 | 28.3 | 28.5 | 21.1 | 7.8 | 0.2 | 0.0 |
| 68 | 0.0 | 0.1 | 2.1 | 7.0 | 13.8 | 21.3 | 28.8 | 29.0 | 22.4 | 9.1 | 0.3 | 0.0 |
| 67 | 0.0 | 0.2 | 2.5 | 7.7 | 14.9 | 22.7 | 29.4 | 29.5 | 23.7 | 10.5 | 0.5 | 0.0 |
| 66 | 0.0 | 0.3 | 3.0 | 8.5 | 16.1 | 24.1 | 30.0 | 30.0 | 25.0 | 11.8 | 0.6 | 0.0 |
| 65 | 0.0 | 0.3 | 3.4 | 9.3 | 17.3 | 25.5 | 30.5 | 30.5 | 26.3 | 13.1 | 0.7 | 0.0 |
| 64 | 0.1 | 0.6 | 4.3 | 10.6 | 18.8 | 26.2 | 30.6 | 30.6 | 26.9 | 14.9 | 1.3 | 0.1 |
| 63 | 0.2 | 1.0 | 5.2 | 11.9 | 20.4 | 27.0 | 30.7 | 30.7 | 27.6 | 16.7 | 2.0 | 0.2 |
| 62 | 0.3 | 1.3 | 6.1 | 13.1 | 22.0 | 27.7 | 30.8 | 30.8 | 28.2 | 18.5 | 2.6 | 0.3 |
| 61 | 0.3 | 1.7 | 7.1 | 14.4 | 23.5 | 28.5 | 30.9 | 30.9 | 28.8 | 20.3 | 3.2 | 0.4 |

Table 10A

| | Monthly Days with High Temp Above - for Cooling | | | | | | | | | | | |
|---|---|---|---|---|---|---|---|---|---|---|---|---|
| temp | Jan | Feb | Mar | Apr | May | Jun | Jul | Aug | Sep | Oct | Nov | Dec |
| 60 | 0.4 | 2.0 | 8.0 | 15.6 | 25.1 | 29.2 | 31.0 | 31.0 | 29.5 | 22.1 | 3.8 | 0.5 |
| 59 | 0.8 | 2.9 | 9.6 | 17.3 | 26.1 | 29.4 | 31.0 | 31.0 | 29.6 | 23.3 | 5.4 | 1.0 |
| 58 | 1.3 | 3.8 | 11.2 | 19.0 | 27.0 | 29.5 | 31.0 | 31.0 | 29.7 | 24.6 | 7.1 | 1.5 |
| 57 | 1.7 | 4.7 | 12.8 | 20.7 | 28.0 | 29.7 | 31.0 | 31.0 | 29.7 | 25.8 | 8.7 | 2.1 |
| 56 | 2.2 | 5.6 | 14.4 | 22.4 | 29.0 | 29.8 | 31.0 | 31.0 | 29.8 | 27.1 | 10.3 | 2.6 |
| 55 | 2.6 | 6.5 | 16.0 | 24.2 | 29.9 | 29.9 | 31.0 | 31.0 | 29.9 | 28.3 | 12.0 | 3.1 |
| 54 | 3.8 | 8.3 | 17.9 | 25.1 | 30.2 | 30.0 | 31.0 | 31.0 | 30.0 | 28.8 | 13.8 | 4.5 |
| 53 | 4.9 | 10.0 | 19.8 | 26.0 | 30.4 | 30.0 | 31.0 | 31.0 | 30.0 | 29.2 | 15.6 | 5.8 |
| 52 | 6.1 | 11.8 | 21.7 | 27.0 | 30.6 | 30.0 | 31.0 | 31.0 | 30.0 | 29.7 | 17.5 | 7.2 |
| 51 | 7.2 | 13.6 | 23.7 | 27.9 | 30.8 | 30.0 | 31.0 | 31.0 | 30.0 | 30.1 | 19.3 | 8.6 |
| 50 | 8.3 | 15.3 | 25.6 | 28.9 | 31.0 | 30.0 | 31.0 | 31.0 | 30.0 | 30.6 | 21.1 | 10.0 |
| 49 | 10.1 | 16.9 | 26.4 | 29.1 | 31.0 | 30.0 | 31.0 | 31.0 | 30.0 | 30.7 | 22.3 | 11.8 |
| 48 | 11.8 | 18.4 | 27.3 | 29.3 | 31.0 | 30.0 | 31.0 | 31.0 | 30.0 | 30.7 | 23.4 | 13.6 |
| 47 | 13.5 | 20.0 | 28.2 | 29.5 | 31.0 | 30.0 | 31.0 | 31.0 | 30.0 | 30.8 | 24.6 | 15.4 |
| 46 | 15.2 | 21.5 | 29.0 | 29.7 | 31.0 | 30.0 | 31.0 | 31.0 | 30.0 | 30.8 | 25.8 | 17.2 |
| 45 | 17.0 | 23.0 | 29.9 | 29.9 | 31.0 | 30.0 | 31.0 | 31.0 | 30.0 | 30.9 | 26.9 | 19.0 |
| 44 | 18.3 | 23.6 | 30.1 | 29.9 | 31.0 | 30.0 | 31.0 | 31.0 | 30.0 | 30.9 | 27.4 | 20.6 |
| 43 | 19.7 | 24.2 | 30.3 | 29.9 | 31.0 | 30.0 | 31.0 | 31.0 | 30.0 | 30.9 | 27.9 | 22.1 |
| 42 | 21.0 | 24.8 | 30.5 | 29.9 | 31.0 | 30.0 | 31.0 | 31.0 | 30.0 | 30.9 | 28.3 | 23.7 |
| 41 | 22.4 | 25.4 | 30.6 | 30.0 | 31.0 | 30.0 | 31.0 | 31.0 | 30.0 | 31.0 | 28.8 | 25.3 |
| 40 | 23.7 | 26.0 | 30.8 | 30.0 | 31.0 | 30.0 | 31.0 | 31.0 | 30.0 | 31.0 | 29.3 | 26.8 |
| 39 | 24.5 | 26.3 | 30.8 | 30.0 | 31.0 | 30.0 | 31.0 | 31.0 | 30.0 | 31.0 | 29.3 | 27.4 |
| 38 | 25.2 | 26.5 | 30.9 | 30.0 | 31.0 | 30.0 | 31.0 | 31.0 | 30.0 | 31.0 | 29.4 | 27.9 |
| 37 | 25.9 | 26.7 | 30.9 | 30.0 | 31.0 | 30.0 | 31.0 | 31.0 | 30.0 | 31.0 | 29.5 | 28.5 |
| 36 | 26.6 | 26.9 | 30.9 | 30.0 | 31.0 | 30.0 | 31.0 | 31.0 | 30.0 | 31.0 | 29.6 | 29.0 |
| 35 | 27.3 | 27.2 | 31.0 | 30.0 | 31.0 | 30.0 | 31.0 | 31.0 | 30.0 | 31.0 | 29.7 | 29.6 |
| 34 | 27.8 | 27.3 | 31.0 | 30.0 | 31.0 | 30.0 | 31.0 | 31.0 | 30.0 | 31.0 | 29.7 | 29.7 |
| 33 | 28.2 | 27.4 | 31.0 | 30.0 | 31.0 | 30.0 | 31.0 | 31.0 | 30.0 | 31.0 | 29.8 | 29.9 |
| 32 | 28.7 | 27.5 | 31.0 | 30.0 | 31.0 | 30.0 | 31.0 | 31.0 | 30.0 | 31.0 | 29.8 | 30.1 |
| 31 | 29.2 | 27.6 | 31.0 | 30.0 | 31.0 | 30.0 | 31.0 | 31.0 | 30.0 | 31.0 | 29.8 | 30.2 |
| 30 | 29.6 | 27.7 | 31.0 | 30.0 | 31.0 | 30.0 | 31.0 | 31.0 | 30.0 | 31.0 | 29.8 | 30.4 |
| 29 | 29.8 | 27.8 | 31.0 | 30.0 | 31.0 | 30.0 | 31.0 | 31.0 | 30.0 | 31.0 | 29.9 | 30.4 |
| 28 | 30.0 | 27.8 | 31.0 | 30.0 | 31.0 | 30.0 | 31.0 | 31.0 | 30.0 | 31.0 | 29.9 | 30.5 |
| 27 | 30.1 | 27.8 | 31.0 | 30.0 | 31.0 | 30.0 | 31.0 | 31.0 | 30.0 | 31.0 | 29.9 | 30.6 |
| 26 | 30.3 | 27.9 | 31.0 | 30.0 | 31.0 | 30.0 | 31.0 | 31.0 | 30.0 | 31.0 | 30.0 | 30.6 |
| 25 | 30.5 | 27.9 | 31.0 | 30.0 | 31.0 | 30.0 | 31.0 | 31.0 | 30.0 | 31.0 | 30.0 | 30.7 |
| 24 | 30.6 | 27.9 | 31.0 | 30.0 | 31.0 | 30.0 | 31.0 | 31.0 | 30.0 | 31.0 | 30.0 | 30.7 |
| 23 | 30.7 | 27.9 | 31.0 | 30.0 | 31.0 | 30.0 | 31.0 | 31.0 | 30.0 | 31.0 | 30.0 | 30.8 |
| 22 | 30.8 | 27.9 | 31.0 | 30.0 | 31.0 | 30.0 | 31.0 | 31.0 | 30.0 | 31.0 | 30.0 | 30.8 |
| 21 | 30.9 | 27.9 | 31.0 | 30.0 | 31.0 | 30.0 | 31.0 | 31.0 | 30.0 | 31.0 | 30.0 | 30.8 |
| 20 | 30.9 | 27.9 | 31.0 | 30.0 | 31.0 | 30.0 | 31.0 | 31.0 | 30.0 | 31.0 | 30.0 | 30.9 |
| 19 | 31.0 | 28.0 | 31.0 | 30.0 | 31.0 | 30.0 | 31.0 | 31.0 | 30.0 | 31.0 | 30.0 | 30.9 |
| 18 | 31.0 | 28.0 | 31.0 | 30.0 | 31.0 | 30.0 | 31.0 | 31.0 | 30.0 | 31.0 | 30.0 | 30.9 |
| 17 | 31.0 | 28.0 | 31.0 | 30.0 | 31.0 | 30.0 | 31.0 | 31.0 | 30.0 | 31.0 | 30.0 | 30.9 |
| 16 | 31.0 | 28.0 | 31.0 | 30.0 | 31.0 | 30.0 | 31.0 | 31.0 | 30.0 | 31.0 | 30.0 | 31.0 |
| 15 | 31.0 | 28.0 | 31.0 | 30.0 | 31.0 | 30.0 | 31.0 | 31.0 | 30.0 | 31.0 | 30.0 | 31.0 |

Table 10B

| Monthly Days with Low Temp Below - for Heating | | | | | | | | | | | | |
|---|---|---|---|---|---|---|---|---|---|---|---|---|
| temp | Jan | Feb | Mar | Apr | May | Jun | Jul | Aug | Sep | Oct | Nov | Year |
| 100 | 31.0 | 28.0 | 31.0 | 30.0 | 31.0 | 30.0 | 31.0 | 31.0 | 30.0 | 31.0 | 30.0 | 31.0 |
| 99 | 31.0 | 28.0 | 31.0 | 30.0 | 31.0 | 30.0 | 31.0 | 31.0 | 30.0 | 31.0 | 30.0 | 31.0 |
| 98 | 31.0 | 28.0 | 31.0 | 30.0 | 31.0 | 30.0 | 31.0 | 31.0 | 30.0 | 31.0 | 30.0 | 31.0 |
| 97 | 31.0 | 28.0 | 31.0 | 30.0 | 31.0 | 30.0 | 31.0 | 31.0 | 30.0 | 31.0 | 30.0 | 31.0 |
| 96 | 31.0 | 28.0 | 31.0 | 30.0 | 31.0 | 30.0 | 31.0 | 31.0 | 30.0 | 31.0 | 30.0 | 31.0 |
| 95 | 31.0 | 28.0 | 31.0 | 30.0 | 31.0 | 30.0 | 31.0 | 31.0 | 30.0 | 31.0 | 30.0 | 31.0 |
| 94 | 31.0 | 28.0 | 31.0 | 30.0 | 31.0 | 30.0 | 31.0 | 31.0 | 30.0 | 31.0 | 30.0 | 31.0 |
| 93 | 31.0 | 28.0 | 31.0 | 30.0 | 31.0 | 30.0 | 31.0 | 31.0 | 30.0 | 31.0 | 30.0 | 31.0 |
| 92 | 31.0 | 28.0 | 31.0 | 30.0 | 31.0 | 30.0 | 31.0 | 31.0 | 30.0 | 31.0 | 30.0 | 31.0 |
| 91 | 31.0 | 28.0 | 31.0 | 30.0 | 31.0 | 30.0 | 31.0 | 31.0 | 30.0 | 31.0 | 30.0 | 31.0 |
| 90 | 31.0 | 28.0 | 31.0 | 30.0 | 31.0 | 30.0 | 31.0 | 31.0 | 30.0 | 31.0 | 30.0 | 31.0 |
| 89 | 31.0 | 28.0 | 31.0 | 30.0 | 31.0 | 30.0 | 31.0 | 31.0 | 30.0 | 31.0 | 30.0 | 31.0 |
| 88 | 31.0 | 28.0 | 31.0 | 30.0 | 31.0 | 30.0 | 31.0 | 31.0 | 30.0 | 31.0 | 30.0 | 31.0 |
| 87 | 31.0 | 28.0 | 31.0 | 30.0 | 31.0 | 30.0 | 31.0 | 31.0 | 30.0 | 31.0 | 30.0 | 31.0 |
| 86 | 31.0 | 28.0 | 31.0 | 30.0 | 31.0 | 30.0 | 31.0 | 31.0 | 30.0 | 31.0 | 30.0 | 31.0 |
| 85 | 31.0 | 28.0 | 31.0 | 30.0 | 31.0 | 30.0 | 31.0 | 31.0 | 30.0 | 31.0 | 30.0 | 31.0 |
| 84 | 31.0 | 28.0 | 31.0 | 30.0 | 31.0 | 30.0 | 31.0 | 31.0 | 30.0 | 31.0 | 30.0 | 31.0 |
| 83 | 31.0 | 28.0 | 31.0 | 30.0 | 31.0 | 30.0 | 31.0 | 31.0 | 30.0 | 31.0 | 30.0 | 31.0 |
| 82 | 31.0 | 28.0 | 31.0 | 30.0 | 31.0 | 30.0 | 31.0 | 31.0 | 30.0 | 31.0 | 30.0 | 31.0 |
| 81 | 31.0 | 28.0 | 31.0 | 30.0 | 31.0 | 30.0 | 31.0 | 31.0 | 30.0 | 31.0 | 30.0 | 31.0 |
| 80 | 31.0 | 28.0 | 31.0 | 30.0 | 31.0 | 30.0 | 31.0 | 31.0 | 30.0 | 31.0 | 30.0 | 31.0 |
| 79 | 31.0 | 28.0 | 31.0 | 30.0 | 31.0 | 30.0 | 31.0 | 31.0 | 30.0 | 31.0 | 30.0 | 31.0 |
| 78 | 31.0 | 28.0 | 31.0 | 30.0 | 31.0 | 30.0 | 31.0 | 31.0 | 30.0 | 31.0 | 30.0 | 31.0 |
| 77 | 31.0 | 28.0 | 31.0 | 30.0 | 31.0 | 30.0 | 31.0 | 31.0 | 30.0 | 31.0 | 30.0 | 31.0 |
| 76 | 31.0 | 28.0 | 31.0 | 30.0 | 31.0 | 30.0 | 31.0 | 31.0 | 30.0 | 31.0 | 30.0 | 31.0 |
| 75 | 31.0 | 28.0 | 31.0 | 30.0 | 31.0 | 30.0 | 31.0 | 31.0 | 30.0 | 31.0 | 30.0 | 31.0 |
| 74 | 31.0 | 28.0 | 31.0 | 30.0 | 31.0 | 30.0 | 31.0 | 31.0 | 30.0 | 31.0 | 30.0 | 31.0 |
| 73 | 31.0 | 28.0 | 31.0 | 30.0 | 31.0 | 30.0 | 30.9 | 31.0 | 30.0 | 31.0 | 30.0 | 31.0 |
| 72 | 31.0 | 28.0 | 31.0 | 30.0 | 31.0 | 30.0 | 30.9 | 31.0 | 30.0 | 31.0 | 30.0 | 31.0 |
| 71 | 31.0 | 28.0 | 31.0 | 30.0 | 31.0 | 30.0 | 30.9 | 31.0 | 30.0 | 31.0 | 30.0 | 31.0 |
| 70 | 31.0 | 28.0 | 31.0 | 30.0 | 31.0 | 30.0 | 30.8 | 31.0 | 30.0 | 31.0 | 30.0 | 31.0 |
| 69 | 31.0 | 28.0 | 31.0 | 30.0 | 31.0 | 30.0 | 30.7 | 30.9 | 30.0 | 31.0 | 30.0 | 31.0 |
| 68 | 31.0 | 28.0 | 31.0 | 30.0 | 31.0 | 30.0 | 30.6 | 30.8 | 30.0 | 31.0 | 30.0 | 31.0 |
| 67 | 31.0 | 28.0 | 31.0 | 30.0 | 31.0 | 29.9 | 30.5 | 30.7 | 30.0 | 31.0 | 30.0 | 31.0 |
| 66 | 31.0 | 28.0 | 31.0 | 30.0 | 31.0 | 29.9 | 30.3 | 30.6 | 30.0 | 31.0 | 30.0 | 31.0 |
| 65 | 31.0 | 28.0 | 31.0 | 30.0 | 31.0 | 29.9 | 30.2 | 30.5 | 30.0 | 31.0 | 30.0 | 31.0 |
| 64 | 31.0 | 28.0 | 31.0 | 30.0 | 31.0 | 29.5 | 29.2 | 29.1 | 29.6 | 31.0 | 30.0 | 31.0 |
| 63 | 31.0 | 28.0 | 31.0 | 30.0 | 30.9 | 29.2 | 28.1 | 27.7 | 29.3 | 30.9 | 30.0 | 31.0 |
| 62 | 31.0 | 28.0 | 31.0 | 30.0 | 30.9 | 28.9 | 27.1 | 26.3 | 29.0 | 30.9 | 30.0 | 31.0 |
| 61 | 31.0 | 28.0 | 31.0 | 30.0 | 30.9 | 28.5 | 26.0 | 24.9 | 28.7 | 30.9 | 30.0 | 31.0 |
| 60 | 31.0 | 28.0 | 31.0 | 30.0 | 30.8 | 28.2 | 25.0 | 23.5 | 28.3 | 30.9 | 30.0 | 31.0 |
| 59 | 31.0 | 28.0 | 31.0 | 29.9 | 30.4 | 26.2 | 21.7 | 20.4 | 26.5 | 30.5 | 29.9 | 31.0 |
| 58 | 31.0 | 28.0 | 31.0 | 29.9 | 29.9 | 24.3 | 18.4 | 17.3 | 24.6 | 30.2 | 29.9 | 31.0 |
| 57 | 31.0 | 28.0 | 31.0 | 29.8 | 29.5 | 22.4 | 15.1 | 14.2 | 22.8 | 29.9 | 29.9 | 31.0 |
| 56 | 31.0 | 28.0 | 31.0 | 29.8 | 29.0 | 20.5 | 11.8 | 11.2 | 21.0 | 29.5 | 29.9 | 30.9 |

Table 11A

| Monthly Days with Low Temp Below - for Heating | | | | | | | | | | | | |
|---|---|---|---|---|---|---|---|---|---|---|---|---|
| temp | Jan | Feb | Mar | Apr | May | Jun | Jul | Aug | Sep | Oct | Nov | Year |
| 55 | 31.0 | 28.0 | 30.9 | 29.7 | 28.6 | 18.5 | 8.5 | 8.1 | 19.1 | 29.2 | 29.9 | 30.9 |
| 54 | 30.9 | 27.9 | 30.8 | 29.2 | 27.0 | 16.1 | 7.1 | 6.8 | 17.0 | 27.7 | 29.5 | 30.9 |
| 53 | 30.9 | 27.8 | 30.7 | 28.7 | 25.4 | 13.6 | 5.6 | 5.4 | 14.9 | 26.3 | 29.2 | 30.8 |
| 52 | 30.8 | 27.8 | 30.6 | 28.2 | 23.9 | 11.1 | 4.1 | 4.1 | 12.8 | 24.9 | 28.9 | 30.7 |
| 51 | 30.8 | 27.7 | 30.5 | 27.7 | 22.3 | 8.7 | 2.7 | 2.8 | 10.6 | 23.4 | 28.6 | 30.6 |
| 50 | 30.7 | 27.7 | 30.4 | 27.2 | 20.7 | 6.2 | 1.2 | 1.5 | 8.5 | 22.0 | 28.3 | 30.6 |
| 49 | 30.4 | 27.3 | 29.5 | 25.7 | 18.2 | 5.1 | 1.0 | 1.2 | 7.3 | 20.0 | 27.1 | 30.1 |
| 48 | 30.0 | 26.9 | 28.7 | 24.3 | 15.6 | 3.9 | 0.7 | 0.9 | 6.1 | 18.1 | 25.9 | 29.7 |
| 47 | 29.7 | 26.5 | 27.8 | 22.9 | 13.1 | 2.8 | 0.5 | 0.6 | 4.9 | 16.1 | 24.7 | 29.3 |
| 46 | 29.3 | 26.1 | 27.0 | 21.5 | 10.6 | 1.7 | 0.3 | 0.3 | 3.7 | 14.1 | 23.5 | 28.9 |
| 45 | 29.0 | 25.7 | 26.1 | 20.1 | 8.0 | 0.5 | 0.0 | 0.1 | 2.5 | 12.2 | 22.3 | 28.4 |
| 44 | 27.9 | 24.3 | 24.1 | 17.9 | 6.7 | 0.4 | 0.0 | 0.0 | 2.1 | 10.7 | 20.6 | 27.0 |
| 43 | 26.8 | 22.8 | 22.0 | 15.7 | 5.4 | 0.3 | 0.0 | 0.0 | 1.6 | 9.2 | 18.8 | 25.6 |
| 42 | 25.8 | 21.4 | 20.0 | 13.6 | 4.1 | 0.2 | 0.0 | 0.0 | 1.2 | 7.7 | 17.1 | 24.2 |
| 41 | 24.7 | 20.0 | 17.9 | 11.4 | 2.8 | 0.1 | 0.0 | 0.0 | 0.8 | 6.2 | 15.4 | 22.7 |
| 40 | 23.6 | 18.6 | 15.9 | 9.2 | 1.5 | 0.0 | 0.0 | 0.0 | 0.4 | 4.7 | 13.7 | 21.3 |
| 39 | 22.0 | 16.9 | 14.0 | 7.8 | 1.2 | 0.0 | 0.0 | 0.0 | 0.3 | 3.9 | 12.2 | 19.5 |
| 38 | 20.3 | 15.3 | 12.1 | 6.4 | 1.0 | 0.0 | 0.0 | 0.0 | 0.3 | 3.2 | 10.7 | 17.6 |
| 37 | 18.7 | 13.6 | 10.2 | 5.0 | 0.7 | 0.0 | 0.0 | 0.0 | 0.2 | 2.5 | 9.3 | 15.7 |
| 36 | 17.1 | 11.9 | 8.3 | 3.6 | 0.4 | 0.0 | 0.0 | 0.0 | 0.1 | 1.7 | 7.8 | 13.9 |
| 35 | 15.4 | 10.3 | 6.4 | 2.2 | 0.2 | 0.0 | 0.0 | 0.0 | 0.0 | 1.0 | 6.3 | 12.0 |
| 34 | 13.9 | 9.0 | 5.4 | 1.7 | 0.1 | 0.0 | 0.0 | 0.0 | 0.0 | 0.8 | 5.5 | 10.6 |
| 33 | 12.4 | 7.8 | 4.5 | 1.3 | 0.1 | 0.0 | 0.0 | 0.0 | 0.0 | 0.6 | 4.7 | 9.3 |
| 32 | 10.8 | 6.5 | 3.5 | 0.9 | 0.1 | 0.0 | 0.0 | 0.0 | 0.0 | 0.5 | 4.0 | 7.9 |
| 31 | 9.3 | 5.2 | 2.5 | 0.5 | 0.1 | 0.0 | 0.0 | 0.0 | 0.0 | 0.3 | 3.2 | 6.5 |
| 30 | 7.8 | 4.0 | 1.6 | 0.0 | 0.0 | 0.0 | 0.0 | 0.0 | 0.0 | 0.1 | 2.4 | 5.1 |
| 29 | 7.0 | 3.5 | 1.3 | 0.0 | 0.0 | 0.0 | 0.0 | 0.0 | 0.0 | 0.1 | 2.0 | 4.5 |
| 28 | 6.2 | 2.9 | 1.0 | 0.0 | 0.0 | 0.0 | 0.0 | 0.0 | 0.0 | 0.1 | 1.7 | 3.8 |
| 27 | 5.5 | 2.4 | 0.7 | 0.0 | 0.0 | 0.0 | 0.0 | 0.0 | 0.0 | 0.0 | 1.3 | 3.1 |
| 26 | 4.7 | 1.9 | 0.5 | 0.0 | 0.0 | 0.0 | 0.0 | 0.0 | 0.0 | 0.0 | 0.9 | 2.5 |
| 25 | 3.9 | 1.4 | 0.2 | 0.0 | 0.0 | 0.0 | 0.0 | 0.0 | 0.0 | 0.0 | 0.6 | 1.8 |
| 24 | 3.5 | 1.2 | 0.2 | 0.0 | 0.0 | 0.0 | 0.0 | 0.0 | 0.0 | 0.0 | 0.5 | 1.6 |
| 23 | 3.1 | 1.1 | 0.1 | 0.0 | 0.0 | 0.0 | 0.0 | 0.0 | 0.0 | 0.0 | 0.4 | 1.4 |
| 22 | 2.7 | 0.9 | 0.1 | 0.0 | 0.0 | 0.0 | 0.0 | 0.0 | 0.0 | 0.0 | 0.3 | 1.2 |
| 21 | 2.3 | 0.7 | 0.1 | 0.0 | 0.0 | 0.0 | 0.0 | 0.0 | 0.0 | 0.0 | 0.2 | 1.0 |
| 20 | 1.9 | 0.6 | 0.0 | 0.0 | 0.0 | 0.0 | 0.0 | 0.0 | 0.0 | 0.0 | 0.2 | 0.7 |
| 19 | 1.7 | 0.5 | 0.0 | 0.0 | 0.0 | 0.0 | 0.0 | 0.0 | 0.0 | 0.0 | 0.1 | 0.7 |
| 18 | 1.4 | 0.4 | 0.0 | 0.0 | 0.0 | 0.0 | 0.0 | 0.0 | 0.0 | 0.0 | 0.1 | 0.6 |
| 17 | 1.2 | 0.3 | 0.0 | 0.0 | 0.0 | 0.0 | 0.0 | 0.0 | 0.0 | 0.0 | 0.1 | 0.5 |
| 16 | 0.9 | 0.3 | 0.0 | 0.0 | 0.0 | 0.0 | 0.0 | 0.0 | 0.0 | 0.0 | 0.1 | 0.4 |
| 15 | 0.7 | 0.2 | 0.0 | 0.0 | 0.0 | 0.0 | 0.0 | 0.0 | 0.0 | 0.0 | 0.0 | 0.3 |
| 14 | 0.6 | 0.2 | 0.0 | 0.0 | 0.0 | 0.0 | 0.0 | 0.0 | 0.0 | 0.0 | 0.0 | 0.3 |
| 13 | 0.5 | 0.1 | 0.0 | 0.0 | 0.0 | 0.0 | 0.0 | 0.0 | 0.0 | 0.0 | 0.0 | 0.2 |
| 12 | 0.4 | 0.1 | 0.0 | 0.0 | 0.0 | 0.0 | 0.0 | 0.0 | 0.0 | 0.0 | 0.0 | 0.2 |
| 11 | 0.3 | 0.1 | 0.0 | 0.0 | 0.0 | 0.0 | 0.0 | 0.0 | 0.0 | 0.0 | 0.0 | 0.1 |

Table 11B

| Monthly Days with Low Temp Below - for Heating | | | | | | | | | | | | |
|---|---|---|---|---|---|---|---|---|---|---|---|---|
| temp | Jan | Feb | Mar | Apr | May | Jun | Jul | Aug | Sep | Oct | Nov | Year |
| 10 | 0.2 | 0.1 | 0.0 | 0.0 | 0.0 | 0.0 | 0.0 | 0.0 | 0.0 | 0.0 | 0.0 | 0.1 |
| 9 | 0.1 | 0.1 | 0.0 | 0.0 | 0.0 | 0.0 | 0.0 | 0.0 | 0.0 | 0.0 | 0.0 | 0.1 |
| 8 | 0.1 | 0.1 | 0.0 | 0.0 | 0.0 | 0.0 | 0.0 | 0.0 | 0.0 | 0.0 | 0.0 | 0.1 |
| 7 | 0.1 | 0.1 | 0.0 | 0.0 | 0.0 | 0.0 | 0.0 | 0.0 | 0.0 | 0.0 | 0.0 | 0.0 |
| 6 | 0.1 | 0.1 | 0.0 | 0.0 | 0.0 | 0.0 | 0.0 | 0.0 | 0.0 | 0.0 | 0.0 | 0.0 |
| 5 | 0.0 | 0.1 | 0.0 | 0.0 | 0.0 | 0.0 | 0.0 | 0.0 | 0.0 | 0.0 | 0.0 | 0.0 |
| 4 | 0.0 | 0.1 | 0.0 | 0.0 | 0.0 | 0.0 | 0.0 | 0.0 | 0.0 | 0.0 | 0.0 | 0.0 |
| 3 | 0.0 | 0.0 | 0.0 | 0.0 | 0.0 | 0.0 | 0.0 | 0.0 | 0.0 | 0.0 | 0.0 | 0.0 |
| 2 | 0.0 | 0.0 | 0.0 | 0.0 | 0.0 | 0.0 | 0.0 | 0.0 | 0.0 | 0.0 | 0.0 | 0.0 |
| 1 | 0.0 | 0.0 | 0.0 | 0.0 | 0.0 | 0.0 | 0.0 | 0.0 | 0.0 | 0.0 | 0.0 | 0.0 |
| 0 | 0.0 | 0.0 | 0.0 | 0.0 | 0.0 | 0.0 | 0.0 | 0.0 | 0.0 | 0.0 | 0.0 | 0.0 |
| -1 | 0.0 | 0.0 | 0.0 | 0.0 | 0.0 | 0.0 | 0.0 | 0.0 | 0.0 | 0.0 | 0.0 | 0.0 |
| -2 | 0.0 | 0.0 | 0.0 | 0.0 | 0.0 | 0.0 | 0.0 | 0.0 | 0.0 | 0.0 | 0.0 | 0.0 |
| -3 | 0.0 | 0.0 | 0.0 | 0.0 | 0.0 | 0.0 | 0.0 | 0.0 | 0.0 | 0.0 | 0.0 | 0.0 |
| -4 | 0.0 | 0.0 | 0.0 | 0.0 | 0.0 | 0.0 | 0.0 | 0.0 | 0.0 | 0.0 | 0.0 | 0.0 |
| -5 | 0.0 | 0.0 | 0.0 | 0.0 | 0.0 | 0.0 | 0.0 | 0.0 | 0.0 | 0.0 | 0.0 | 0.0 |

Table 11C

| Monthly Days with Low Temp Above - for Cooling | | | | | | | | | | | | |
|---|---|---|---|---|---|---|---|---|---|---|---|---|
| temp | Jan | Feb | Mar | Apr | May | Jun | Jul | Aug | Sep | Oct | Nov | Dec |
| 105 | 0.0 | 0.0 | 0.0 | 0.0 | 0.0 | 0.0 | 0.0 | 0.0 | 0.0 | 0.0 | 0.0 | 0.0 |
| 104 | 0.0 | 0.0 | 0.0 | 0.0 | 0.0 | 0.0 | 0.0 | 0.0 | 0.0 | 0.0 | 0.0 | 0.0 |
| 103 | 0.0 | 0.0 | 0.0 | 0.0 | 0.0 | 0.0 | 0.0 | 0.0 | 0.0 | 0.0 | 0.0 | 0.0 |
| 102 | 0.0 | 0.0 | 0.0 | 0.0 | 0.0 | 0.0 | 0.0 | 0.0 | 0.0 | 0.0 | 0.0 | 0.0 |
| 101 | 0.0 | 0.0 | 0.0 | 0.0 | 0.0 | 0.0 | 0.0 | 0.0 | 0.0 | 0.0 | 0.0 | 0.0 |
| 100 | 0.0 | 0.0 | 0.0 | 0.0 | 0.0 | 0.0 | 0.0 | 0.0 | 0.0 | 0.0 | 0.0 | 0.0 |
| 99 | 0.0 | 0.0 | 0.0 | 0.0 | 0.0 | 0.0 | 0.0 | 0.0 | 0.0 | 0.0 | 0.0 | 0.0 |
| 98 | 0.0 | 0.0 | 0.0 | 0.0 | 0.0 | 0.0 | 0.0 | 0.0 | 0.0 | 0.0 | 0.0 | 0.0 |
| 97 | 0.0 | 0.0 | 0.0 | 0.0 | 0.0 | 0.0 | 0.0 | 0.0 | 0.0 | 0.0 | 0.0 | 0.0 |
| 96 | 0.0 | 0.0 | 0.0 | 0.0 | 0.0 | 0.0 | 0.0 | 0.0 | 0.0 | 0.0 | 0.0 | 0.0 |
| 95 | 0.0 | 0.0 | 0.0 | 0.0 | 0.0 | 0.0 | 0.0 | 0.0 | 0.0 | 0.0 | 0.0 | 0.0 |
| 94 | 0.0 | 0.0 | 0.0 | 0.0 | 0.0 | 0.0 | 0.0 | 0.0 | 0.0 | 0.0 | 0.0 | 0.0 |
| 93 | 0.0 | 0.0 | 0.0 | 0.0 | 0.0 | 0.0 | 0.0 | 0.0 | 0.0 | 0.0 | 0.0 | 0.0 |
| 92 | 0.0 | 0.0 | 0.0 | 0.0 | 0.0 | 0.0 | 0.0 | 0.0 | 0.0 | 0.0 | 0.0 | 0.0 |
| 91 | 0.0 | 0.0 | 0.0 | 0.0 | 0.0 | 0.0 | 0.0 | 0.0 | 0.0 | 0.0 | 0.0 | 0.0 |
| 90 | 0.0 | 0.0 | 0.0 | 0.0 | 0.0 | 0.0 | 0.0 | 0.0 | 0.0 | 0.0 | 0.0 | 0.0 |
| 89 | 0.0 | 0.0 | 0.0 | 0.0 | 0.0 | 0.0 | 0.0 | 0.0 | 0.0 | 0.0 | 0.0 | 0.0 |
| 88 | 0.0 | 0.0 | 0.0 | 0.0 | 0.0 | 0.0 | 0.0 | 0.0 | 0.0 | 0.0 | 0.0 | 0.0 |
| 87 | 0.0 | 0.0 | 0.0 | 0.0 | 0.0 | 0.0 | 0.0 | 0.0 | 0.0 | 0.0 | 0.0 | 0.0 |
| 86 | 0.0 | 0.0 | 0.0 | 0.0 | 0.0 | 0.0 | 0.0 | 0.0 | 0.0 | 0.0 | 0.0 | 0.0 |
| 85 | 0.0 | 0.0 | 0.0 | 0.0 | 0.0 | 0.0 | 0.0 | 0.0 | 0.0 | 0.0 | 0.0 | 0.0 |
| 84 | 0.0 | 0.0 | 0.0 | 0.0 | 0.0 | 0.0 | 0.0 | 0.0 | 0.0 | 0.0 | 0.0 | 0.0 |
| 83 | 0.0 | 0.0 | 0.0 | 0.0 | 0.0 | 0.0 | 0.0 | 0.0 | 0.0 | 0.0 | 0.0 | 0.0 |
| 82 | 0.0 | 0.0 | 0.0 | 0.0 | 0.0 | 0.0 | 0.1 | 0.1 | 0.0 | 0.0 | 0.0 | 0.0 |
| 81 | 0.0 | 0.0 | 0.0 | 0.0 | 0.0 | 0.0 | 0.1 | 0.1 | 0.0 | 0.0 | 0.0 | 0.0 |
| 80 | 0.0 | 0.0 | 0.0 | 0.0 | 0.0 | 0.0 | 0.0 | 0.2 | 0.0 | 0.0 | 0.0 | 0.0 |
| 79 | 0.0 | 0.0 | 0.0 | 0.0 | 0.0 | 0.0 | 0.0 | 0.3 | 0.0 | 0.0 | 0.0 | 0.0 |
| 78 | 0.0 | 0.0 | 0.0 | 0.0 | 0.0 | 0.1 | 0.0 | 0.4 | 0.0 | 0.0 | 0.0 | 0.0 |
| 77 | 0.0 | 0.0 | 0.0 | 0.0 | 0.0 | 0.2 | 0.0 | 0.5 | 0.0 | 0.0 | 0.0 | 0.0 |
| 76 | 0.0 | 0.0 | 0.0 | 0.0 | 0.0 | 0.2 | 0.3 | 0.6 | 0.1 | 0.0 | 0.0 | 0.0 |
| 75 | 0.0 | 0.0 | 0.0 | 0.0 | 0.1 | 0.3 | 0.6 | 0.8 | 0.1 | 0.0 | 0.0 | 0.0 |
| 74 | 0.0 | 0.0 | 0.0 | 0.0 | 0.1 | 0.3 | 0.8 | 1.0 | 0.2 | 0.0 | 0.0 | 0.0 |
| 73 | 0.0 | 0.0 | 0.0 | 0.0 | 0.2 | 0.5 | 1.1 | 1.2 | 0.2 | 0.0 | 0.0 | 0.0 |
| 72 | 0.0 | 0.0 | 0.0 | 0.0 | 0.2 | 0.7 | 1.4 | 1.4 | 0.3 | 0.0 | 0.0 | 0.0 |
| 71 | 0.0 | 0.0 | 0.0 | 0.1 | 0.3 | 0.9 | 1.8 | 1.9 | 0.5 | 0.1 | 0.0 | 0.0 |
| 70 | 0.0 | 0.0 | 0.0 | 0.1 | 0.3 | 1.1 | 2.3 | 2.3 | 0.7 | 0.1 | 0.0 | 0.0 |
| 69 | 0.0 | 0.0 | 0.0 | 0.1 | 0.6 | 1.3 | 2.7 | 2.8 | 0.9 | 0.2 | 0.0 | 0.0 |
| 68 | 0.0 | 0.0 | 0.0 | 0.1 | 0.8 | 1.8 | 3.2 | 3.3 | 1.1 | 0.2 | 0.0 | 0.0 |
| 67 | 0.0 | 0.0 | 0.0 | 0.2 | 1.1 | 2.2 | 3.6 | 3.8 | 1.4 | 0.3 | 0.0 | 0.0 |
| 66 | 0.0 | 0.0 | 0.0 | 0.2 | 1.3 | 2.7 | 4.5 | 4.7 | 1.8 | 0.3 | 0.0 | 0.0 |
| 65 | 0.0 | 0.0 | 0.0 | 0.3 | 1.6 | 3.2 | 5.5 | 5.5 | 2.3 | 0.4 | 0.0 | 0.0 |
| 64 | 0.0 | 0.0 | 0.0 | 0.4 | 1.9 | 3.6 | 6.4 | 6.3 | 2.8 | 0.5 | 0.0 | 0.0 |
| 63 | 0.0 | 0.0 | 0.0 | 0.5 | 2.3 | 4.3 | 7.4 | 7.2 | 3.3 | 0.6 | 0.0 | 0.0 |
| 62 | 0.0 | 0.0 | 0.1 | 0.6 | 2.7 | 5.0 | 8.3 | 8.0 | 3.8 | 0.7 | 0.0 | 0.0 |
| 61 | 0.0 | 0.0 | 0.1 | 0.7 | 3.1 | 5.7 | 9.6 | 9.2 | 4.6 | 0.8 | 0.0 | 0.0 |

Table 12A

| Monthly Days with Low Temp Above - for Cooling | | | | | | | | | | | | |
|---|---|---|---|---|---|---|---|---|---|---|---|---|
| temp | Jan | Feb | Mar | Apr | May | Jun | Jul | Aug | Sep | Oct | Nov | Dec |
| 60 | 0.0 | 0.0 | 0.1 | 1.0 | 3.5 | 6.3 | 10.9 | 10.3 | 5.4 | 1.2 | 0.0 | 0.0 |
| 59 | 0.0 | 0.0 | 0.1 | 1.3 | 4.2 | 7.0 | 12.2 | 11.5 | 6.1 | 1.6 | 0.0 | 0.0 |
| 58 | 0.0 | 0.0 | 0.2 | 1.6 | 4.8 | 8.0 | 13.4 | 12.6 | 6.9 | 2.0 | 0.0 | 0.0 |
| 57 | 0.0 | 0.0 | 0.4 | 2.0 | 5.5 | 8.9 | 14.7 | 13.8 | 7.6 | 2.4 | 0.0 | 0.0 |
| 56 | 0.0 | 0.0 | 0.6 | 2.3 | 6.1 | 9.9 | 16.1 | 15.4 | 8.7 | 2.8 | 0.0 | 0.0 |
| 55 | 0.0 | 0.0 | 0.8 | 2.9 | 6.8 | 10.8 | 17.5 | 17.0 | 9.8 | 3.5 | 0.0 | 0.0 |
| 54 | 0.0 | 0.1 | 1.0 | 3.5 | 7.7 | 11.8 | 18.9 | 18.6 | 10.9 | 4.3 | 0.0 | 0.0 |
| 53 | 0.0 | 0.1 | 1.2 | 4.1 | 8.6 | 13.1 | 20.3 | 20.2 | 12.0 | 5.0 | 0.0 | 0.1 |
| 52 | 0.1 | 0.2 | 1.7 | 4.8 | 9.6 | 14.5 | 21.7 | 21.8 | 13.1 | 5.7 | 0.0 | 0.2 |
| 51 | 0.2 | 0.3 | 2.1 | 5.4 | 10.5 | 15.9 | 22.9 | 23.0 | 14.4 | 6.4 | 0.1 | 0.3 |
| 50 | 0.3 | 0.3 | 2.5 | 6.2 | 11.4 | 17.2 | 24.1 | 24.3 | 15.8 | 7.8 | 0.2 | 0.4 |
| 49 | 0.3 | 0.6 | 3.0 | 7.0 | 12.6 | 18.6 | 25.3 | 25.5 | 17.1 | 9.1 | 0.3 | 0.5 |
| 48 | 0.4 | 1.0 | 3.4 | 7.7 | 13.8 | 20.0 | 26.5 | 26.8 | 18.5 | 10.5 | 0.5 | 1.0 |
| 47 | 0.8 | 1.3 | 4.3 | 8.5 | 14.9 | 21.3 | 27.7 | 28.0 | 19.8 | 11.8 | 0.6 | 1.5 |
| 46 | 1.3 | 1.7 | 5.2 | 9.3 | 16.1 | 22.7 | 28.3 | 28.5 | 21.1 | 13.1 | 0.7 | 2.1 |
| 45 | 1.7 | 2.0 | 6.1 | 10.6 | 17.3 | 24.1 | 28.8 | 29.0 | 22.4 | 14.9 | 1.3 | 2.6 |
| 44 | 2.2 | 2.9 | 7.1 | 11.9 | 18.8 | 25.5 | 29.4 | 29.5 | 23.7 | 16.7 | 2.0 | 3.1 |
| 43 | 2.6 | 3.8 | 8.0 | 13.1 | 20.4 | 26.2 | 30.0 | 30.0 | 25.0 | 18.5 | 2.6 | 4.5 |
| 42 | 3.8 | 4.7 | 9.6 | 14.4 | 22.0 | 27.0 | 30.5 | 30.5 | 26.3 | 20.3 | 3.2 | 5.8 |
| 41 | 4.9 | 5.6 | 11.2 | 15.6 | 23.5 | 27.7 | 30.6 | 30.6 | 26.9 | 22.1 | 3.8 | 7.2 |
| 40 | 6.1 | 6.5 | 12.8 | 17.3 | 25.1 | 28.5 | 30.7 | 30.7 | 27.6 | 23.3 | 5.4 | 8.6 |
| 39 | 7.2 | 8.3 | 14.4 | 19.0 | 26.1 | 29.2 | 30.8 | 30.8 | 28.2 | 24.6 | 7.1 | 10.0 |
| 38 | 8.3 | 10.0 | 16.0 | 20.7 | 27.0 | 29.4 | 30.9 | 30.9 | 28.8 | 25.8 | 8.7 | 11.8 |
| 37 | 10.1 | 11.8 | 17.9 | 22.4 | 28.0 | 29.5 | 31.0 | 31.0 | 29.5 | 27.1 | 10.3 | 13.6 |
| 36 | 11.8 | 13.6 | 19.8 | 24.2 | 29.0 | 29.7 | 31.0 | 31.0 | 29.6 | 28.3 | 12.0 | 15.4 |
| 35 | 13.5 | 15.3 | 21.7 | 25.1 | 29.9 | 29.8 | 31.0 | 31.0 | 29.7 | 28.8 | 13.8 | 17.2 |
| 34 | 15.2 | 16.9 | 23.7 | 26.0 | 30.2 | 29.9 | 31.0 | 31.0 | 29.7 | 29.2 | 15.6 | 19.0 |
| 33 | 17.0 | 18.4 | 25.6 | 27.0 | 30.4 | 30.0 | 31.0 | 31.0 | 29.8 | 29.7 | 17.5 | 20.6 |
| 32 | 18.3 | 20.0 | 26.4 | 27.9 | 30.6 | 30.0 | 31.0 | 31.0 | 29.9 | 30.1 | 19.3 | 22.1 |
| 31 | 19.7 | 21.5 | 27.3 | 28.9 | 30.8 | 30.0 | 31.0 | 31.0 | 30.0 | 30.6 | 21.1 | 23.7 |
| 30 | 21.0 | 23.0 | 28.2 | 29.1 | 31.0 | 30.0 | 31.0 | 31.0 | 30.0 | 30.7 | 22.3 | 25.3 |
| 29 | 22.4 | 23.6 | 29.0 | 29.3 | 31.0 | 30.0 | 31.0 | 31.0 | 30.0 | 30.7 | 23.4 | 26.8 |
| 28 | 23.7 | 24.2 | 29.9 | 29.5 | 31.0 | 30.0 | 31.0 | 31.0 | 30.0 | 30.8 | 24.6 | 27.4 |
| 27 | 24.5 | 24.8 | 30.1 | 29.7 | 31.0 | 30.0 | 31.0 | 31.0 | 30.0 | 30.8 | 25.8 | 27.9 |
| 26 | 25.2 | 25.4 | 30.3 | 29.9 | 31.0 | 30.0 | 31.0 | 31.0 | 30.0 | 30.9 | 26.9 | 28.5 |
| 25 | 25.9 | 26.0 | 30.5 | 29.9 | 31.0 | 30.0 | 31.0 | 31.0 | 30.0 | 30.9 | 27.4 | 29.0 |
| 24 | 26.6 | 26.3 | 30.6 | 29.9 | 31.0 | 30.0 | 31.0 | 31.0 | 30.0 | 30.9 | 27.9 | 29.6 |
| 23 | 27.3 | 26.5 | 30.8 | 29.9 | 31.0 | 30.0 | 31.0 | 31.0 | 30.0 | 30.9 | 28.3 | 29.7 |
| 22 | 27.8 | 26.7 | 30.8 | 30.0 | 31.0 | 30.0 | 31.0 | 31.0 | 30.0 | 31.0 | 28.8 | 29.9 |
| 21 | 28.2 | 26.9 | 30.9 | 30.0 | 31.0 | 30.0 | 31.0 | 31.0 | 30.0 | 31.0 | 29.3 | 30.1 |
| 20 | 28.7 | 27.2 | 30.9 | 30.0 | 31.0 | 30.0 | 31.0 | 31.0 | 30.0 | 31.0 | 29.3 | 30.2 |
| 19 | 29.2 | 27.3 | 30.9 | 30.0 | 31.0 | 30.0 | 31.0 | 31.0 | 30.0 | 31.0 | 29.4 | 30.4 |
| 18 | 29.6 | 27.4 | 31.0 | 30.0 | 31.0 | 30.0 | 31.0 | 31.0 | 30.0 | 31.0 | 29.5 | 30.4 |
| 17 | 29.8 | 27.5 | 31.0 | 30.0 | 31.0 | 30.0 | 31.0 | 31.0 | 30.0 | 31.0 | 29.6 | 30.5 |
| 16 | 30.0 | 27.6 | 31.0 | 30.0 | 31.0 | 30.0 | 31.0 | 31.0 | 30.0 | 31.0 | 29.7 | 30.6 |
| 15 | 30.1 | 27.7 | 31.0 | 30.0 | 31.0 | 30.0 | 31.0 | 31.0 | 30.0 | 31.0 | 29.7 | 30.6 |

Table 12B

| Monthly Days with High Temp Below - for Heating | | | | | | | | | | | | |
|---|---|---|---|---|---|---|---|---|---|---|---|---|
| temp | Jan | Feb | Mar | Apr | May | Jun | Jul | Aug | Sep | Oct | Nov | Year |
| 100 | 31.0 | 28.0 | 31.0 | 30.0 | 31.0 | 30.0 | 31.0 | 31.0 | 30.0 | 31.0 | 30.0 | 31.0 |
| 99 | 31.0 | 28.0 | 31.0 | 30.0 | 31.0 | 30.0 | 31.0 | 31.0 | 30.0 | 31.0 | 30.0 | 31.0 |
| 98 | 31.0 | 28.0 | 31.0 | 30.0 | 31.0 | 30.0 | 31.0 | 31.0 | 30.0 | 31.0 | 30.0 | 31.0 |
| 97 | 31.0 | 28.0 | 31.0 | 30.0 | 31.0 | 30.0 | 31.0 | 31.0 | 30.0 | 31.0 | 30.0 | 31.0 |
| 96 | 31.0 | 28.0 | 31.0 | 30.0 | 31.0 | 30.0 | 30.9 | 31.0 | 30.0 | 31.0 | 30.0 | 31.0 |
| 95 | 31.0 | 28.0 | 31.0 | 30.0 | 31.0 | 30.0 | 30.9 | 31.0 | 30.0 | 31.0 | 30.0 | 31.0 |
| 94 | 31.0 | 28.0 | 31.0 | 30.0 | 31.0 | 30.0 | 30.9 | 31.0 | 30.0 | 31.0 | 30.0 | 31.0 |
| 93 | 31.0 | 28.0 | 31.0 | 30.0 | 31.0 | 30.0 | 30.8 | 31.0 | 30.0 | 31.0 | 30.0 | 31.0 |
| 92 | 31.0 | 28.0 | 31.0 | 30.0 | 31.0 | 30.0 | 30.7 | 30.9 | 30.0 | 31.0 | 30.0 | 31.0 |
| 91 | 31.0 | 28.0 | 31.0 | 30.0 | 31.0 | 30.0 | 30.6 | 30.8 | 30.0 | 31.0 | 30.0 | 31.0 |
| 90 | 31.0 | 28.0 | 31.0 | 30.0 | 31.0 | 30.0 | 30.5 | 30.7 | 30.0 | 31.0 | 30.0 | 31.0 |
| 89 | 31.0 | 28.0 | 31.0 | 30.0 | 31.0 | 30.0 | 30.3 | 30.6 | 30.0 | 31.0 | 30.0 | 31.0 |
| 88 | 31.0 | 28.0 | 31.0 | 30.0 | 31.0 | 29.9 | 30.2 | 30.5 | 30.0 | 31.0 | 30.0 | 31.0 |
| 87 | 31.0 | 28.0 | 31.0 | 30.0 | 31.0 | 29.9 | 29.2 | 29.1 | 29.6 | 31.0 | 30.0 | 31.0 |
| 86 | 31.0 | 28.0 | 31.0 | 30.0 | 31.0 | 29.9 | 28.1 | 27.7 | 29.3 | 31.0 | 30.0 | 31.0 |
| 85 | 31.0 | 28.0 | 31.0 | 30.0 | 31.0 | 29.5 | 27.1 | 26.3 | 29.0 | 31.0 | 30.0 | 31.0 |
| 84 | 31.0 | 28.0 | 31.0 | 30.0 | 31.0 | 29.2 | 26.0 | 24.9 | 28.7 | 31.0 | 30.0 | 31.0 |
| 83 | 31.0 | 28.0 | 31.0 | 30.0 | 30.9 | 28.9 | 25.0 | 23.5 | 28.3 | 31.0 | 30.0 | 31.0 |
| 82 | 31.0 | 28.0 | 31.0 | 30.0 | 30.9 | 28.5 | 21.7 | 20.4 | 26.5 | 30.9 | 30.0 | 31.0 |
| 81 | 31.0 | 28.0 | 31.0 | 30.0 | 30.9 | 28.2 | 18.4 | 17.3 | 24.6 | 30.9 | 30.0 | 31.0 |
| 80 | 31.0 | 28.0 | 31.0 | 30.0 | 30.8 | 26.2 | 15.1 | 14.2 | 22.8 | 30.9 | 30.0 | 31.0 |
| 79 | 31.0 | 28.0 | 31.0 | 30.0 | 30.4 | 24.3 | 11.8 | 11.2 | 21.0 | 30.9 | 30.0 | 31.0 |
| 78 | 31.0 | 28.0 | 31.0 | 29.9 | 29.9 | 22.4 | 8.5 | 8.1 | 19.1 | 30.5 | 29.9 | 31.0 |
| 77 | 31.0 | 28.0 | 31.0 | 29.9 | 29.5 | 20.5 | 7.1 | 6.8 | 17.0 | 30.2 | 29.9 | 31.0 |
| 76 | 31.0 | 28.0 | 31.0 | 29.8 | 29.0 | 18.5 | 5.6 | 5.4 | 14.9 | 29.9 | 29.9 | 31.0 |
| 75 | 31.0 | 28.0 | 31.0 | 29.8 | 28.6 | 16.1 | 4.1 | 4.1 | 12.8 | 29.5 | 29.9 | 31.0 |
| 74 | 31.0 | 28.0 | 31.0 | 29.7 | 27.0 | 13.6 | 2.7 | 2.8 | 10.6 | 29.2 | 29.9 | 31.0 |
| 73 | 31.0 | 28.0 | 31.0 | 29.2 | 25.4 | 11.1 | 1.2 | 1.5 | 8.5 | 27.7 | 29.5 | 31.0 |
| 72 | 31.0 | 28.0 | 30.9 | 28.7 | 23.9 | 8.7 | 1.0 | 1.2 | 7.3 | 26.3 | 29.2 | 31.0 |
| 71 | 31.0 | 28.0 | 30.8 | 28.2 | 22.3 | 6.2 | 0.7 | 0.9 | 6.1 | 24.9 | 28.9 | 31.0 |
| 70 | 31.0 | 28.0 | 30.7 | 27.7 | 20.7 | 5.1 | 0.5 | 0.6 | 4.9 | 23.4 | 28.6 | 31.0 |
| 69 | 31.0 | 27.9 | 30.6 | 27.2 | 18.2 | 3.9 | 0.3 | 0.3 | 3.7 | 22.0 | 28.3 | 31.0 |
| 68 | 31.0 | 27.8 | 30.5 | 25.7 | 15.6 | 2.8 | 0.0 | 0.1 | 2.5 | 20.0 | 27.1 | 31.0 |
| 67 | 31.0 | 27.8 | 30.4 | 24.3 | 13.1 | 1.7 | 0.0 | 0.0 | 2.1 | 18.1 | 25.9 | 30.9 |
| 66 | 30.9 | 27.7 | 29.5 | 22.9 | 10.6 | 0.5 | 0.0 | 0.0 | 1.6 | 16.1 | 24.7 | 30.9 |
| 65 | 30.9 | 27.7 | 28.7 | 21.5 | 8.0 | 0.4 | 0.0 | 0.0 | 1.2 | 14.1 | 23.5 | 30.9 |
| 64 | 30.8 | 27.3 | 27.8 | 20.1 | 6.7 | 0.3 | 0.0 | 0.0 | 0.8 | 12.2 | 22.3 | 30.8 |
| 63 | 30.8 | 26.9 | 27.0 | 17.9 | 5.4 | 0.2 | 0.0 | 0.0 | 0.4 | 10.7 | 20.6 | 30.7 |
| 62 | 30.7 | 26.5 | 26.1 | 15.7 | 4.1 | 0.1 | 0.0 | 0.0 | 0.3 | 9.2 | 18.8 | 30.6 |
| 61 | 30.4 | 26.1 | 24.1 | 13.6 | 2.8 | 0.0 | 0.0 | 0.0 | 0.3 | 7.7 | 17.1 | 30.6 |
| 60 | 30.0 | 25.7 | 22.0 | 11.4 | 1.5 | 0.0 | 0.0 | 0.0 | 0.2 | 6.2 | 15.4 | 30.1 |
| 59 | 29.7 | 24.3 | 20.0 | 9.2 | 1.2 | 0.0 | 0.0 | 0.0 | 0.1 | 4.7 | 13.7 | 29.7 |
| 58 | 29.3 | 22.8 | 17.9 | 7.8 | 1.0 | 0.0 | 0.0 | 0.0 | 0.0 | 3.9 | 12.2 | 29.3 |
| 57 | 29.0 | 21.4 | 15.9 | 6.4 | 0.7 | 0.0 | 0.0 | 0.0 | 0.0 | 3.2 | 10.7 | 28.9 |
| 56 | 27.9 | 20.0 | 14.0 | 5.0 | 0.4 | 0.0 | 0.0 | 0.0 | 0.0 | 2.5 | 9.3 | 28.4 |

Table 13A

| Monthly Days with High Temp Below - for Heating | | | | | | | | | | | | |
|---|---|---|---|---|---|---|---|---|---|---|---|---|
| temp | Jan | Feb | Mar | Apr | May | Jun | Jul | Aug | Sep | Oct | Nov | Year |
| 55 | 26.8 | 18.6 | 12.1 | 3.6 | 0.2 | 0.0 | 0.0 | 0.0 | 0.0 | 1.7 | 7.8 | 27.0 |
| 54 | 25.8 | 16.9 | 10.2 | 2.2 | 0.1 | 0.0 | 0.0 | 0.0 | 0.0 | 1.0 | 6.3 | 25.6 |
| 53 | 24.7 | 15.3 | 8.3 | 1.7 | 0.1 | 0.0 | 0.0 | 0.0 | 0.0 | 0.8 | 5.5 | 24.2 |
| 52 | 23.6 | 13.6 | 6.4 | 1.3 | 0.1 | 0.0 | 0.0 | 0.0 | 0.0 | 0.6 | 4.7 | 22.7 |
| 51 | 22.0 | 11.9 | 5.4 | 0.9 | 0.1 | 0.0 | 0.0 | 0.0 | 0.0 | 0.5 | 4.0 | 21.3 |
| 50 | 20.3 | 10.3 | 4.5 | 0.5 | 0.0 | 0.0 | 0.0 | 0.0 | 0.0 | 0.3 | 3.2 | 19.5 |
| 49 | 18.7 | 9.0 | 3.5 | 0.0 | 0.0 | 0.0 | 0.0 | 0.0 | 0.0 | 0.1 | 2.4 | 17.6 |
| 48 | 17.1 | 7.8 | 2.5 | 0.0 | 0.0 | 0.0 | 0.0 | 0.0 | 0.0 | 0.1 | 2.0 | 15.7 |
| 47 | 15.4 | 6.5 | 1.6 | 0.0 | 0.0 | 0.0 | 0.0 | 0.0 | 0.0 | 0.1 | 1.7 | 13.9 |
| 46 | 13.9 | 5.2 | 1.3 | 0.0 | 0.0 | 0.0 | 0.0 | 0.0 | 0.0 | 0.0 | 1.3 | 12.0 |
| 45 | 12.4 | 4.0 | 1.0 | 0.0 | 0.0 | 0.0 | 0.0 | 0.0 | 0.0 | 0.0 | 0.9 | 10.6 |
| 44 | 10.8 | 3.5 | 0.7 | 0.0 | 0.0 | 0.0 | 0.0 | 0.0 | 0.0 | 0.0 | 0.6 | 9.3 |
| 43 | 9.3 | 2.9 | 0.5 | 0.0 | 0.0 | 0.0 | 0.0 | 0.0 | 0.0 | 0.0 | 0.5 | 7.9 |
| 42 | 7.8 | 2.4 | 0.2 | 0.0 | 0.0 | 0.0 | 0.0 | 0.0 | 0.0 | 0.0 | 0.4 | 6.5 |
| 41 | 7.0 | 1.9 | 0.2 | 0.0 | 0.0 | 0.0 | 0.0 | 0.0 | 0.0 | 0.0 | 0.3 | 5.1 |
| 40 | 6.2 | 1.4 | 0.1 | 0.0 | 0.0 | 0.0 | 0.0 | 0.0 | 0.0 | 0.0 | 0.2 | 4.5 |
| 39 | 5.5 | 1.2 | 0.1 | 0.0 | 0.0 | 0.0 | 0.0 | 0.0 | 0.0 | 0.0 | 0.2 | 3.8 |
| 38 | 4.7 | 1.1 | 0.1 | 0.0 | 0.0 | 0.0 | 0.0 | 0.0 | 0.0 | 0.0 | 0.1 | 3.1 |
| 37 | 3.9 | 0.9 | 0.0 | 0.0 | 0.0 | 0.0 | 0.0 | 0.0 | 0.0 | 0.0 | 0.1 | 2.5 |
| 36 | 3.5 | 0.7 | 0.0 | 0.0 | 0.0 | 0.0 | 0.0 | 0.0 | 0.0 | 0.0 | 0.1 | 1.8 |
| 35 | 3.1 | 0.6 | 0.0 | 0.0 | 0.0 | 0.0 | 0.0 | 0.0 | 0.0 | 0.0 | 0.1 | 1.6 |
| 34 | 2.7 | 0.5 | 0.0 | 0.0 | 0.0 | 0.0 | 0.0 | 0.0 | 0.0 | 0.0 | 0.0 | 1.4 |
| 33 | 2.3 | 0.4 | 0.0 | 0.0 | 0.0 | 0.0 | 0.0 | 0.0 | 0.0 | 0.0 | 0.0 | 1.2 |
| 32 | 1.9 | 0.3 | 0.0 | 0.0 | 0.0 | 0.0 | 0.0 | 0.0 | 0.0 | 0.0 | 0.0 | 1.0 |
| 31 | 1.7 | 0.3 | 0.0 | 0.0 | 0.0 | 0.0 | 0.0 | 0.0 | 0.0 | 0.0 | 0.0 | 0.7 |
| 30 | 1.4 | 0.2 | 0.0 | 0.0 | 0.0 | 0.0 | 0.0 | 0.0 | 0.0 | 0.0 | 0.0 | 0.7 |
| 29 | 1.2 | 0.2 | 0.0 | 0.0 | 0.0 | 0.0 | 0.0 | 0.0 | 0.0 | 0.0 | 0.0 | 0.6 |
| 28 | 0.9 | 0.1 | 0.0 | 0.0 | 0.0 | 0.0 | 0.0 | 0.0 | 0.0 | 0.0 | 0.0 | 0.5 |
| 27 | 0.7 | 0.1 | 0.0 | 0.0 | 0.0 | 0.0 | 0.0 | 0.0 | 0.0 | 0.0 | 0.0 | 0.4 |
| 26 | 0.6 | 0.1 | 0.0 | 0.0 | 0.0 | 0.0 | 0.0 | 0.0 | 0.0 | 0.0 | 0.0 | 0.3 |
| 25 | 0.5 | 0.1 | 0.0 | 0.0 | 0.0 | 0.0 | 0.0 | 0.0 | 0.0 | 0.0 | 0.0 | 0.3 |
| 24 | 0.4 | 0.1 | 0.0 | 0.0 | 0.0 | 0.0 | 0.0 | 0.0 | 0.0 | 0.0 | 0.0 | 0.2 |
| 23 | 0.3 | 0.1 | 0.0 | 0.0 | 0.0 | 0.0 | 0.0 | 0.0 | 0.0 | 0.0 | 0.0 | 0.2 |
| 22 | 0.2 | 0.1 | 0.0 | 0.0 | 0.0 | 0.0 | 0.0 | 0.0 | 0.0 | 0.0 | 0.0 | 0.1 |
| 21 | 0.1 | 0.1 | 0.0 | 0.0 | 0.0 | 0.0 | 0.0 | 0.0 | 0.0 | 0.0 | 0.0 | 0.1 |
| 20 | 0.1 | 0.1 | 0.0 | 0.0 | 0.0 | 0.0 | 0.0 | 0.0 | 0.0 | 0.0 | 0.0 | 0.1 |
| 19 | 0.1 | 0.1 | 0.0 | 0.0 | 0.0 | 0.0 | 0.0 | 0.0 | 0.0 | 0.0 | 0.0 | 0.1 |
| 18 | 0.1 | 0.0 | 0.0 | 0.0 | 0.0 | 0.0 | 0.0 | 0.0 | 0.0 | 0.0 | 0.0 | 0.0 |
| 17 | 0.0 | 0.0 | 0.0 | 0.0 | 0.0 | 0.0 | 0.0 | 0.0 | 0.0 | 0.0 | 0.0 | 0.0 |
| 16 | 0.0 | 0.0 | 0.0 | 0.0 | 0.0 | 0.0 | 0.0 | 0.0 | 0.0 | 0.0 | 0.0 | 0.0 |
| 15 | 0.0 | 0.0 | 0.0 | 0.0 | 0.0 | 0.0 | 0.0 | 0.0 | 0.0 | 0.0 | 0.0 | 0.0 |
| 14 | 0.0 | 0.0 | 0.0 | 0.0 | 0.0 | 0.0 | 0.0 | 0.0 | 0.0 | 0.0 | 0.0 | 0.0 |
| 13 | 0.0 | 0.0 | 0.0 | 0.0 | 0.0 | 0.0 | 0.0 | 0.0 | 0.0 | 0.0 | 0.0 | 0.0 |
| 12 | 0.0 | 0.0 | 0.0 | 0.0 | 0.0 | 0.0 | 0.0 | 0.0 | 0.0 | 0.0 | 0.0 | 0.0 |
| 11 | 0.0 | 0.0 | 0.0 | 0.0 | 0.0 | 0.0 | 0.0 | 0.0 | 0.0 | 0.0 | 0.0 | 0.0 |

Table 13B

| Monthly Days with High Temp Below - for Heating | | | | | | | | | | | | |
|---|---|---|---|---|---|---|---|---|---|---|---|---|
| temp | Jan | Feb | Mar | Apr | May | Jun | Jul | Aug | Sep | Oct | Nov | Year |
| 10 | 0.0 | 0.0 | 0.0 | 0.0 | 0.0 | 0.0 | 0.0 | 0.0 | 0.0 | 0.0 | 0.0 | 0.0 |
| 9 | 0.0 | 0.0 | 0.0 | 0.0 | 0.0 | 0.0 | 0.0 | 0.0 | 0.0 | 0.0 | 0.0 | 0.0 |
| 8 | 0.0 | 0.0 | 0.0 | 0.0 | 0.0 | 0.0 | 0.0 | 0.0 | 0.0 | 0.0 | 0.0 | 0.0 |
| 7 | 0.0 | 0.0 | 0.0 | 0.0 | 0.0 | 0.0 | 0.0 | 0.0 | 0.0 | 0.0 | 0.0 | 0.0 |
| 6 | 0.0 | 0.0 | 0.0 | 0.0 | 0.0 | 0.0 | 0.0 | 0.0 | 0.0 | 0.0 | 0.0 | 0.0 |
| 5 | 0.0 | 0.0 | 0.0 | 0.0 | 0.0 | 0.0 | 0.0 | 0.0 | 0.0 | 0.0 | 0.0 | 0.0 |
| 4 | 0.0 | 0.0 | 0.0 | 0.0 | 0.0 | 0.0 | 0.0 | 0.0 | 0.0 | 0.0 | 0.0 | 0.0 |
| 3 | 0.0 | 0.0 | 0.0 | 0.0 | 0.0 | 0.0 | 0.0 | 0.0 | 0.0 | 0.0 | 0.0 | 0.0 |
| 2 | 0.0 | 0.0 | 0.0 | 0.0 | 0.0 | 0.0 | 0.0 | 0.0 | 0.0 | 0.0 | 0.0 | 0.0 |
| 1 | 0.0 | 0.0 | 0.0 | 0.0 | 0.0 | 0.0 | 0.0 | 0.0 | 0.0 | 0.0 | 0.0 | 0.0 |
| 0 | 0.0 | 0.0 | 0.0 | 0.0 | 0.0 | 0.0 | 0.0 | 0.0 | 0.0 | 0.0 | 0.0 | 0.0 |
| -1 | 0.0 | 0.0 | 0.0 | 0.0 | 0.0 | 0.0 | 0.0 | 0.0 | 0.0 | 0.0 | 0.0 | 0.0 |
| -2 | 0.0 | 0.0 | 0.0 | 0.0 | 0.0 | 0.0 | 0.0 | 0.0 | 0.0 | 0.0 | 0.0 | 0.0 |
| -3 | 0.0 | 0.0 | 0.0 | 0.0 | 0.0 | 0.0 | 0.0 | 0.0 | 0.0 | 0.0 | 0.0 | 0.0 |
| -4 | 0.0 | 0.0 | 0.0 | 0.0 | 0.0 | 0.0 | 0.0 | 0.0 | 0.0 | 0.0 | 0.0 | 0.0 |
| -5 | 0.0 | 0.0 | 0.0 | 0.0 | 0.0 | 0.0 | 0.0 | 0.0 | 0.0 | 0.0 | 0.0 | 0.0 |

Table 13C

| Annual Days with High Temp Above - for Cooling | | | |
|---|---|---|---|
| temp | Days | temp | Days |
| 105 | 0.2 | 60 | 198.2 |
| 104 | 0.2 | 59 | 207.5 |
| 103 | 0.3 | 58 | 216.7 |
| 102 | 0.4 | 57 | 226.0 |
| 101 | 0.5 | 56 | 235.2 |
| 100 | 0.6 | 55 | 244.5 |
| 99 | 1.1 | 54 | 254.1 |
| 98 | 1.7 | 53 | 263.8 |
| 97 | 2.3 | 52 | 273.5 |
| 96 | 2.8 | 51 | 283.1 |
| 95 | 3.4 | 50 | 292.8 |
| 94 | 4.8 | 49 | 300.2 |
| 93 | 6.3 | 48 | 307.5 |
| 92 | 7.7 | 47 | 314.9 |
| 91 | 9.1 | 46 | 322.3 |
| 90 | 10.5 | 45 | 329.7 |
| 89 | 13.6 | 44 | 333.9 |
| 88 | 16.7 | 43 | 338.1 |
| 87 | 19.7 | 42 | 342.3 |
| 86 | 22.8 | 41 | 346.4 |
| 85 | 25.9 | 40 | 350.6 |
| 84 | 30.3 | 39 | 352.3 |
| 83 | 34.8 | 38 | 353.9 |
| 82 | 39.3 | 37 | 355.5 |
| 81 | 43.7 | 36 | 357.1 |
| 80 | 48.2 | 35 | 358.8 |
| 79 | 54.6 | 34 | 359.5 |
| 78 | 61.1 | 33 | 360.3 |
| 77 | 67.5 | 32 | 361.0 |
| 76 | 73.9 | 31 | 361.8 |
| 75 | 80.4 | 30 | 362.5 |
| 74 | 88.0 | 29 | 362.8 |
| 73 | 95.7 | 28 | 363.1 |
| 72 | 103.4 | 27 | 363.4 |
| 71 | 111.1 | 26 | 363.8 |
| 70 | 118.7 | 25 | 364.1 |
| 69 | 126.4 | 24 | 364.2 |
| 68 | 134.0 | 23 | 364.4 |
| 67 | 141.7 | 22 | 364.5 |
| 66 | 149.4 | 21 | 364.6 |
| 65 | 157.0 | 20 | 364.8 |
| 64 | 165.3 | 19 | 364.8 |
| 63 | 173.5 | 18 | 364.8 |
| 62 | 181.7 | 17 | 364.9 |
| 61 | 190.0 | 16 | 364.9 |
| | | 15 | 365.0 |

Table 14

| Annual Days with Low Temp Above - for Cooling | | | |
|---|---|---|---|
| temp | Days | temp | Days |
| 105 | 0.0 | 60 | 38.8 |
| 104 | 0.0 | 59 | 44.0 |
| 103 | 0.0 | 58 | 49.6 |
| 102 | 0.0 | 57 | 55.3 |
| 101 | 0.0 | 56 | 61.9 |
| 100 | 0.0 | 55 | 69.2 |
| 99 | 0.0 | 54 | 76.8 |
| 98 | 0.0 | 53 | 84.9 |
| 97 | 0.0 | 52 | 93.3 |
| 96 | 0.0 | 51 | 101.4 |
| 95 | 0.0 | 50 | 110.5 |
| 94 | 0.0 | 49 | 120.0 |
| 93 | 0.0 | 48 | 130.0 |
| 92 | 0.0 | 47 | 140.8 |
| 91 | 0.0 | 46 | 150.2 |
| 90 | 0.0 | 45 | 161.0 |
| 89 | 0.0 | 44 | 172.7 |
| 88 | 0.0 | 43 | 184.7 |
| 87 | 0.0 | 42 | 198.1 |
| 86 | 0.0 | 41 | 209.9 |
| 85 | 0.0 | 40 | 222.6 |
| 84 | 0.0 | 39 | 235.6 |
| 83 | 0.0 | 38 | 248.4 |
| 82 | 0.2 | 37 | 262.2 |
| 81 | 0.2 | 36 | 275.2 |
| 80 | 0.3 | 35 | 286.8 |
| 79 | 0.4 | 34 | 297.5 |
| 78 | 0.6 | 33 | 307.8 |
| 77 | 0.7 | 32 | 316.7 |
| 76 | 1.3 | 31 | 325.5 |
| 75 | 1.9 | 30 | 332.5 |
| 74 | 2.5 | 29 | 338.3 |
| 73 | 3.3 | 28 | 343.2 |
| 72 | 4.1 | 27 | 346.7 |
| 71 | 5.5 | 26 | 350.1 |
| 70 | 7.0 | 25 | 352.7 |
| 69 | 8.6 | 24 | 354.8 |
| 68 | 10.6 | 23 | 356.6 |
| 67 | 12.5 | 22 | 358.0 |
| 66 | 15.6 | 21 | 359.3 |
| 65 | 18.8 | 20 | 360.3 |
| 64 | 22.1 | 19 | 361.1 |
| 63 | 25.7 | 18 | 361.9 |
| 62 | 29.3 | 17 | 362.4 |
| 61 | 33.8 | 16 | 362.8 |
| | | 15 | 363.2 |

Table 15

| Annual Days with High Temp Below - for Heating | | | | | |
|---|---|---|---|---|---|
| temp | Days | temp | Days | temp | Days |
| 100 | 365.0 | 55 | 97.8 | 10 | 0.0 |
| 99 | 365.0 | 54 | 88.1 | 9 | 0.0 |
| 98 | 365.0 | 53 | 80.6 | 8 | 0.0 |
| 97 | 365.0 | 52 | 73.2 | 7 | 0.0 |
| 96 | 364.9 | 51 | 66.1 | 6 | 0.0 |
| 95 | 364.9 | 50 | 58.5 | 5 | 0.0 |
| 94 | 364.9 | 49 | 51.4 | 4 | 0.0 |
| 93 | 364.8 | 48 | 45.2 | 3 | 0.0 |
| 92 | 364.6 | 47 | 39.1 | 2 | 0.0 |
| 91 | 364.4 | 46 | 33.7 | 1 | 0.0 |
| 90 | 364.1 | 45 | 28.9 | 0 | 0.0 |
| 89 | 363.9 | 44 | 24.8 | -1 | 0.0 |
| 88 | 363.6 | 43 | 21.1 | -2 | 0.0 |
| 87 | 360.8 | 42 | 17.3 | -3 | 0.0 |
| 86 | 358.0 | 41 | 14.5 | -4 | 0.0 |
| 85 | 354.8 | 40 | 12.4 | -5 | 0.0 |
| 84 | 351.7 | 39 | 10.7 | | |
| 83 | 348.5 | 38 | 9.1 | | |
| 82 | 339.9 | 37 | 7.4 | | |
| 81 | 331.3 | 36 | 6.2 | | |
| 80 | 321.1 | 35 | 5.4 | | |
| 79 | 310.5 | 34 | 4.6 | | |
| 78 | 299.5 | 33 | 3.9 | | |
| 77 | 291.8 | 32 | 3.2 | | |
| 76 | 284.1 | 31 | 2.7 | | |
| 75 | 275.8 | 30 | 2.3 | | |
| 74 | 266.4 | 29 | 1.9 | | |
| 73 | 255.2 | 28 | 1.5 | | |
| 72 | 247.1 | 27 | 1.2 | | |
| 71 | 238.9 | 26 | 1.0 | | |
| 70 | 232.1 | 25 | 0.8 | | |
| 69 | 224.3 | 24 | 0.7 | | |
| 68 | 214.1 | 23 | 0.5 | | |
| 67 | 205.3 | 22 | 0.4 | | |
| 66 | 195.6 | 21 | 0.3 | | |
| 65 | 186.9 | 20 | 0.2 | | |
| 64 | 179.2 | 19 | 0.2 | | |
| 63 | 170.5 | 18 | 0.1 | | |
| 62 | 162.3 | 17 | 0.1 | | |
| 61 | 152.5 | 16 | 0.1 | | |
| 60 | 142.5 | 15 | 0.1 | | |
| 59 | 132.5 | 14 | 0.1 | | |
| 58 | 124.3 | 13 | 0.0 | | |
| 57 | 116.2 | 12 | 0.0 | | |
| 56 | 107.5 | 11 | 0.0 | | |

Table 16

| Annual Days with Low Temp Below - for Heating | | | | | |
|---|---|---|---|---|---|
| temp | Days | temp | Days | temp | Days |
| 100 | 365.0 | 55 | 292.5 | 10 | 0.3 |
| 99 | 365.0 | 54 | 281.0 | 9 | 0.3 |
| 98 | 365.0 | 53 | 269.4 | 8 | 0.2 |
| 97 | 365.0 | 52 | 257.9 | 7 | 0.2 |
| 96 | 365.0 | 51 | 246.4 | 6 | 0.1 |
| 95 | 365.0 | 50 | 234.9 | 5 | 0.1 |
| 94 | 365.0 | 49 | 222.9 | 4 | 0.1 |
| 93 | 365.0 | 48 | 210.9 | 3 | 0.1 |
| 92 | 365.0 | 47 | 198.9 | 2 | 0.1 |
| 91 | 365.0 | 46 | 186.9 | 1 | 0.1 |
| 90 | 365.0 | 45 | 174.9 | 0 | 0.1 |
| 89 | 365.0 | 44 | 161.7 | -1 | 0.0 |
| 88 | 365.0 | 43 | 148.5 | -2 | 0.0 |
| 87 | 365.0 | 42 | 135.3 | -3 | 0.0 |
| 86 | 365.0 | 41 | 122.1 | -4 | 0.0 |
| 85 | 365.0 | 40 | 109.0 | -5 | 0.0 |
| 84 | 365.0 | 39 | 97.9 | | |
| 83 | 365.0 | 38 | 86.9 | | |
| 82 | 365.0 | 37 | 75.8 | | |
| 81 | 365.0 | 36 | 64.8 | | |
| 80 | 365.0 | 35 | 53.8 | | |
| 79 | 365.0 | 34 | 47.2 | | |
| 78 | 365.0 | 33 | 40.7 | | |
| 77 | 365.0 | 32 | 34.1 | | |
| 76 | 365.0 | 31 | 27.6 | | |
| 75 | 365.0 | 30 | 21.0 | | |
| 74 | 365.0 | 29 | 18.4 | | |
| 73 | 364.9 | 28 | 15.7 | | |
| 72 | 364.9 | 27 | 13.1 | | |
| 71 | 364.9 | 26 | 10.5 | | |
| 70 | 364.8 | 25 | 7.8 | | |
| 69 | 364.6 | 24 | 7.0 | | |
| 68 | 364.3 | 23 | 6.1 | | |
| 67 | 364.0 | 22 | 5.2 | | |
| 66 | 363.8 | 21 | 4.3 | | |
| 65 | 363.5 | 20 | 3.4 | | |
| 64 | 360.3 | 19 | 3.0 | | |
| 63 | 357.1 | 18 | 2.5 | | |
| 62 | 353.9 | 17 | 2.1 | | |
| 61 | 350.7 | 16 | 1.6 | | |
| 60 | 347.5 | 15 | 1.2 | | |
| 59 | 336.5 | 14 | 1.0 | | |
| 58 | 325.5 | 13 | 0.8 | | |
| 57 | 314.5 | 12 | 0.7 | | |
| 56 | 303.5 | 11 | 0.5 | | |

Table 17

| Annual High Temp Deg-Hours Above - for Cooling | | | |
|---|---|---|---|
| temp | DH | temp | DH |
| 105 | 0.2 | 60 | 2818.7 |
| 104 | 0.4 | 59 | 3026.2 |
| 103 | 0.7 | 58 | 3242.9 |
| 102 | 1.1 | 57 | 3468.8 |
| 101 | 1.6 | 56 | 3704.1 |
| 100 | 2.1 | 55 | 3948.5 |
| 99 | 3.3 | 54 | 4202.7 |
| 98 | 5.0 | 53 | 4466.5 |
| 97 | 7.2 | 52 | 4739.9 |
| 96 | 10.1 | 51 | 5023.1 |
| 95 | 13.5 | 50 | 5315.9 |
| 94 | 18.4 | 49 | 5616.0 |
| 93 | 24.6 | 48 | 5923.6 |
| 92 | 32.3 | 47 | 6238.5 |
| 91 | 41.4 | 46 | 6560.8 |
| 90 | 52.0 | 45 | 6890.5 |
| 89 | 65.6 | 44 | 7224.3 |
| 88 | 82.3 | 43 | 7562.4 |
| 87 | 102.0 | 42 | 7904.6 |
| 86 | 124.8 | 41 | 8251.1 |
| 85 | 150.7 | 40 | 8601.7 |
| 84 | 181.0 | 39 | 8954.0 |
| 83 | 215.8 | 38 | 9307.9 |
| 82 | 255.1 | 37 | 9663.4 |
| 81 | 298.8 | 36 | 10020.5 |
| 80 | 347.0 | 35 | 10379.3 |
| 79 | 401.6 | 34 | 10738.8 |
| 78 | 462.7 | 33 | 11099.1 |
| 77 | 530.2 | 32 | 11460.1 |
| 76 | 604.2 | 31 | 11821.8 |
| 75 | 684.5 | 30 | 12184.3 |
| 74 | 772.6 | 29 | 12547.2 |
| 73 | 868.3 | 28 | 12910.3 |
| 72 | 971.7 | 27 | 13273.7 |
| 71 | 1082.7 | 26 | 13637.5 |
| 70 | 1201.5 | 25 | 14001.6 |
| 69 | 1327.8 | 24 | 14365.8 |
| 68 | 1461.9 | 23 | 14730.1 |
| 67 | 1603.6 | 22 | 15094.6 |
| 66 | 1753.0 | 21 | 15459.3 |
| 65 | 1910.0 | 20 | 15824.0 |
| 64 | 2075.3 | 19 | 16188.8 |
| 63 | 2248.8 | 18 | 16553.7 |
| 62 | 2430.5 | 17 | 16918.5 |
| 61 | 2620.5 | 16 | 17283.5 |
| | | 15 | 17648.4 |

Table 18

| Annual Low Temp Deg-Hours Above - for Cooling | | | |
|---|---|---|---|
| temp | DH | temp | DH |
| 105 | 0.0 | 60 | 243.7 |
| 104 | 0.0 | 59 | 287.7 |
| 103 | 0.0 | 58 | 337.3 |
| 102 | 0.0 | 57 | 392.6 |
| 101 | 0.0 | 56 | 454.5 |
| 100 | 0.0 | 55 | 523.7 |
| 99 | 0.0 | 54 | 600.5 |
| 98 | 0.0 | 53 | 685.4 |
| 97 | 0.0 | 52 | 778.7 |
| 96 | 0.0 | 51 | 880.2 |
| 95 | 0.0 | 50 | 990.6 |
| 94 | 0.0 | 49 | 1110.6 |
| 93 | 0.0 | 48 | 1240.7 |
| 92 | 0.0 | 47 | 1381.5 |
| 91 | 0.0 | 46 | 1531.7 |
| 90 | 0.0 | 45 | 1692.7 |
| 89 | 0.0 | 44 | 1865.5 |
| 88 | 0.0 | 43 | 2050.2 |
| 87 | 0.0 | 42 | 2248.2 |
| 86 | 0.0 | 41 | 2458.1 |
| 85 | 0.0 | 40 | 2680.7 |
| 84 | 0.0 | 39 | 2916.4 |
| 83 | 0.0 | 38 | 3164.8 |
| 82 | 0.2 | 37 | 3427.0 |
| 81 | 0.4 | 36 | 3702.1 |
| 80 | 0.7 | 35 | 3988.9 |
| 79 | 1.2 | 34 | 4286.4 |
| 78 | 1.7 | 33 | 4594.2 |
| 77 | 2.4 | 32 | 4910.9 |
| 76 | 3.7 | 31 | 5236.4 |
| 75 | 5.6 | 30 | 5568.9 |
| 74 | 8.1 | 29 | 5907.2 |
| 73 | 11.4 | 28 | 6250.4 |
| 72 | 15.5 | 27 | 6597.0 |
| 71 | 21.0 | 26 | 6947.1 |
| 70 | 28.0 | 25 | 7299.8 |
| 69 | 36.6 | 24 | 7654.6 |
| 68 | 47.2 | 23 | 8011.2 |
| 67 | 59.7 | 22 | 8369.2 |
| 66 | 75.3 | 21 | 8728.5 |
| 65 | 94.0 | 20 | 9088.8 |
| 64 | 116.2 | 19 | 9449.9 |
| 63 | 141.9 | 18 | 9811.8 |
| 62 | 171.1 | 17 | 10174.2 |
| 61 | 204.9 | 16 | 10537.1 |
| | | 15 | 10900.3 |

Table 19

| Annual High Temp Deg-Hours Below - for Heating | | | | | |
|---|---|---|---|---|---|
| temp | DH | temp | DH | temp | DH |
| 100 | 13338.8 | 55 | 817.5 | 10 | 0.0 |
| 99 | 12973.8 | 54 | 719.7 | 9 | 0.0 |
| 98 | 12608.8 | 53 | 631.5 | 8 | 0.0 |
| 97 | 12243.8 | 52 | 550.9 | 7 | 0.0 |
| 96 | 11878.8 | 51 | 477.7 | 6 | 0.0 |
| 95 | 11513.8 | 50 | 411.7 | 5 | 0.0 |
| 94 | 11148.9 | 49 | 353.2 | 4 | 0.0 |
| 93 | 10784.1 | 48 | 301.8 | 3 | 0.0 |
| 92 | 10419.2 | 47 | 256.6 | 2 | 0.0 |
| 91 | 10054.6 | 46 | 217.6 | 1 | 0.0 |
| 90 | 9690.2 | 45 | 183.8 | 0 | 0.0 |
| 89 | 9326.1 | 44 | 154.9 | -1 | 0.0 |
| 88 | 8962.3 | 43 | 130.0 | -2 | 0.0 |
| 87 | 8598.7 | 42 | 109.0 | -3 | 0.0 |
| 86 | 8237.9 | 41 | 91.7 | -4 | 0.0 |
| 85 | 7879.9 | 40 | 77.1 | -5 | 0.0 |
| 84 | 7525.1 | 39 | 64.7 | | |
| 83 | 7173.4 | 38 | 54.0 | | |
| 82 | 6824.9 | 37 | 44.9 | | |
| 81 | 6485.0 | 36 | 37.5 | | |
| 80 | 6153.8 | 35 | 31.4 | | |
| 79 | 5832.7 | 34 | 26.0 | | |
| 78 | 5522.2 | 33 | 21.4 | | |
| 77 | 5222.8 | 32 | 17.4 | | |
| 76 | 4931.0 | 31 | 14.2 | | |
| 75 | 4646.9 | 30 | 11.5 | | |
| 74 | 4371.1 | 29 | 9.3 | | |
| 73 | 4104.7 | 28 | 7.4 | | |
| 72 | 3849.6 | 27 | 5.8 | | |
| 71 | 3602.5 | 26 | 4.6 | | |
| 70 | 3363.5 | 25 | 3.6 | | |
| 69 | 3131.4 | 24 | 2.8 | | |
| 68 | 2907.1 | 23 | 2.1 | | |
| 67 | 2693.0 | 22 | 1.6 | | |
| 66 | 2487.7 | 21 | 1.3 | | |
| 65 | 2292.0 | 20 | 1.0 | | |
| 64 | 2105.1 | 19 | 0.7 | | |
| 63 | 1925.9 | 18 | 0.6 | | |
| 62 | 1755.4 | 17 | 0.4 | | |
| 61 | 1593.1 | 16 | 0.3 | | |
| 60 | 1440.6 | 15 | 0.3 | | |
| 59 | 1298.1 | 14 | 0.2 | | |
| 58 | 1165.5 | 13 | 0.2 | | |
| 57 | 1041.2 | 12 | 0.1 | | |
| 56 | 925.0 | 11 | 0.1 | | |

Table 20

| Annual Low Temp Deg-Hours Below - for Heating | | | | | |
|---|---|---|---|---|---|
| temp | DH | temp | DH | temp | DH |
| 100 | 20093.8 | 55 | 3909.3 | 10 | 1.7 |
| 99 | 19728.8 | 54 | 3616.8 | 9 | 1.4 |
| 98 | 19363.8 | 53 | 3335.9 | 8 | 1.1 |
| 97 | 18998.8 | 52 | 3066.4 | 7 | 0.9 |
| 96 | 18633.8 | 51 | 2808.5 | 6 | 0.7 |
| 95 | 18268.8 | 50 | 2562.1 | 5 | 0.6 |
| 94 | 17903.8 | 49 | 2327.3 | 4 | 0.5 |
| 93 | 17538.8 | 48 | 2104.4 | 3 | 0.4 |
| 92 | 17173.8 | 47 | 1893.6 | 2 | 0.3 |
| 91 | 16808.8 | 46 | 1694.7 | 1 | 0.2 |
| 90 | 16443.8 | 45 | 1507.9 | 0 | 0.2 |
| 89 | 16078.8 | 44 | 1333.0 | -1 | 0.1 |
| 88 | 15713.8 | 43 | 1171.3 | -2 | 0.1 |
| 87 | 15348.8 | 42 | 1022.8 | -3 | 0.0 |
| 86 | 14983.8 | 41 | 887.5 | -4 | 0.0 |
| 85 | 14618.8 | 40 | 765.4 | -5 | 0.0 |
| 84 | 14253.8 | 39 | 656.4 | | |
| 83 | 13888.8 | 38 | 558.5 | | |
| 82 | 13523.8 | 37 | 471.6 | | |
| 81 | 13158.8 | 36 | 395.8 | | |
| 80 | 12793.8 | 35 | 331.0 | | |
| 79 | 12428.8 | 34 | 277.2 | | |
| 78 | 12063.8 | 33 | 230.0 | | |
| 77 | 11698.8 | 32 | 189.4 | | |
| 76 | 11333.8 | 31 | 155.3 | | |
| 75 | 10968.8 | 30 | 127.7 | | |
| 74 | 10603.8 | 29 | 106.7 | | |
| 73 | 10238.8 | 28 | 88.3 | | |
| 72 | 9873.8 | 27 | 72.6 | | |
| 71 | 9508.9 | 26 | 59.5 | | |
| 70 | 9144.1 | 25 | 49.0 | | |
| 69 | 8779.2 | 24 | 41.2 | | |
| 68 | 8414.6 | 23 | 34.2 | | |
| 67 | 8050.3 | 22 | 28.2 | | |
| 66 | 7686.3 | 21 | 23.0 | | |
| 65 | 7322.5 | 20 | 18.6 | | |
| 64 | 6959.0 | 19 | 15.2 | | |
| 63 | 6598.7 | 18 | 12.2 | | |
| 62 | 6241.5 | 17 | 9.7 | | |
| 61 | 5887.6 | 16 | 7.6 | | |
| 60 | 5536.9 | 15 | 6.0 | | |
| 59 | 5189.3 | 14 | 4.8 | | |
| 58 | 4852.8 | 13 | 3.8 | | |
| 57 | 4527.3 | 12 | 2.9 | | |
| 56 | 4212.8 | 11 | 2.2 | | |

Table 21

ENERGY USAGE ESTIMATION FOR CLIMATE CONTROL SYSTEM

RELATED APPLICATION

This application is continuation-in-part of and claims filing date priority of application Ser. No. 10/873,921 "Zone Climate Control" filed Jun. 22, 2004, now U.S. Pat. No. 7,188,779 by this inventor. That application was, in turn, a continuation-in-part of and claimed filing date priority of application Ser. No. 10/249,198 "An Improved Forced-Air Zone Climate Control System for Existing Residential House" filed Mar. 21, 2003, now U.S. Pat. No. 6,983,889 by this inventor. Both are incorporated by reference as if fully set forth herein.

BACKGROUND OF THE INVENTION

1. Technical Field of the Invention

This invention relates generally to climate control systems, and more specifically to providing a user with an estimated financial cost or savings resulting from his changing a setting of the climate control system.

2. Background Art

FIG. 1 illustrates a residential home 10 which is equipped with a heating, ventilation, air conditioning (HVAC) climate control system. The home is a building 12 which includes five rooms A-E. Each "room" may include one actual room, or it may include one or more rooms whose air is conditioned together as a zone.

The climate control system includes an air conditioner, furnace, or other such conditioning apparatus which provides conditioned, forced air into a primary trunk duct 14. The conditioned air is provided into the rooms via secondary ducts 16 which extend from the primary trunk duct to respective vents 18 in the various rooms. In most instances, the conditioned air returns from the room by passing out the room's door 20, but in some instances there may be return air ducts (not shown) in some or all of the rooms. The air returning from the various rooms mixes to some extent in the hallways 22 connecting the rooms and the common areas, and eventually returns into a return air vent 24 which feeds into the return air plenum of the furnace.

Operation of the air conditioner or furnace is managed by a controller. In one embodiment of the system described in the co-pending parent application, each room is equipped with a wireless thermometer and the controller is equipped with a wireless link which interfaces with the wireless thermometers to receive data from them; there may also be a wireless thermometer outside the house, which reports the outside air temperature to the climate control system.

In one embodiment, the conditioned air vent in each room is equipped with a controllable damper 26 which can be opened and closed to permit or prevent air from passing from the duct into the room. In one such embodiment described by the co-pending parent application, the dampers are inflatable bladders which are coupled to a valve pump system by pneumatic tubes 28 disposed within the ducts; the bladders are individually inflated and deflated by the valve pump system, whose operation is managed by the controller.

The controller is equipped with a display interface via which the user interacts with the system. The display interface includes a visual display which presents information to the user, and an input apparatus which accepts commands from the user. The particular details of the display controller are not especially pertinent to the invention; any suitable input and output means will suffice. In one embodiment, the display interface comprises a liquid crystal touch panel display which functions both as the output device and the input device.

The user provides inputs and commands via the display interface, to control various aspects of the operation of the HVAC system. For example, the user may switch the system from a standby or off mode to an on mode. Or, the user may adjust the thermostat setting for the house or for a particular room. Or, the user may alter the conditioning schedule for the house or for a particular room.

In a conventional HVAC system, the user makes such changes without any feedback or calculation of the financial cost or savings resulting from the changes, beyond a general and somewhat vague sense that the warmer the house is kept in the winter and the cooler it is kept in the summer, the higher the bill will be. The user is likely to make very different tradeoffs and decisions in setting his HVAC system, in the absence of any quantization of the resulting cost or savings, than he would make if he had an immediate and reasonably accurate estimate of the cost or savings.

What is desirable, then, is an improved HVAC controller and method of operation of the same, providing the user with reasonably accurate estimates of the financial impact of changes made to the HVAC system settings.

BRIEF DESCRIPTION OF THE DRAWINGS

FIGS. 3A and 3B show one method for heating, by which the HVAC controller may determine which vents to open, whether a heating cycle may be performed, and for how long.

FIG. 4 shows one method of circulation for heating, used for warming up some rooms without running the heater.

FIGS. 5A and 5B show one method of circulation for temperature equalization, used for correcting over-conditioning of some rooms.

FIG. 6 shows one method of circulation for maintaining air quality.

Figure 1:
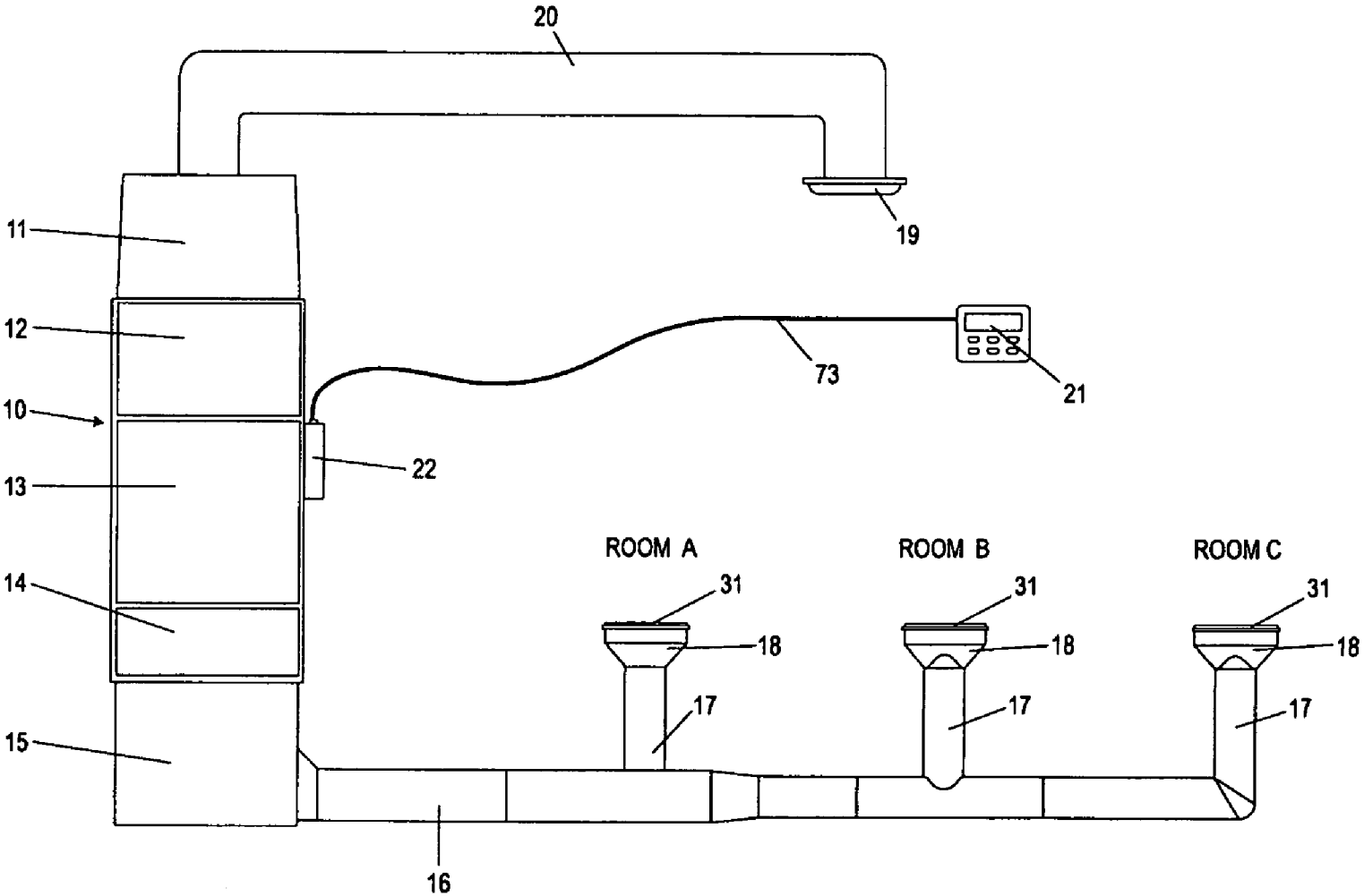
FIG. 1 shows a conventional residential forced-air HVAC system.

Table 1 contains "high temperature above" probability data for Portland, Oreg. as provided in 5° increments by the National Weather Service.

Table 2 contains "low temperature above" probability data for Portland, Oreg. as provided in 5° increments by the National Weather Service.

Table 3 contains "low temperature below" probability data derived from Table 2 and range extended.

Table 4 contains average monthly high and low temperature data for Portland, Oreg. as provided by the National weather Service.

Table 5 contains average monthly temperature spread data for Portland, Oreg. derived from the data of Table 4.

Table 6 contains data indicating the daily local climate pattern during the cooling season for Portland, Oreg.

Table 7 contains data indicating the daily local climate pattern during the heating season for Portland, Oreg.

Table 8 contains high temperature probability data for Portland, Oreg. in 1° increments interpolated from the data of Table 1.

Table 9 contains low temperature probability data for Portland, Oreg. in 1° increments interpolated from the data of Table 3.

Table 10 contains data indicating, for each month, the likely number of days whose high temperature will be at or above each temperature in the range, derived from the data of Table 8.

Table 11 contains data indicating, for each month, the likely number of days whose low temperature will be at or below each temperature in the range, derived from the data of Table 9.

Table 12 contains data indicating, for each month, the likely number of days whose high temperature will be at or above each temperature in the range, derived from the data of Tables 10 and 5.

Table 13 contains data indicating, for each month, the likely number of days whose high temperature will be at or below each temperature in the range, derived from the data of Tables 11 and5.

Table 14 contains data indicating, for the year, the likely number of days on which the hottest hour of the day will be at or above each temperature in the range, derived from the data of Table 10.

Table 15 contains data indicating, for the year, the likely number of days on which the coolest hour of the day will be at or above each temperature in the range, derived from the data of Table 12.

Table 16 contains data indicating, for the year, the likely number of days on which the hottest hour of the day will be at or above each temperature in the range, derived from the data of Table 13.

Table 17 contains data indicating, for the year, the likely number of days on which the coldest hour of the day will be at or above each temperature in the range, derived from the data of Table 11.

Table 18 contains data indicating, for the year, the number of degree-hours that the hottest hour of the day will be at or above each temperature in the range, derived from the data of Table 14.

Table 19 contains data indicating, for the year, the number of degree-hours that the coolest hour of the day will be at or above each temperature in the range, derived from the data of Table 15.

Table 20 contains data indicating, for the year, the number of degree-hours that the warmest hour of the day will be at or below each temperature in the range, derived from the data of Table 16.

Table 21 contains data indicating, for the year, the number of degree-hours that the coldest hour of the day will be at or below each temperature in the range, derived from the data of Table 17.

DETAILED DESCRIPTION

The invention will be understood more fully from the detailed description given below and from the accompanying drawings of embodiments of the invention which, however, should not be taken to limit the invention to the specific embodiments described, but are for explanation and understanding only.

OUTLINE

I. Zone Climate Control
- A. Forced Air Central HVAC Systems
- B. Retrofit Zone Climate Control System II. House and HVAC System Thermal Model
- A. Parameters
  - 1. Room Parameters
  - 2. HVAC System Parameters
  - 3. House Parameters
  - 4. Delta Values
- B. Stored Data
  - 1. Short Term Data Storage
    - a. Room Short Term Data
    - b. HVAC System Short Term Data
    - c. House Short Term Data
  - 2. Long Term Data Storage
    - a. Room Long Term Data
    - b. HVAC System Long Term Data
    - c. House Long Term Data
- C. Calibrating the Thermal Model Using the Stored Data III. Basic Control Operating Methodology
- A. Initial Installation
- B. Temperature Control
  - 1. Heating
  - 2. Cooling
- C. Circulation
  - 1. Circulation for Heating
  - 2. Circulation for Cooling
  - 3. Circulation to Reduce Over-Conditioning
  - 4. Circulation for Air Quality
- D. Anticipation IV. Energy Usage Estimation
- A. Initial Installation
- B. Energy Usage Estimation Methodology The zone climate control system, thermal model, and operating methodology will be described with reference to specific embodiments and, in the interest of conciseness, will focus more on heating than on cooling. The invention is, of course, not limited to these specific details, which are provided for the reader's convenience and education only.

I. Zone Climate Control

A. Forced Air Central HVAC Systems

FIG. 1 is a block diagram of a typical forced air system. The existing central HVAC unit 10 is typically comprised of a return air plenum 11, a blower 12, a furnace 13, an optional heat exchanger for air conditioning 14, and a conditioned air plenum 15. The configuration shown is called "down flow" because the air flows down. Other possible configurations include "up flow" and "horizontal flow". A network of air duct trunks 16 and air duct branches 17 connect from the conditioned air plenum 15 to each air vent 18 in room A, room B, and room C. Each air vent is covered by an air grill 31. Although only three rooms are represented in FIG. 1, the invention is designed for larger houses with many rooms and, typically, at least one air vent in each room. The conditioned air forced into each room is typically returned to the central HVAC unit 10 through one or more common return air vents 19 located in central areas. Air flows through the air return duct 20 into the return plenum 11.

A thermostat 21 is connected by a multi-conductor cable 73 to an HVAC controller 22 that switches power to the blower, furnace and air conditioner. The thermostat commands the blower and furnace or blower and air conditioner to provide conditioned air to cause the temperature at the thermostat to move toward the temperature set at the thermostat.

FIG. 1 is only representative of many possible configurations of forced air HVAC systems found in existing houses. For example, the air conditioner can be replaced by a heat pump that can provide both heating and cooling, eliminating the furnace. In some climates, a heat pump is used in combination with a furnace. The present invention can accommodate the different configurations found in most existing houses.

B. Retrofit Zone Climate Control Systems

Figure 2:
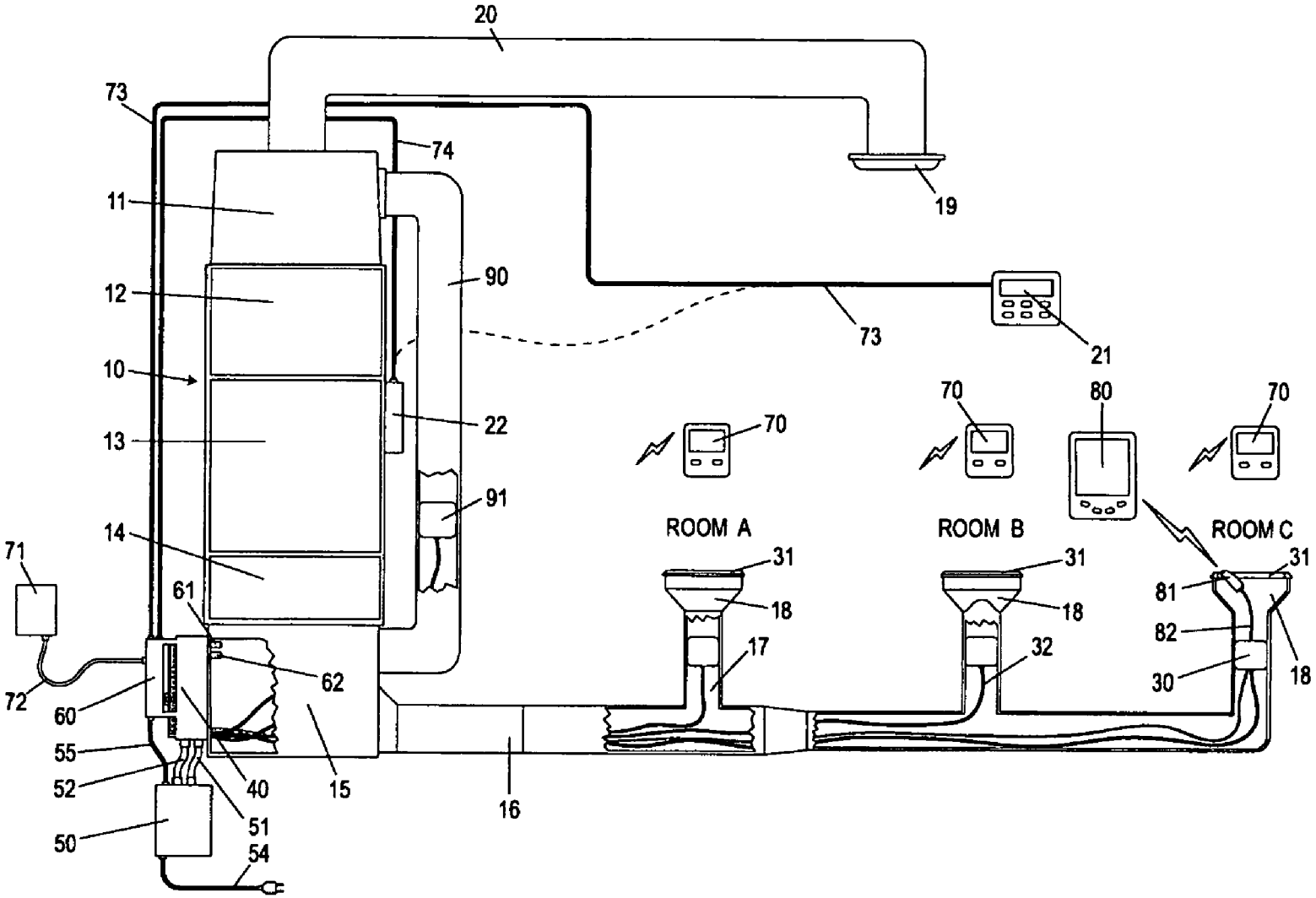
FIG. 2 shows the zone climate control system as retrofitted into the HVAC system.

FIG. 2 is a block diagram of one embodiment of the present invention installed in an existing forced air HVAC system, such as that shown in FIG. 1. The airflow through each vent is controlled by a substantially airtight bladder 30 mounted behind the air grill 31 covering the air vent 18. The bladder is, ideally, either fully inflated or fully deflated while the blower 12 is forcing air through the air duct 17. A small air tube 32 (~0.25" OD) is pulled through the existing air ducts to connect each bladder to one air valve of a plurality of servo controlled air valves 40. In one embodiment, the air valves are mounted on the side of the conditioned air plenum 15. There is one air valve for each bladder, or, in some embodiments, one air valve for each set of commonly-acting bladders (such as, for example, if there are multiple vents in a single room).

A small air pump in air pump enclosure 50 provides a source of low-pressure (~1 psi) compressed air and vacuum at a rate of e.g. ~1.5 cubic feet per minute. The pressure air tube 51 connects the pressurized air to the air valves 40. The vacuum air tube 52 connects the vacuum to the air valves. The air pump enclosure also contains a low voltage (typically 5 or 12 volts) power supply and control circuit for the air pump. The AC power cord 54 connects the system to 110V AC power. The power and control cable 55 connect the low voltage power supply to the control processor and servo controlled air valves and connect the control processor 60 to the circuit that controls the air pump. The control processor controls the air valve servos to set each air valve to one of two positions. The first position connects the compressed air to the air tube so that the bladder inflates. The second position connects the vacuum to the air tube so that the bladder deflates.

A wireless thermometer 70 is placed in each room in the house. All thermometers transmit, on a shared radio frequency of 418 MHz, packets of digital information that encode 32-bit digital messages. A digital message includes a unique thermometer identification number, the temperature, and command data. Two or more thermometers can transmit at the same time, causing errors in the data. To detect errors, the 32-bit digital message is encoded twice in the packet. The radio receiver 71 decodes the messages from all the thermometers, discards packets that have errors, and generates messages that are communicated by serial data link 72 to the control processor. The radio receiver can be located away from the shielding effects of the HVAC equipment if necessary, to ensure reception from all thermometers.

The control processor is connected to the existing HVAC controller 22 by the existing HVAC controller connection 74. The existing thermostat 21 is replaced by a graphical display 80 with a touch sensitive screen. The graphical display is connected to the processor using the same wires that had been used by the existing thermostat. Therefore, no new wires need be installed through the walls. The program executing in the processor controls the graphical display and touch screen to provide the occupant a convenient way to program the temperature schedules for the rooms and to display useful information about energy usage and the operation of the HVAC system.

The control processor controls the HVAC equipment and the airflow to each room according to the temperature reported for each room and according to an independent temperature schedule for each room. The temperature schedules specify a heat-when-below-temperature and a cool-when-above-temperature for each minute of a 24-hour day. A different temperature schedule can be specified for each day for each room.

The present invention can set the bladders so that all of the airflow goes to a single air vent, thereby conditioning the air in a single room. This could cause excessive air velocity and noise at the air vent and possibly damage the HVAC equipment. This is solved by connecting a bypass air duct 90 between the conditioned air plenum 15 and the return air plenum 11. A bladder 91 is installed in the bypass 90 and its air tube is connected to an air valve 40 so that the control processor can enable or disable the bypass. The bypass provides a path for the excess airflow and storage for conditioned air. The control processor is interfaced to a temperature sensor 61 located inside the conditioned air plenum. The control processor monitors the conditioned air temperature to ensure that the temperature in the plenum does not go above a preset temperature when heating or below a preset temperature when cooling, and ensures that the blower continues to run until all of the heating or cooling has been transferred to the rooms. This is important when bypass is used and only a portion of the heating or cooling capacity is needed, so the furnace or air conditioner is turned only for a short time. Some existing HVAC equipment has two or more heating or cooling speeds or capacities. When present, the control processor controls the speed control and selects the speed based on the number of air vents open. This capability can eliminate the need for the bypass.

A pressure sensor 62 is mounted inside the conditioned air plenum and interfaced to the control processor. The plenum pressure as a function of different bladder settings is used to deduce the airflow capacity of each air vent in the system and to predict the plenum pressure for any combination of air valve settings. The airflow to each room and the time spent heating or cooling each room is use to provide a relative measure of the energy used to condition each room. This information is reported to the house occupants via the graphical display screen.

This brief description of the components of the present invention installed in an existing residential HVAC system provides an understanding of how independent temperature schedules are applied to each room in the house, and the improvements provided by the present invention. The following discloses the details of each of the components and how the components work together to proved the claimed features.

II. Thermal Model

A. Parameters

The present invention uses one instance of a first set of parameters to describe and control the climate control of each respective room, and to make energy usage calculations regarding that room. In this context, a "room" is defined as a portion of a house associated with a particular smart controller (wireless thermometer 70). In one embodiment, there may be up to 32 rooms. The invention also uses one instance of a second set of parameters to describe and control the operation of each HVAC system in the house. In one embodiment, there may be up to 5 HVAC systems. The invention also uses a third set of parameters to describe and control the entire house. Customarily, any given room gets its conditioned air supply from a single, predetermined one of the HVAC systems. In other words, the room's ductwork is connected to exactly one HVAC system. This is not a necessary limitation on the invention, although for convenience the house will be described in such terms herein.

The parameters are either measured, or derived from data measured while controlling the HVAC systems, and they become more accurate over time, as more data are gathered and factored into the derivation. Upon initial installation, default values may be utilized. In some embodiments, the default values may be customized to suit the particular house and/or local climate.

Before explaining the climate control methodology and its algorithms in detail, it will be useful to the reader to have an understanding of the data, parameters, and values used by such.

1. Room Parameters

In one embodiment, there are eight parameters associated with each room:

a. Current Temperature

Naturally, the current temperature in the room has the most significant impact on whether the HVAC system will be run. If the temperature does not need to be changed in order to bring the room into a specified target temperature range, then the room will not be the cause of the HVAC system being turned on.

b. Airflow

The airflow parameter is a unit-less value indicating the relative portion of the airflow that goes to a particular room compared to the total airflow in the plenum of the HVAC system. The bypass vent also has an airflow parameter associated with it. The airflow value is used in predicting plenum pressure for any combination of open and closed air vents, and in prorating energy usage to each room. The airflow value is always used in a ratio or with a calibrated scale factor, so it has no units and its absolute value is not important. In one embodiment, the average value of the airflow parameter for each room in the house is chosen to be an integer value of 100, and each airflow parameter will typically be within the range of 30 to 300, corresponding to airflows of 0.3 to 3 times the average airflow. The range can, of course, vary depending on the specific duct system.

Plenum pressure is predicted according to the equation:

$$PP = \frac{K_{HVAC}}{(Airflow_i + Airflow_j \ \ldots + Airflow_n)}$$

where:

PP is the predicted plenum pressure.

$K_{HVAC}$ is one of a set of calibration or scaling factors determined during installation of the HVAC system which includes the plenum whose pressure is being predicted and which supplies conditioned air to this room. There is a different $K_{HVAC}$ scaling factor for each HVAC function, because the fan is typically set up to run at different speeds for heating, cooling, and circulation. These specific factors are $K_{HEAT}$, $K_{COOL}$, and $K_{CIR}$, and the appropriate one is used as $K_{HVAC}$ in predicting plenum pressure, according to which type of HVAC function is to be performed. Some HVAC systems have two or more selectable heating or cooling rates. For these systems, a separate $K_{HVAC}$ factor is used for each rate to account for different fan speeds.

$Airflow_x$ is the airflow parameter of each room or bypass which has its vents set open. $Airflow_{bypass}$ is included if the bypass is open, because the bypass contributes to lowering plenum pressure.

In typical residential HVAC systems, the plenum pressure should be limited to ~0.5" to 1.0" $H_2O$ (inches of water), equivalent to ~0.018 to 0.36 psi (pounds per square inch). In one embodiment of the invention, it is beneficial to use only integer arithmetic for all calculations. Therefore inches-$H_2O$ is scaled by 1,000 to be "thousandths of inches of water" so that the maximum plenum pressure typically has an integer value of 500 to 1,000. For example, if four average rooms ($Airflow_x$=100) must be turned on to make the plenum pressure equal 500, then the value of $K_{HVAC}$ is 200,000=500*(100+100+100+100). The measured plenum pressure is scaled in a corresponding way, so that when the plenum pressure is 0.5" $H_2O$, the measured value used in calculations is 500.

The parameter $Airflow_x$ for each room and for the bypass is determined using a set of measured plenum pressures for a set of predetermined combinations of room and bypass vent settings. The process for determining $Airflow_{bypass}$ for the bypass is the same as for rooms, so in the following description, the bypass is treated as an additional room. The combinations are generated by representing the OPEN/CLOSED states of the vent(s) in rooms as bits in a circular binary array. Suppose there are n−1 rooms and a bypass. The binary array then has n elements and the elements are numbered 1, 2, . . . , n. The array is indexed using modulo arithmetic, so that an index value of n+1 accesses element 1, n+2 accesses element 2, etc. Thus, indexing is "circular" so that the end connects to the beginning. When the value of an element is 0, the air vent of the corresponding room is CLOSED (room is CLOSED). When the element has a value of 1, the air vent of the corresponding room is OPEN (room is OPEN).

Two groups of combinations are generated. The A group starts with j=n/3 (rounded down to an integer) rooms OPEN, and n-j rooms CLOSED. The B group starts with n-j rooms OPEN and j rooms CLOSED. The first combination in the A group sets rooms 1 through j OPEN and rooms j+1 through n CLOSED, and the plenum pressure $PP_{A1:J}$ is measured. The second combination in the A group additionally sets room j+1 OPEN, and the plenum pressure $PP_{A1:j+1}$ is measured. The third combination sets room 1 CLOSED, and the plenum pressure $PP_{A2:j+1}$ is measured, the fourth combination sets room j+2 OPEN and the plenum pressure $PP_{A2:j+2}$ is measured. Setting the next room OPEN, followed by setting the last room CLOSED sequentially generates the combinations. The difference between successive combinations is one additional room OPEN, or one previously OPEN room CLOSED. The number of rooms OPEN alternates between j and j+1. 2n such A group combinations are generated until the combination repeats. B group combinations are generated in the same way, beginning with rooms 1 through n-j set OPEN. The number of rooms set OPEN alternates between nj and n-j+1. 2n such B group combinations are generated. The following is an example for 6 rooms with the nomenclature for the 24 measured plenum pressures and the corresponding combinations in the 6 element binary array:

| A Group | | B Group | |
|---|---|---|---|
| $PP_{A1:2}$ | 110000 | $PP_{B1:4}$ | 111100 |
| $PP_{A1:3}$ | 111000 | $PP_{B1:5}$ | 111110 |
| $PP_{A2:3}$ | 011000 | $PP_{B2:5}$ | 011110 |

-continued

| A Group | | B Group | |
|---|---|---|---|
| $PP_{A2:4}$ | 011100 | $PP_{B2:6}$ | 011111 |
| $PP_{A3:4}$ | 001100 | $PP_{B3:6}$ | 001111 |
| $PP_{A3:5}$ | 001110 | $PP_{B3:7}$ | 101111 |
| $PP_{A4:5}$ | 000110 | $PP_{B4:7}$ | 100111 |
| $PP_{A4:6}$ | 000111 | $PP_{B4:8}$ | 110111 |
| $PP_{A5:6}$ | 000011 | $PP_{B5:8}$ | 110011 |
| $PP_{A5:7}$ | 100011 | $PP_{B5:9}$ | 111011 |
| $PP_{A6:7}$ | 100001 | $PP_{B6:9}$ | 111001 |
| $PP_{A6:8}$ | 110001 | $PP_{B6:10}$ | 111101 |

This combination generating method yields 4n pressure measurements to determine n airflow values. Each room is OPEN and CLOSED an equal number of times, and there are 4 pairs of measurements for each room where the difference is only that one room. Using the equation for predicting plenum pressure, a typical pair of equations is:

$$PP_{Ak:i-1}=k_{HAVC}/\text{sum}(\text{Airflow}_{k:i-1})$$

$$PP_{Ak:i}=k_{HAvc}/(\text{sum}(\text{AirfloW}_{k:i-1})+\text{Airflow}_i)$$

This pair can be combined to eliminate the term: sum($\text{Airflow}_{k:i-1}$), the combined airflow for the common set of rooms that are OPEN for the two measurements; The resulting equation is:

$$\text{Airflow}_i=(k_{HAVC}/PP_{Ak:i})-(k_{HAVC}/PP_{Ak:i-1})$$

Since $k_{HAVC}$ is a common scale factor, it can be conveniently selected so that the average $\text{Airflow}_i$ term is about 100 and so that integer arithmetic can be used for the calculations. A value of 200,000 for $\text{Airflow}_i$ can be used (as described above), so the equation produces a calibrated value for $\text{Airflow}_i$. Three other pairs of plenum pressure measurements can be used to find independent measurements of $\text{Airflow}_i$:

$PP_{Ai:k}$ with $PP_{Ai+1:k}$ $PP_{Bi:k}$ with $PP_{Bi+1:k}$ $PP_{Bk:i-1}$ with $PP_{Bk:i}$ Each pair yields a value of $\text{Airflow}_i$ for a different set of rooms in combination with the $i^{th}$ room. The airflow may be slightly different for different combinations because rooms may share the same trunk duct so that the room airflows are somewhat dependent on each other. Using the average of the four values partially compensated for such dependencies.

Energy usage is prorated according to the equation:

$$PE_i = \frac{Airflow_i}{(Airflow_i + Airflow_j + \ldots + Airflow_n)}$$

where:

$PE_i$ is the energy prorated to the $\text{room}_i$; and $\text{Airflow}_x$ is the airflow parameter of each room which has its vent OPEN. The bypass is not included, because it does not materially contribute to energy usage.

The value of PE is bounded 0<PE<=1, and thus represents a unit-less percentage of energy usage attributed to the particular room.

C. Heat Capacity

The heat capacity, $\text{Capacity}_{HEAT}$, is the time in seconds the furnace must run to raise the temperature of the room by 1 degree. $\text{Capacity}_{HEAT}$ considers only the ability of the room to hold heat energy and the ability of the furnace to produce heat, and is independent of thermal losses or gains caused by differences between inside and outside temperatures.

d. Cool Capacity

The cool capacity, $\text{Capacity}_{cooL}$, is the time in seconds the air conditioning must run to lower the temperature of the room by 1 degree, and is similar in nature to $\text{Capacity}_{HEAT}$.

e. Heat Offset

The heat offset, $\text{TempOffset}_{HEAT}$, is an empirical correction factor derived from stored operating data that corrects for secondary heat sources such as sunlight through a window, incandescent lights, appliances, and thermal coupling to other heated rooms. Its units are seconds per hour.

f. Heat Loss Factor

The heat loss factor, $\text{LOSS}_{HEAT}$, represents the amount of heat required to keep the room at a specific temperature, and is determined according to the equation:

$$\text{Loss}_{HEAT}=\text{TempOffset}_{HEAT}+(\text{Temp}_{room}-\text{Temp}_{outside})*UF_{HEAT}$$

where:

$\text{LOSS}_{HEAT}$ is the time in seconds the furnace would have to run per hour to supply the heat needed to maintain a constant room temperature. This value assumes that all of the furnace's heat could be sent to this one room; this cannot happen in most systems since the plenum pressure would be too high. Therefore, when the $\text{LOSS}_{HEAT}$ factor is actually used, it is scaled by the prorated airflow being provided to the room.

$\text{TempOffset}_{HEAT}$ is as described above.

$\text{Temp}_{room}$ is the current temperature in the room.

$\text{Temp}_{outside}$ is the current temperature outside the house.

$\text{UF}_{HEAT}$ is an empirical energy usage factor, derived from operating data. It is related to the reciprocal of the more familiar insulation "R factor". $\text{UF}_{HEAT}$ represents the rate of increase in energy usage needed to keep a room at the target temperature as the outside temperature drops. Its units are seconds per hour per degree.

The calculated $\text{LOSS}_{HEAT}$ value is valid only if it has a positive value. If it is zero or negative, the outside temperature is not low enough for the room to need heat.

g. Cool Offset

The cool offset factor, $\text{TempOffset}_{COOL}$, is an empirical factor similar to $\text{TempOffset}_{HEAT}$, and corrects for sources of heating and cooling. A source of cooling could be a basement room kept cool by the ground and having little thermal contact with the outside air.

h. Cool Loss Factor

The cool loss factor, $\text{LOSS}_{COOL}$, represents the amount of cooling required to keep the room at a specific temperature, and is determined according to the equation:

$$\text{Loss}_{COOL}=\text{TempOffset}_{COOL}+(\text{Temp}_{room}-\text{TemP}_{outside})*UF_{COOL}$$

where:

$\text{LOSS}_{COOL}$ is the time in seconds the air conditioner must run per hour to supply the cooling to maintain a constant room temperature. When it is used, it is scaled by the prorated airflow.

$\text{Temp}_{room}$ is the current temperature of the room.

$\text{Temp}_{outide}$ is the current outside temperature.

$\text{UF}_{COOL}$ is an empirical factor, derived from operating data, which represents the rate of energy usage needed to keep the room at the target temperature as the outside temperature increases. Its units are seconds per hour per degree. Its sign is negative, since ($Temp_{room}$ −$Temp_{outside}$) becomes more negative as the outside temperature increases.

The calculated $LOSS_{COOL}$ value is valid only if it has a positive value. If it is zero or negative, the outside temperature is not high enough for the room to need cooling.

Typical rooms have sources of heating, so $LOSS_{HEAT}$ becomes positive only if the outside temperature is several degrees cooler than the target temperature ("heat when below" temperature) for heating. Likewise, $LOSS_{COOL}$ becomes positive when the outside temperature is several degrees cooler than the target temperature for cooling ("cool when above" temperature).

2. HVAC System Parameters

Many residential HVAC systems use different fan speeds for the different HVAC functions. For example, the fan speed is lowest for the circulation function, higher for the heating function, and highest for the cooling function. Since the plenum pressure increases as fan speed increases, the plenum pressure $K_{HVAC}$ scale factors $K_{HEAT}$, $K_{COOL}$, and $K_{CIR}$, are different for the functions as described above. The calibration process is done using the circulation function, so $K_{CIR}$ is arbitrarily set to a value of 200,000. $K_{HEAT}$ and $K_{COOL}$ are then determined by comparing the measured plenum pressure for the heating and cooling functions with the predicted plenum pressure using $K_{CIR}$.

3. House Parameters

The thermal behavior of the house as a whole is the composite of the behaviors of all of the rooms. Therefore there is a set of six corresponding thermal parameters for the whole house: $Capacity_{HEAT}$, $TempOffset_{HEAT}$, $UF_{HEAT}$, $Capacity_{COOL}$, $TempOffset_{COOL}$, and $UF_{COOL}$, which are used to calculate $LOSS_{HEAT}$ and $LOSS_{COOL}$, and to control the HVAC equipment to achieve the desired temperatures in each of the rooms. There is no separate Airflow factor for the whole house.

4. Measuring $Capacity_{HEAT}$ and $Capacity_{COOL}$

When the outside temperature is cold enough to require heating of a room, the room is heated (by warm air flow) for a period of time and its temperature increases. The room is then unheated for a period of time while the $Capacity_{HEAT}$ of the room supplies the heat lost to the outside (and perhaps to other rooms) and its temperature decreases. After some period of time, the temperature will have decreased sufficiently such that heating is again required for the room. The time between the heating cycles, and the difference between the outside temperature and the room temperature, can be used to calculate the heat lost ($LOSS_{HEAT}$) during that period. The $Capacity_{HEAT}$ is then (heat lost)/(room temperature change). This is more accurate if the average of the $LOSS_{HEAT}$ at the beginning of the period and the $LOSS_{HEAT}$ at the end of the period is used. Using the average is important when the outside temperature changes significantly during the measurement period.

In one embodiment, parameters are measured and stored for each room as the system controls the heating cycles according to the temperatures in the rooms. A $Capacity_{HEAT}$ is calculated for each room and for each time period between the heating cycles for that room. (Since rooms are heated only when needed, the time period between cycles is typically different for different rooms.) During each 24-hour period, the individual measurements of $Capacity_{HEAT}$ are accumulated, and at the end of the 24-hour period, the average $Capacity_{HEAT}$ is calculated for each room and is stored into long term storage.

This method of measuring $Capacity_{HEAT}$ is meaningful only if the room continuously cools between heating cycles, the change in temperature between cycles is sufficient to be measured accurately, and the environment (outside air temperature and activity in the room) has not changed significantly between heating cycles. In one embodiment, the temperature measurement has a resolution of 0.25 degree, so the change in temperature needs to be at least 0.5 degree for the measurement to have any significance. A special case occurs when the target heat temperature is reduced. The time between heating cycles may be unusually long since the room temperature may decrease several degrees before heating is required, so it is likely the environment will change significantly before heating in again needed. However, the larger change in room temperature will produce a more accurate measurement of $Capacity_{HEAT}$. Therefore the measurement is terminated when the time since the last heat cycle exceeds two hours, and a value for $Capacity_{HEAT}$ is calculated. Considering the possible sources of error when measuring $Capacity_{HEAT}$, the measured value of $Capacity_{HEAT}$ is used in the average only if all of the following conditions are satisfied:

1. The change in room temperature is more than 0.5 degree during the measurement period.
2. The calculated $LOSS_{HEAT}$ is positive at the beginning and end of the measurement period.
3. The measured $Capacity_{HEAT}$ is greater than 10% of the average $LOSS_{HEAT}$, during the measurement period. If $Capacity_{HEAT}$ is small compared to $LOSS_{HEAT}$, It does not contribute significantly to any of the methods used to control the HVAC system. This also helps prevent the average $Capacity_{HEAT}$ for the 24-hour period from being distorted by a temporary source of heat such as a fireplace.

The method for measuring $Capacity_{COOL}$ is similar. When the outside temperature is high enough to require the room to be cooled, the room temperature decreases while the room receives cool airflow. The temperature increases between cooling cycles as heat from the outside overcomes the $Capacity_{COOL}$ of the room at a rate of $LOSS_{COOL}$. $Capacity_{COOL}$ is then (heat gain)/(room temperature change).

During any 24-hour period, only $Capacity_{COOL}$ or $Capacity_{HEAT}$ may be measured. If both heating and cooling are used during the 24-hour period, the environmental conditions are extremely variable and the Capacity values measured are likely to have large errors. Therefore no value for either Capacity is stored long term.

B. Stored Data

1. Short Term Data Storage

In one embodiment, the system gathers the following data and stores it for a relatively short period of time, such as a few days. In one embodiment, the total storage for one day is set to 32 Kbytes so that one bank of flash memory can store two days of data for a maximally configured system with 32 rooms and 5 HVAC systems. In one embodiment, the system includes flash memories, operated in ping-pong fashion in which one memory or block is used until it is full, and then the other, older block is erased and used for new data.

a. Room Short Term Data

Room Temperature. For each room, the current room temperature, recorded every 6 minutes, stored as 1 byte. The daily data quantity is 32 rooms*1 sample/room*1 byte/sample* 10 samples/hour*24 hours=7,680 bytes.

Room Target Temperature Changes. For each target temperature change for any given room, the following data are stored in a structure:

The ID number of the room and the settings for quiet mode (which causes the system to use a reduced plenum pressure when this room is receiving airflow and the relative amount of circulation to use to control the temperature (low, medium, or high), etc., 1 byte.

New target heat temperature, 1 byte.

New target cool temperature, 1 byte.

Transition time since midnight, scaled to 6-minute units to fit in 1 byte and match the sampling rate of the temperatures.

This structure requires 4 bytes of storage per transition. In one embodiment, 451 such structures (~16 per room in a maximally configured system)=1804 bytes are provided for one day of short term storage. These changes can be caused by daily temperature schedules (no more than 6 per day) or by button pushes at the Smart Controllers. In the very unlikely event the storage is fully used, the transitions for the remainder of the day are not stored.

b. HVAC System Short Term Data

HVAC System Cycle. For each cycle of the HVAC equipment, the following data are recorded:

Cycle start time, in seconds since midnight, divided by 2 so it fits in 2 bytes.

HVAC equipment duration, in seconds, stored in 2 bytes. This is the actual time the heat source or cool source used energy during the cycle.

Dead time of the cycle, which is the difference in seconds between the total time of the cycle and the HVAC equipment duration, stored in 1 byte. This is the time used to set the airflow control valves (inflate or deflate the bladders) before the start of HVAC equipment duration plus the additional circulation time after the HVAC equipment duration to fully extract the heating or cooling inn the plenum.

ID number (1-5) of the HVAC system running the cycle, 1 byte.

HVAC activity type, 1 byte comprising 8 bit fields each indicating whether the HVAC cycle included the bypass, the outside air vent, and any combination of the 6 HVAC controls used turn on the fan, heating, cooling, etc.

Rooms whose vents were open for the cycle, indicated by 32 respective bit fields in a 4-byte word.

Minimum plenum pressure measured during the cycle, scaled to fit in a 1-byte value.

Maximum plenum pressure measured during the cycle, scaled to fit in a 1-byte value.

Predicted plenum pressure measured during the cycle, scaled to fit in a 1-byte value.

Minimum plenum temperature measured during the cycle, 1-byte.

Maximum plenum temperature measured during the cycle, 1-byte.

Minimum humidity measured during the cycle, 1-byte.

Maximum humidity measured during the cycle, 1-byte.

This structure uses 18 bytes of storage per HVAC cycle. In one embodiment, 1280 such structures=23,040 bytes are provided for each day of short term storage. This is sufficient for any operating conditions of a maximally configured system.

C. House Short-Term Data

Outside temperature. Current outside temperature, recorded every 6 minutes, stored as 1 byte. The daily data quantity is 1 byte/sample*10 samples/hour*24 hours=240 bytes.

Date. The year, month, and day stored in a 4-byte word. This value is only used when recovering from a power failure.

In one embodiment, the total daily short term data storage provided is:

32*240=7,680 bytes for room temperatures

451*4=1,804 bytes for target temperature transitions

1280*18=23,040 bytes for HVAC equipment cycles 240 bytes for outside temperature 4 bytes for date Total=32,768 bytes (32 Kbytes).

2. Long-Term Data Storage

Every day, shortly after midnight, the short-term data from the previous day are processed to derive a smaller data set for longer-term storage.

a. Room Long Term Data Storage

The following data are stored for each room in the house:

Minimum temperature measured in the room, 1 byte

Maximum temperature measured in the room, 1 byte

Average temperature measured in the room, 1 byte

Average difference between the room temperature and the outside temperature (the average of the 240 differences measured during the 24-hour period), 1 byte.

Maximum negative difference between the measured room temperature and the target heat temperature, 1 byte. In other words, the most "too cold" the room was when it should have been heated.

Maximum positive difference between the measured room temperature and the target cool temperature, 1 byte. In other words, the most "too hot" the room was when it should have been cooled.

Prorated number of seconds of HVAC activity for the room, divided by 2 so it fits in 2 bytes, for each of the 6 HVAC controls, for a total of 12 bytes. This data is used to calculate the UF and Offset parameters for the thermal model.

Minimum humidity measured in the plenum when the room was receiving airflow for the HVAC cycle, 1 byte.

Maximum humidity measured in the plenum when the room was receiving airflow for the HVAC cycle, 1 byte.

Average humidity measured in the plenum when the room was receiving airflow for the HVAC cycle, 1 byte.

Average signal strength of the room's Smart Controller as measured at the central receiver, 1 byte.

The number of commands received from the room's Smart Controller, 1 byte.

Room status settings including quiet mode, circulation mode, etc., one byte.

$UF_{HEAT}$ calculate for the day, 1 byte.

$TempOffset_{HEAT}/UF_{HEAT}$ calculated for the day, 1 byte.

$UF_{COOL}$ calculate for the day, 1 byte.

$TempOffset_{COOL}/UF_{COOL}$ calculated for the day, 1 byte.

$Capacity_{HEAT}$ measurement for the day, 2 bytes.

$Capacity_{COOL}$ measurement for the day, 2 bytes.

These parameters require a total of 32 bytes per day per room, for a maximum daily data quantity of 1,024 bytes for 32 rooms.

b. HVAC System Long-Term Data Storage

The following data are stored for each of the up to 5 HVAC systems:

Data for the cycle which produced the highest plenum pressure, 18 bytes.

Data for the cycle which produced the largest difference between the predicted plenum pressure and the measured maximum plenum pressure, 18 bytes.

Data for the cycle which produced the highest plenum temperature, 18 bytes.

Data for the cycle which produced the lowest plenum temperature, 18 bytes.

Data for the cycle which produced the highest measured humidity, 18 bytes.

Data for the cycle which produced the lowest measured humidity, 18 bytes.

Total number of HVAC cycles, 1 byte.

Total number of cycles for each of the 6 HVAC controls, 6 bytes total.

Total time, in seconds/2, that each of the 6 HVAC controls were active, 12 bytes total.

Number of commands entered at the touch screen controlled by this HVAC system, 2 bytes.

This gives a total daily data quantity of 128 bytes per HVAC system, 5*128=640 bytes for 5 HVAC systems.

C. House Long-Term Data Storage

The following data are stored for the whole house:

Date (year, month, date), 4 bytes.

Control mode or program active at the end of the day, 1 byte.

Minimum outside temperature, 1 byte.

Maximum outside temperature, 1 byte.

Average outside temperature, calculated as the average of the 240 stored measurements, 1 byte.

Minimum inside temperature in any room, 1 byte.

Maximum inside temperature in any room, 1 byte.

Weighted average inside temperature in any room, based on weightings which take into account the $UF_{HEAT}$ and $UF_{COOL}$ for each room, 1 byte.

Weighted average difference between inside and outside temperature, based on the difference between each room and the outside temperature, weighted by the average of $UF_{HEAT}$ and $UF_{COOL}$ for each room, 1 byte.

Weighted average target heat to temperature, 1 byte.

Weighted average target cool to temperature, 1 byte. The weighted average target temperatures are calculated by averaging the target temperatures for each room over the 24-hour periods, and weighting them according to the UF factors for each room.

This gives a total of 14 bytes of whole-house data per day. The total daily long term data storage is 1024+540+14=1,675 bytes. In one embodiment, 13 segments of 64 Kbytes (851,968 bytes) are allocated for long term storage, enough for 508 days.

C. Calibrating the Thermal Model Using the Stored Data

As described in the previous section, the heat loss factor, $LOSS_{HEAT}$, represents the amount of heat required to keep the room at a specific temperature, and is determined according to the equation:

$$Loss_{HEAT}=TempOffset_{HEAT}+(Temp_{room}-Temp_{outside})*UF_{HEAT}$$

This equation is a first order linear equation of the form:

$$y=a+b*x$$

Given a series of N measurements of x and y, the values of a and b can be determined using the formulas $$a=\left(\frac{1}{N}\right)*(\text{sum}(y_i)-\text{sum}(x_i)) \text{ and}$$

$$b=\frac{(\text{sum}(x_i*y_i)-a*\text{sum}(x_i))}{\text{sum}(x_i*x_i)}$$

where $\text{sum}(x_i)$ is the sum of all the x values for the N measurements.

$TempOffset_{HEAT}$ is calculated as $$TempOffset_{HEAT}=\left(\frac{1}{N}\right)*(\text{sum}(Loss_{HEAT})-\text{sum}(temp_{room}-temp_{outside}))$$

where $LOSS_{HEAT}$ is the stored prorated heating time (appropriately scaled to account for conversion from seconds to hours).

$UF_{HEAT}$ is calculated as $$UF_{HEAT}=\frac{(\text{sum}((temp_{room}-temp_{outside})-(TempOffset_{HEAT}*\text{sum}(temp_{room}-temp_{outside})))}{\text{sum}(temp_{room}-temp_{outside})}$$

The method for calculating $TempOffset_{COOL}$ and $UF_{COOL}$ is identical, except the prorated time for cooling is used to determine $LOSS_{COOL}$.

At the end of each 24-hour period, the thermal mode parameters are calculated for each room based on the short term data gathered for that day. Each cycle of HVAC activity for a room is evaluated as a pair of data values where one value is the Loss (3,600*[prorated seconds of* HVAC activity]/[time between cycles]), and the other value is the difference between the room temperature at the beginning of the cycle and the outside temperature.

At the beginning of each 24-hour period, a new set of thermal model parameters are calculated for each room, and these are used throughout the following 24-hour period. The simple average of the most recent values are used. Averaging the last 15 values smoothes day-to-day variations while compensating for systematic changes in the seasons. Other numbers of values can be averaged, depending on the dynamics of the local climate. If there are fewer than 15 values stored, then as many as are available are averaged.

Only parameter values for one of the HEAT or COOL thermal models are calculated each day. It may be necessary to search backward many months to retrieve the 15 most recent values of the "off season" thermal model. For example, in some temperate climates with short cooling seasons, it may be up to a year between the last day needing cooling previous season to the first day needing cooling of the new season.

III. Operational Methodology

A. Initial Installation

When the system is first installed, the $Airflow_i$ value for each room is determined through the set of measurements and calculations described above in section II.A.1.b.

Default values are automatically assigned to the other six parameters: $Capacity_{HEAT}$, $UF_{HEAT}$, $TempOffset_{HEAT}$, $Capacity_{COOL}$, $UF_{COOL}$, and $TempOffset_{COOL}$. The quality of the default values is important, to make the system work as well as possible upon initial installation, to avoid customer dissatisfaction during the first few days while the system extracts calibrated values from measured data. The default values should, ideally, be customized for the local climate at that particular time of year, and for the house itself e.g. the size of the house and the quality of its insulation. These default values will typically assume that the HVAC system is properly designed. A properly designed heating system can keep the house at 70 degrees on the coldest day, and a properly designed cooling system can keep the house at 72 degrees on the hottest day. A properly designed HVAC system can heat or cool the house temperature 5 degrees per hour. A properly designed heat pump system can typically change the house temperature only 2 degrees per hour, however. For a properly designed system, the airflow to each room should be proportional to the heating and/or cooling requirements of that room; however, in practice, most houses have problems here, and sometimes they are significant problems.

Reasonable default values for the six remaining parameters are:

$$TempOffset_{HEAT} = 10 \text{ degrees}$$

$$TempOffset_{COOL} = 10 \text{ degrees}$$

$$UF_{HEAT} = \frac{\left(\frac{60 \text{ sec}}{\text{min}} * \frac{60 \text{ min}}{\text{hour}} * Airflow_i\right)}{(TargetTemp_{HEAT} - Climate_{\text{MIN}} - TempOffset_{HEAT})}$$

$$UF_{COOL} = \frac{\left(\frac{60 \text{ sec}}{\text{min}} * \frac{60 \text{ min}}{\text{hour}} * Airflow_i\right)}{(Climate_{\text{Max}} + TempOffset_{COOL} - TargetTemp_{COOL})}$$

$$Capacity_{HEAT} = \frac{\frac{60 \text{ sec}}{\text{min}} * \frac{60 \text{ min}}{\text{hour}}}{2 \text{ degrees}} * Airflow_i$$

$$Capacity_{COOL} = \frac{\frac{60 \text{ sec}}{\text{min}} * \frac{60 \text{ min}}{\text{hour}}}{2 \text{ degrees}} * Airflow_i$$

The "5 degrees" factor is default degrees per hour the heating or cooling system can change the temperature of the whole house. This should be "2 degrees" for heat pumps.

B. Temperature Control

The temperature control method uses the thermal model, described above, to predict the conditioning time (in seconds) needed to keep all of the rooms within a predetermined number of degrees—DeltaT—of the target temperature. A reasonable default value for this global parameter may be 1 degree, but it may be changed, based on field experience, the local climate, and the homeowner's preference. When heating, it is acceptable to heat a room until its temperature is DeltaT above its target heating temperature. And when cooling, it is acceptable to cool a room until its temperature is DeltaT below its target cooling temperature.

In order to maximize the efficiency of the heating or cooling, and to minimize the number of cycles—which the occupants may find distracting, and which may stress the HVAC equipment excessively—the temperature control method attempts to make each cycle at least a minimum duration, if possible. A reasonable minimum duration may be 15 minutes. When bypass is used, it may be necessary to use a lower duration target, to avoid overheating or overcooling the plenum; therefore, the method attempts to maximize the number of open vents, and will reduce the cycle time, to avoid using the bypass, if possible.

At the start of the control cycle, the amount of heating and cooling needed for each room during the next 15 minutes is calculated, in seconds. The target temperature used for this calculation is adjusted by DeltaT. If the time value is negative, it is set to zero. In order to ensure that both heating and cooling are never required at the same time, the system may require that the $TargetTemp_{HEAT}$ be at least twice DeltaT below the $TargetTemp_{COOL}$.

Figure 3B:
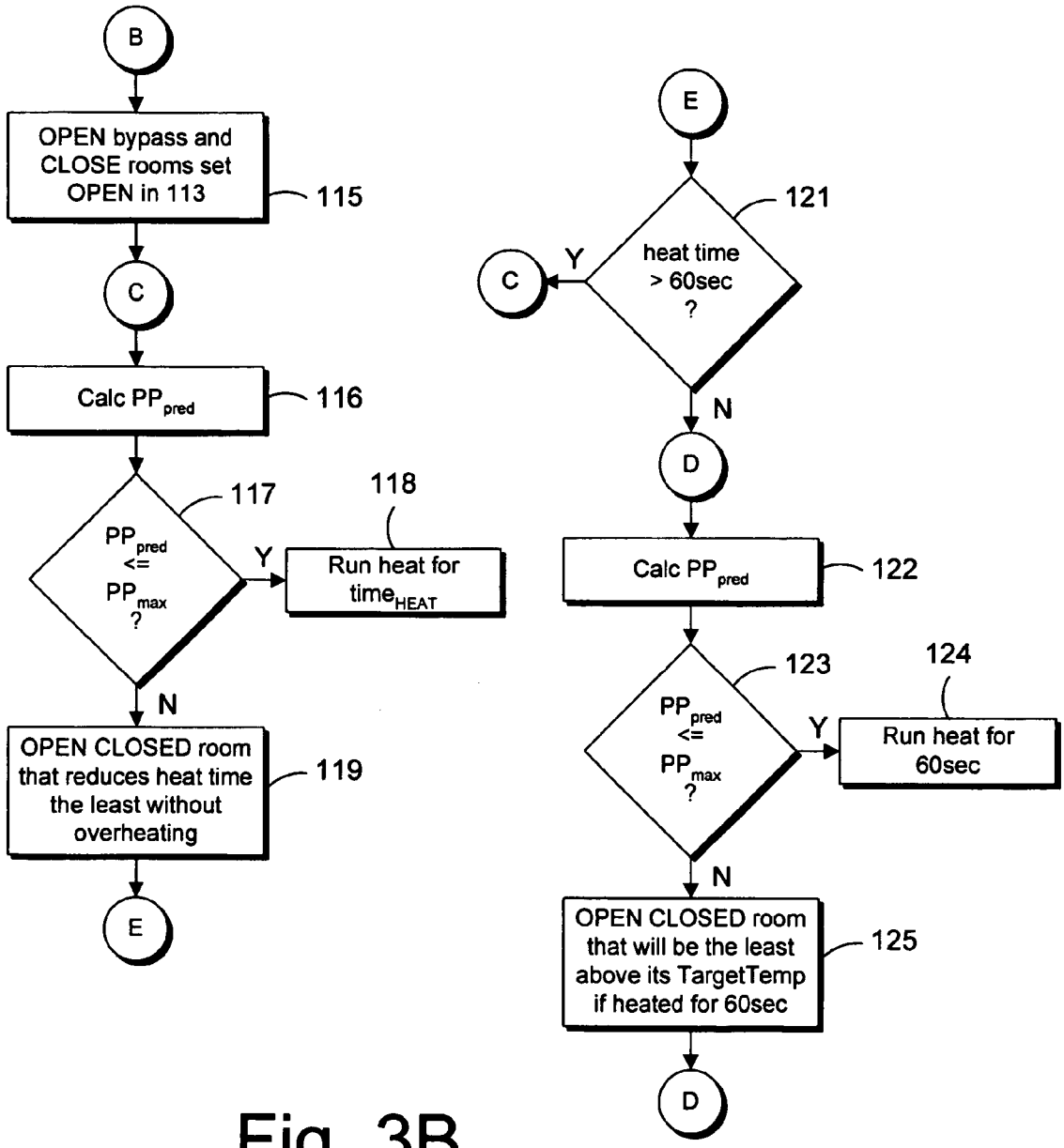

In one embodiment, the $TargetTemp_{HEAT}$ and $TargetTemp_{COOL}$ are specified with 1-degree resolution, while the wireless thermometers report the current temperature with 1. Heating FIGS. 3A and 3B illustrate one exemplary embodiment of a method 100 of operating an HVAC system to heat rooms of a house. A similar method may be used for cooling, but for simplicity, only a heating method will be described. The room's vents are either OPEN or CLOSED, controlling whether heated air is, or is not, supplied to the room.

If (101) one or more rooms coupled to the HVAC system needs heat, meaning that the temperature reported by the room's wireless thermometer is lower than the TargetTempHEAT assigned to that room in the currently running program, then the heating method is undertaken. Otherwise, no heat is needed (102) and the HVAC controller can check whether cooling or circulation may be needed.

When heating is to be undertaken, the HVAC controller may begin by logically setting (103) all room vents to CLOSED. Then, the vents are set (104) to OPEN for all rooms which need heat.

The HVAC controller calculates (105) the $time_{HEAT}$ (total time), in seconds, of heating required to raise all OPEN rooms to their respective $TargetTemp_{HEAT}$ settings+DeltaT. The $time_{HEAT\text{-}ROOM}$ for each room is:

$$Capacity_{HEAT}*(TargetTemp_{HEAT}+DeltaT-\text{room temperature})+LOSS_{HEAT}$$

where $LOSS_{HEAT}$ is calculated from the equation for the room, using the current room temperature, outside temperature, and an initial time of 15 minutes (the target time between HVAC cycles). This total heating required is $time_{HEAT}$, the sum of the $time_{HEAT}$–ROOM values for each of the rooms that need heat.

The $time_{HEAT\text{-}ROOM}$ is calculated again for each room with its vent OPEN (called an OPEN room) using the prorated (106) heat to the room using the Airflow parameters of all OPEN rooms and using $time_{HEAT}$ as the time between HVAC cycles. This compensates for the potential unequal distribution of the airflow to the OPEN rooms. The shortest of these $time_{HEAT\text{-}ROOM}$ values is the $time_{HEAT}$ that will not overheat any of the OPEN rooms. (A room is considered overheated if it is more than DeltaT warmer than its $TargetTemp_{HEAT}$.)

The HVAC controller then calculates (107) the longest duration $time_{HEAT}$ for which the heater may be run, without overheating any OPEN room.

In one embodiment of the method, the HVAC controller then attempts to maximize $time_{HEAT}$ (the duration of the heating cycle), by testing (108) all remaining CLOSED rooms with temperatures below their $TargetTemp_{HEAT}$+DeltaT. These are rooms that, although not requiring heat, could receive additional heat without becoming overheated. Each candidate room is set OPEN (one at a time), and the calculation of $time_{HEAT}$ (the minimum of all of the $time_{HEAT\text{-}ROOM}$ values) is repeated, using the adjusted prorated airflows. If making the room OPEN increases $time_{HEAT}$, then that room is left OPEN. If $time_{HEAT}$ is reduced, then that room is left CLOSED. This means that even if the room temperature is above its $TargetTemp_{HEAT}$, it may still receive additional heating, provided its final predicted temperature does not exceed $TargetTemp_{HEAT}$+DeltaT, and that including the room will increase $time_{HEAT}$.

The HVAC controller then calculates (109) the predicted plenum pressure $PP_{pred}$ according to the Airflow values of the OPEN vents. If (110) the predicted plenum pressure is less than or equal to the specified maximum plenum pressure $PP_{max}$, the heater is run (111) for the $time_{HEAT}$ duration.

If the predicted plenum pressure is too high, the HVAC controller attempts to lower the plenum pressure by various means. In one embodiment, the HVAC controller first attempts to lower the plenum pressure by sequentially opening additional room vents at the cost of reducing the $time_{HEAT}$. One at a time, for each room currently CLOSED (and not needing heat) whose temperature is lower than its $TargetTemp_{HEAT}$+DeltaT, the HVAC controller logically sets (113) the vent to OPEN and $time_{HEAT}$ is calculated again. The calculated $time_{HEAT}$ for each candidate room is compared (114), and if the longest $time_{HEAT}$ is greater than a predetermined threshold, such as 120 seconds, the HVAC controller sets the vent for that one room OPEN and goes back (A) to again predict (109) the plenum pressure.

If either there are no rooms with CLOSED vents that are below their $TargetTemp_{HEAT}$+DeltaT (112), or the $time_{HEAT}$ has fallen below the first threshold (114), the HVAC controller sets (115) the bypass to OPEN. All of the rooms previously set open (in 113) are set CLOSED, since they do not require heat this cycle, but were set OPEN only as a means of reducing plenum pressure.

The HVAC controller then again predicts (116) the plenum pressure with the bypass set OPEN. If (117) the plenum pressure is less than or equal to the maximum, the heater is run (118) for the $time_{HEAT}$ duration calculated for the rooms set OPEN. Otherwise, the HVAC controller may take further measures to try to lower the plenum pressure.

The HVAC controller sets (119) OPEN the CLOSED room that will reduce $time_{HEAT}$ the least if heated to DeltaT plus its $TargetTemp_{HEAT}$. If (121) the $time_{HEAT}$ is greater than a second threshold, e.g. 60 seconds, the HVAC controller then again predicts (116) the plenum pressure. Otherwise, the HVAC controller predicts (122) the plenum pressure and, if (123) the predicted plenum pressure is below the maximum allowed, the heater is run (124) for the second threshold of time. Otherwise, the HVAC controller (125) searches one at a time for the room currently CLOSED that would be least above its $TargetTemp_{HEAT}$ if heated for 60 seconds. That room is set OPEN and the HVAC controller returns to (122) to predict the plenum pressure. This is repeated until sufficient rooms are set OPEN so that with bypass set OPEN, the plenum pressure is less than the maximum.

In summary, the heating control process is to always provide heat to all rooms below their $TargetTemp_{HEAT}$. The $time_{HEAT}$ is maximized by also heating rooms up to DeltaT above their $TargetTemp_{HEAT}$. If the plenum pressure is too high with just these rooms set OPEN, rooms are set open one at a time, selected in the order that reduces $time_{HEAT}$ the least. Rooms are added until the plenum pressure is satisfied or until the $time_{HEAT}$ becomes less than 120 seconds. If the $time_{HEAT}$ becomes less than 120 seconds, all the rooms set OPEN that reduced the $time_{HEAT}$ are set CLOSED and the bypass is set OPEN. If the plenum pressure is not satisfied, rooms are again added one at a time selected in the order that reduces $time_{HEAT}$ the least. This is repeated until the plenum pressure is satisfied or until the $time_{HEAT}$ becomes less than 60 seconds. If $time_{HEAT}$ becomes less than 60 seconds, it is set to 60 seconds and the CLOSED rooms are search one at a time for the one room that will be the closest to its $TargetTemp_{HEAT}$ if heated for 60 seconds, and that room is set OPEN. Rooms are added one at a time until the plenum pressure is satisfied. Then the rooms now set OPEN are heated for 60 seconds.

2. Cooling

The method for cooling is similar to the method for heating, appropriately exchanging the roles of $TargetTemp_{COOL}$ and $TargetTemp_{HEAT}$, and using the corresponding values and equations for $LOSS_{COOL}$ and $Capacity_{COOL}$. It is much less likely that rooms will be overcooled than overheated, because there are many sources of heating and only few sources of cooling.

Circulation

If neither a heating cycle nor a cooling cycle is possible, then circulation may be used to heat, cool, equalize temperatures, or maintain air quality. Four different conditions are considered for circulation:

1) Heating is needed in one or more rooms, and one or more rooms can be a source of heat.
2) Cooling is needed in one or more rooms, and one or more rooms can be a source of cool (sink of heat).
3) No room needs heating or cooling, but one or more rooms are over-conditioned (significantly above their $TargetTemp_{HEAT}$ or significantly below their Target $Temp_{COOL}$). Circulation is used to equalize the temperature.
4) One or more rooms have not received a minimum amount of airflow to maintain air quality.

In one embodiment of the system, each temperature schedule setting for each room specifies a low, medium, or high level of circulation, which influences how circulation is used. At the low circulation setting, circulation is only used to ensure a minimum of new air is sent to the room each day, or as a last resort source of heat or cool to satisfy another room which has a high circulation setting. The low circulation setting is ordinarily only applied to rooms that are set for minimal conditioning to save energy. At the medium circulation setting, the room can be used as a source of heat or cool, but does not itself trigger circulation for equalization if its temperature is significantly greater than its $TargetTemp_{HEAT}$ or significantly less than its $TargetTemp_{COOL}$; in other words, a medium circulation room accepts over-conditioning. At the high circulation setting, the room calls for circulation when it is excessively conditioned.

A room is considered excessively conditioned (different than over-conditioned) when it is more than a predetermined threshold, such as 3 degrees above its $TargetTemp_{HEAT}$ or below its $TargetTemp_{COOL}$. In some embodiments, there may be separate excessively conditioned thresholds for heating and for cooling. In some embodiments, the excessively conditioned thresholds may have seasonal adjustments; for example, a room may be excessively heated if it is 3 degrees too hot in the summer, but 5 degrees too hot in the winter.

Circulation for temperature equalization or control is only utilized when the temperature difference between the warmest and coolest participating rooms is greater than a predetermined threshold, such as 3 degrees. The bypass is not used in circulation for temperature equalization; sufficient vents are opened to prevent over-pressurizing the plenum and to maximize the effect of circulation.

Circulation for air quality is done when most cost effective. During heating season, circulation to unconditioned rooms is done in the afternoon, when the outside temperature is highest. During cooling season, circulation to unconditioned rooms is done after midnight, when the outside temperature is lowest.

1. Circulation for Heating

FIG. 4 illustrates one embodiment of a method 140 of circulation for heating, such as may be employed when a normal heating cycle is not needed because no room is yet below its $TargetTemp_{HEAT}$. The HVAC controller starts by finding (141) the lowest temperature room which can use heat (meaning it is less than DeltaT above its $TargetTemp_{HEAT}$) and which has a medium or high circulation setting. Low circulation rooms are not considered because they are minimally conditioned, and not heated until below their $TargetTemp_{HEAT}$.

If (142) such a room is not found, circulation for heating is not needed (143), and the HVAC controller can move on to evaluating the cooling needs of the house.

But if such a room is found, which is to be heated by circulation, the HVAC controller finds (144) the highest temperature room that does not need heat (is more than DeltaT above its $TargetTemp_{HEAT}$ and thus can be a source of heat. This room is potentially the heat source room for heating the cold room by circulation.

If (145) the temperature in the potential heat source room is less than a predetermined threshold, such as 3 degrees, warmer than the temperature in the room to be heated, circulation heating would not be effective (146). Otherwise, circulation heating will be attempted.

The HVAC controller logically sets (147) all rooms vents to CLOSED, sets (148) the vents of the heat source room and the room to be heated OPEN, and sets (149) to OPEN the vents of all rooms which can use heat and whose temperature is at least the threshold amount, such as 3 degrees, cooler than the heat source room.

Optionally, the HVAC controller then attempts to increase the amount of heat source, by setting (150) to OPEN all rooms which (1) do not need heat and (2) are at least the threshold amount warmer than the coolest OPEN room which can use heat.

With this baseline set of participating rooms' vents set OPEN, the HVAC controller then predicts (151) the plenum pressure. If (152) the predicted plenum pressure is less than or equal to the maximum allowed, the HVAC controller causes the HVAC system to circulate (153) the air into the participating rooms for a predetermined amount of time, such as 10 minutes. In some embodiments, the amount of time may be determined according to dynamic factors, such as the total $Capacity_{HEAT}$ of the participating rooms.

If the plenum pressure is predicted to exceed the maximum allowed pressure, the HVAC controller attempts to lower the pressure by finding (154) the warmest CLOSED room not needing heat. If (155) the temperature in that room is greater than the temperature in the warmest room that can use heat, then that room can be used as a heat source, although it may not be an especially good one, such as if its temperature is only very slightly above that in the warmest room that can use heat. The HVAC controller sets (157) that room's vent OPEN, and goes back to re-predict (151) the plenum pressure and so forth. If, after the initial or a subsequent check of the predicted plenum pressure, it exceeds the maximum pressure, and if (154) there is no other CLOSED room not needing heat or if (155) the temp of such room is too low, recirculation for heating cannot be done (156).

2. Circulation for Cooling

The method for circulation cooling is substantially similar to the method for circulation heating.

3. Circulation to Reduce Excessive Conditioning

Circulation for equalization is used to reduce excessive conditioning and to keep temperatures more equalized. It is done only for rooms having the high circulation setting.

Figure 5B:
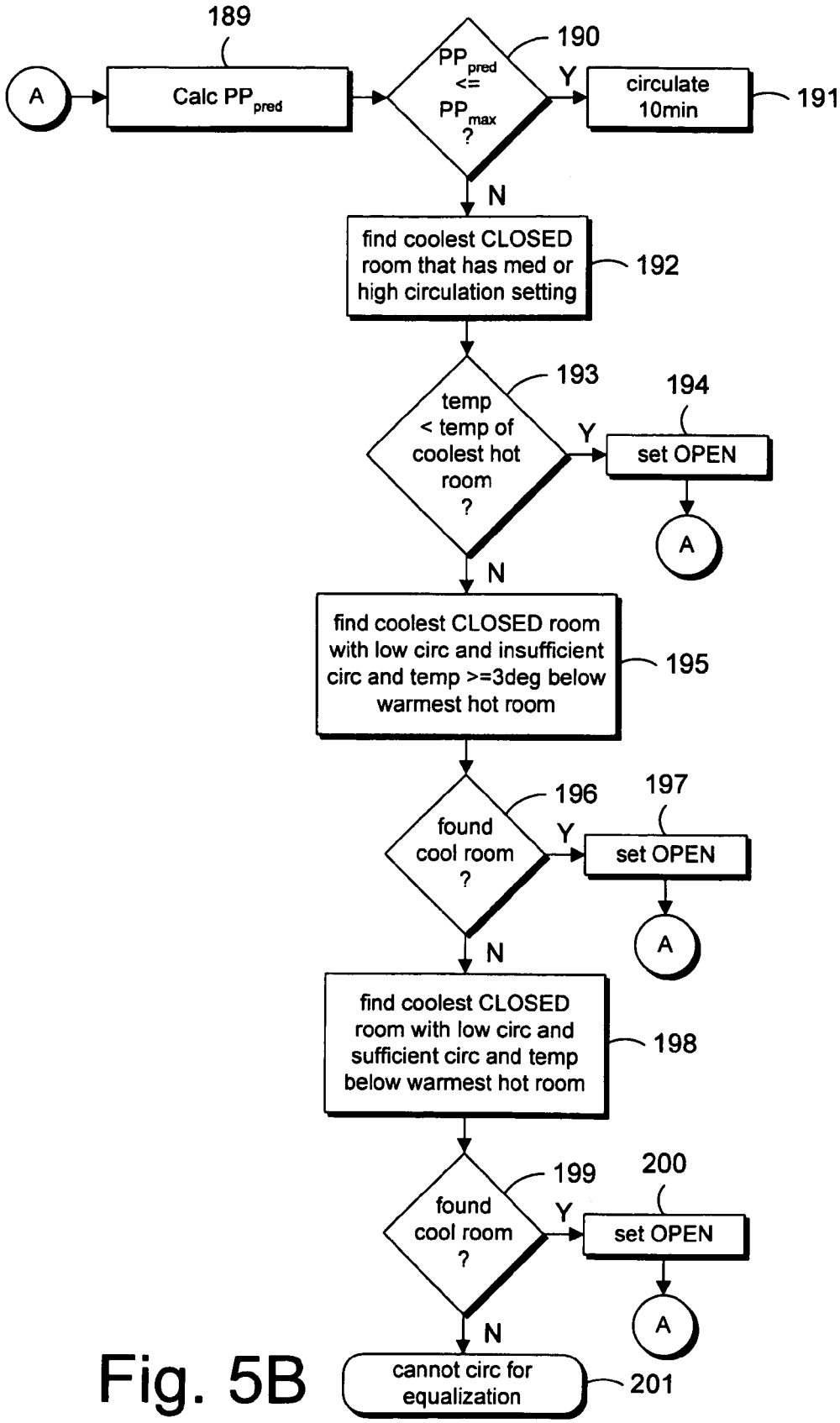

FIGS. 5A and 5B illustrate one embodiment of a method (170) of performing circulation for reducing excessive conditioning and equalizing room temperatures. The method is explained in terms of the heating function, but the same or a similar method can be employed to reduce excessive cooling, as well. Excessive cooling is less likely than excessive heating, because the house has numerous sources of supplemental heat, such as incandescent lights, appliances, an oven, a cooktop, sunlight, people, and so forth, and there are few sources of supplemental cool.

The HVAC controller starts by logically initializing all vents to CLOSED state. It then searches to find (171) the warmest room which is at least 3 degrees excessively heated and has a high circulation setting. If (172) no such room is found, circulation for equalization is not needed. Otherwise, a "hot room" has been found, which needs to be cooled down toward its $TargetTemp_{HEAT}$. The hot room temperature will be lowered by mixing hot air from the hot room with air from a cooler room, the "source of cool".

The HVAC controller tries to find (174) the coolest room which is at least 3 degrees cooler than the hot room, and which has a circulation setting of high or medium. If (175) no such room is found, the HVAC controller tries to find (176) the next preferred type of source of cool, the coolest room that has a low circulation setting and that has not had sufficient circulation yet today to maintain its air quality. If (177) no such room is found, the HVAC controller tries (178) to find the next preferred type of source of cool, the coolest room that has a low circulation setting and that has received sufficient circulation already today. If (179) no such room is found, there simply is not a suitable source of cool, and circulation for equalization cannot be performed (180).

If (175, 177, 179), however, a suitable source of cool has been found, the HVAC controller logically sets (181) the vents in that room and in the hot room OPEN. To maximize the redistribution of heat, the HVAC controller also sets (182) OPEN the vents of all rooms that are at least 3 degrees excessively heated, have the high circulation setting, and are warmer than the cool room. To maximize the effectiveness of the cooling, the HVAC controller also sets (183) OPEN the vents of all rooms that: (1) are at least 3 degrees cooler than the warmest excessively heated room, and (2) have (a) high or medium circulation settings, or (b) the low circulation setting and have not received sufficient circulation yet today.

The HVAC controller predicts (189) the plenum pressure. If (190) the predicted plenum pressure is less than or equal to the maximum allowable pressure, the fan is run (191) for a predetermined period of circulation, such as ten minutes. As air is pushed into the overheated rooms and the source of cool rooms, it will mix in the hallways etc. and in the plenum, quickly equalizing to a middle temperature cooler than the overheated rooms were and warmer than the source of cool rooms were.

If the predicted plenum pressure is too high, the HVAC controller attempts to lower it by opening more vents. The HVAC controller attempts to find (192) the coolest CLOSED room that has the medium or high circulation setting. If (193) the temperature in that room is lower than that of the coolest overheated room, the HVAC controller sets (194) that room's vents OPEN, and goes back to re-predict (189) the plenum pressure. Otherwise, the HVAC controller attempts to find (195) the coolest CLOSED room with the low circulation setting and insufficient air circulation today, which is at least 3 degrees cooler than the warmest excessively heated room. If (196) such a room is found, the HVAC controller sets (197) its vents OPEN, and goes back to re-predict (189) the plenum pressure. Otherwise, the HVAC controller attempts to find (198) the coolest CLOSED room with the low circulation setting and sufficient circulation, which is cooler than the warmest excessively heated OPEN room. If (199) such a room is found, the HVAC controller sets (200) its vents OPEN, and goes back to re-predict (189) the plenum pressure. Otherwise, there are no suitable rooms whose vents can be opened to lower the plenum pressure, and circulation for equalization cannot be performed (201).

4. Circulation for Air Quality

FIG. 6 illustrates one embodiment of a method (210) for circulating the air to maintain air quality, particularly in rooms which are set to minimal conditioning for energy savings, and therefore not conditioned each day. The HVAC controller starts by logically setting (211) all vents CLOSED. For each room, the HVAC controller goes back through its stored data for the previous period of time, such as 24 hours, and adds (212) up the total time the room received airflow. If (213) the total time for every room is above some threshold, such as some predetermined minimum, there is no need (214) for circulation, as every room has already received sufficient circulation today and will have adequate air quality.

Otherwise, the HVAC controller sets (215) OPEN the vents of all rooms which have not had sufficient circulation. The HVAC controller predicts (216) the plenum pressure. If (217) the predicted plenum pressure is less than or equal to the maximum allowed, the HVAC controller turns on the fan to circulate (218) the air for a predetermined period of time, such as 10 minutes. In some embodiments, the period of time may be dynamically determined, such as in response to the least amount of prior circulation, or the Airflow parameters of the OPEN rooms.

If the plenum pressure will be too high, the HVAC controller sets (219) the bypass OPEN, and re-predicts (220) the plenum pressure. If (221) the plenum pressure is low enough, the HVAC controller runs the fan to circulate (222) the air for a predetermined period, such as 10 minutes. Otherwise, the HVAC controller attempts to lower the plenum pressure by opening the vents of certain rooms which do not actually need circulation.

The HVAC controller finds (223) the CLOSED room whose temperature is closest to the average temperature of the OPEN rooms. The HVAC controller sets (226) its vents OPEN, and goes back to re-predict (220) the plenum pressure.

The bypass is used in preference to using more rooms, to reduce the mixing of conditioned and unconditioned air.

D. Anticipation

The seven room parameters, and other data, are also used for providing an accurate "anticipation" function when one or more different temperature schedules ("setback") are in use. Anticipation is needed when making a transition to a new target temperature that requires an increase in energy usage—moving to a higher $\text{TargetTemp}_{HEAT}$ or a colder Target $\text{Temp}_{COOL}$, because the user commonly understands the schedule time to specify the time at which the room should be at the new target temperature, not the time at which the HVAC system should begin heating or cooling to the new target temperature. It takes some amount of time for the HVAC system to raise or lower the house temperature, so heating or cooling must be started early, to reach the new target temperature by the specified time. Various factors will influence the amount of anticipation time needed, such as the outside temperature, the Capacity of the rooms, the number of rooms moving to a new target temperature, the Airflow available to those rooms, and so forth. The more extreme the outside temperature, the longer the anticipation time will need to be, because more of the HVAC system capacity will be needed simply to maintain the current temperature.

The anticipation function uses the thermal model described above, and looks ahead in time for the changes in target temperature that will require additional conditioning. The time when the new target temperature becomes effective is advanced sufficiently to ensure that the new target temperature is reached at or before its specified time. The anticipation function calculates an anticipation time for every room, responding to changes in room temperature and outside temperature. The anticipation function is a separate process from the HVAC temperature control process described above. The temperature control process adds the separately calculated anticipation time to the current time, and uses this adjusted time to get the target temperatures from the programmed temperature schedules. This is a simple way to cleanly separate the longer-term anticipation function from the shorter-term HVAC control function.

The anticipation function considers the capacity of the HVAC system, and the ability to use that capacity to change the temperature in each room. Even though the HVAC equipment may have sufficient capacity, it may not be possible to effectively get the capacity to the room needing the temperature change.

A portion of the total HVAC conditioning capacity is needed for keeping the rooms at their current temperatures. This is calculated by summing the $\text{LOSS}_{HEAT}$ or $\text{LOSS}_{COOL}$ for all the rooms. The excess heating capacity available to raise the temperature can be calculated as $$ExcessCapacity_{HEAT} = \frac{60\ \text{sec}}{\text{min}} * \frac{60\ \text{min}}{\text{hour}} - \text{sum}(Loss_{Heat})$$

The excess cooling capacity is calculated similarly. As the outside temperature becomes more extreme, there is less excess capacity available for changing the room temperature.

The maximum conditioning that can be delivered to a room is proportional to the room's Airflow. When only a few rooms change target temperature at the same time, the fraction $\text{Frac}_i$ of the excess conditioning that can be delivered to a room is roughly $$Frac_i = Airflow_i * \frac{PP_{\max}}{k_{HVAC}}$$

When many rooms change target temperature at the same time, the fraction $\text{Frac}_i$ of the excess conditioning that can be delivered to a room is roughly $$Frac_i = \frac{Airflow_i}{\text{sum}(Airflow_i)}$$

The sum is taken over all the rooms that are changing target temperatures in a way that requires more conditioning at the same time. This calculation takes into account the time calculated the last time the anticipation function was executed.

The smaller of these two values of $\text{Frac}_i$ is used in calculating the anticipation. Consider the case of heating. The anticipation function first looks ahead in all the temperature schedules to find the first change in each schedule that requires additional heating to reach the target temperature, or, in other words, new target temperatures which are higher than current target temperatures. This is referred to as the TempDelta. The extra heating time $\text{ExtraTime}_{HEAT}$ (in seconds of heating) required to get the room to its new target temperature is:

$$\text{ExtraTime}_{HEAT} = \text{Capacity}_{HEAT} * \text{Temp}_{Delta}$$

The room also needs heating time to overcome the heat losses to the outside. This is calculated using the thermal model $$Loss_{HEAT}=TempOffset_{HEAT}+((Temp_{room}-Temp_{outside})*UF_{HEAT})$$

where $LOSS_{HEAT}$ is the seconds of heating per hour.

Both $ExtraTime_{HEAT}$ and $LOSS_{HEAT}$ must be prorated by the fraction of the total airflow received by the room. The maximum prorated seconds of airflow per hour the room can receive is 3,600*$Frac_i$, so the excess airflow available to increase the temperature of the room is 3,600* $Frac_i$−$LOSS_{HEAT}$. Combining these terms (including scale factors), the anticipation time (in seconds of "real time") required to supply the extra heat is $$Time_{anticipation}=\frac{\frac{60\text{ sec}}{\text{min}}*\frac{60\text{ min}}{\text{hour}}*ExtraTime_{HEAT}}{\frac{60\text{ sec}}{\text{min}}*\frac{60\text{ min}}{\text{hour}}*Frac_i-Loss_{HEAT}}$$

Initially, $$Frac_i=Airflow_i*\frac{PP_{\max}}{k_{HVAC}}$$

is used to calculate the anticipation time for each room. Then, additional iterations are made using the calculated anticipation values from the previous iteration for all other rooms, taking into account the anticipation times. The airflows for all rooms with overlapping anticipation times are summed. If $$\frac{Airflow_i}{\text{sum}(Airflow_i)}<\frac{Airflow_i*PP_{\max}}{k_{HVAC}}$$

then $$Frac_i=\frac{Airflow_i}{\text{sum}(Airflow_i)}$$

is used, and the anticipation is recalculated. This makes the anticipation longer, so the overlap of anticipation must be checked again, and $Frac_i$ adjusted if necessary. This iteration continues until $Frac_i$ is acceptably stable for this room, such as the value changes less than 5% between iterations.

At the limits of the capacity of the heating system, the HVAC controller must limit the amount of anticipation time to some predetermined maximum, such as 4 hours.

Anticipation is regularly calculated as part of the main control loop. Anticipation has no effect when the change in target temperature is farther in the future than the anticipation value. The anticipation value strongly depends on the outside temperature, and changes as the outside temperature changes. Therefore, the anticipation value needs to be recalculated fairly frequently. For example, if the outside temperature at 4 am is 20 degrees, and there is a 5 degree increase in room temperature scheduled for 10 am, the anticipation value calculated at 4 am might be 3 hours, suggesting that the heating will need to be turned on at 7 am. However, when 7 am arrives, the outside temperature may have risen to 40 degrees, resulting in an anticipation value of only 2 hours, or 8 am. In this instance, the rising outside temperature shortens the anticipation value, causing the turn-on time to recede into the future. The opposite can also happen, when a falling outside temperature causes the anticipation value to increase and the turn-on time to advance earlier and earlier. The same general methodology can be used with cooling, but with the opposite effects caused by changing outside temperatures, of course.

IV. Energy Usage Estimation

Figure 7:
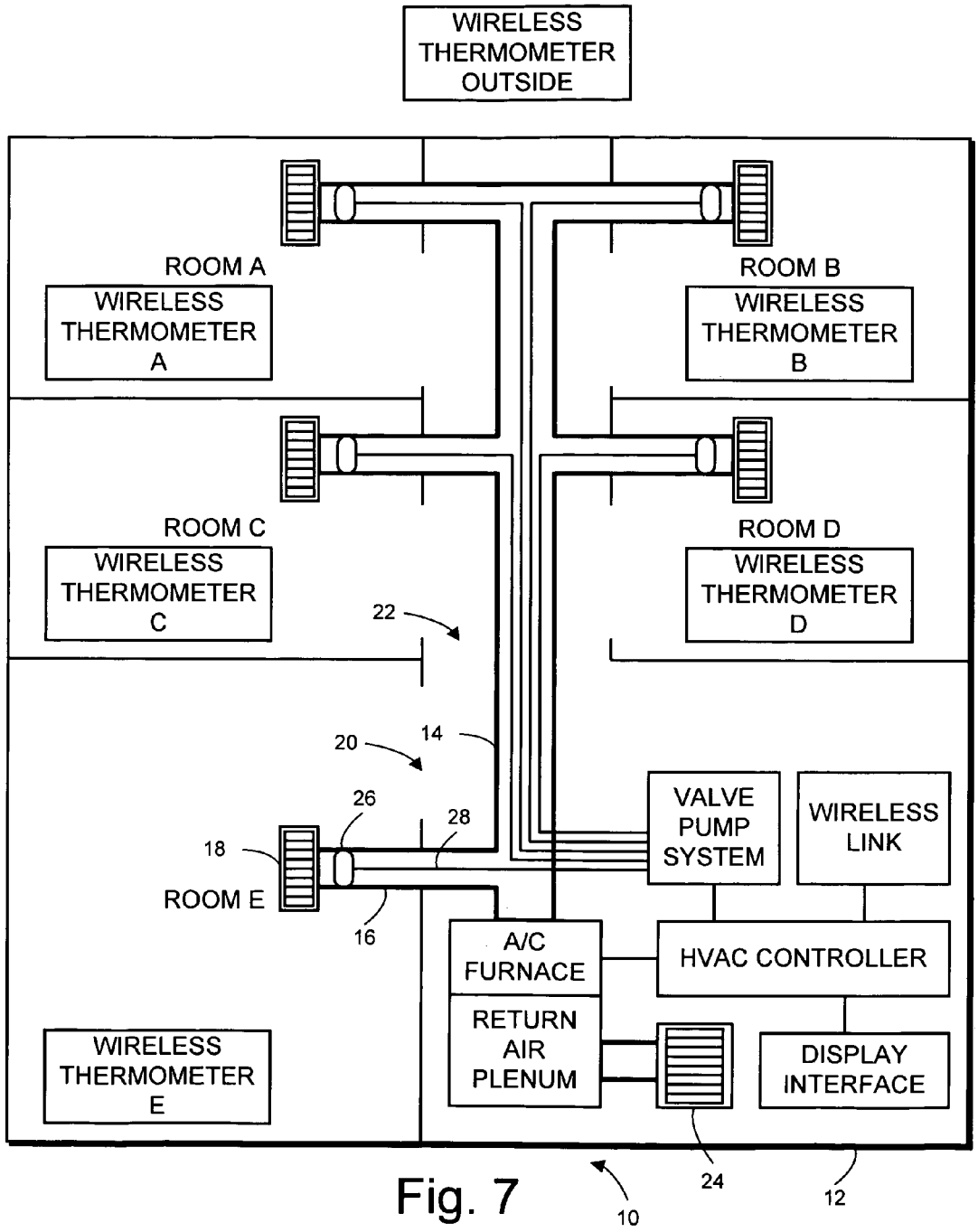
FIG. 7 shows an exemplary residential home with a forced air climate control system, in which the present invention may be practiced.

FIG. 7 illustrates one embodiment of an HVAC controller such as may be employed in practicing this invention. The HVAC controller includes a thermal model of the house. The thermal model includes a model of the thermal characteristics of each room in the house, and a model of the local climate. In one embodiment, the thermal models are created at installation, based on default settings and some customizations. In one embodiment, the thermal models are adaptive, learning over time as the HVAC system operates and actual temperatures are measured, and so forth. The HVAC controller is also provided with information regarding the energy costs associated with conditioning the air in the house.

The HVAC controller maintains a conditioning schedule for the house. In one embodiment, each room or zone has its own schedule. The schedules can vary from day to day; in some modes of operation, the same schedule is applied each day; in other modes of operation, a first schedule is used Monday through Friday, with a second schedule for the weekend; in other modes of operation, each day of the week has its own schedule. The schedule specifies a target temperature range within which the HVAC system is to maintain the zone during a specified time period. Each day's schedule can be comprised of one or more start times for new temperature ranges.

In some embodiments, it is sufficient that the thermal model be accurate to only a first order. For example, the thermal model may assume that the cost of heating or cooling a room is proportional to the difference between the outside temperature ($T_{outside}$) and the target "heat-to" temperature ($T_{heat}$) or "cool-to" temperature ($T_{cool}$) specified by the programmable temperature schedule specified for that room at a particular time. This assumption will be captured by referred to the thermal model or the energy usage estimation as "linear".

The thermal model may further include an "offset temperature" ($T_{heatoffset}$ or $T_{cooloffset}$) which compensates for intrinsic sources of heating and cooling associated with each room. For example, if $T_{heat}$ is programmed at 70° and $T_{outside}$ is 65°, it is typically the case that the furnace will not actually be needed, because of the various other sources of heating inside the house, such as human bodies, stoves, ovens, incandescent light bulbs, exterior walls with solar exposure, and so forth. In many cases, a $T_{heatoffset}$ value of 10° may be a useful parameter. In other words, the furnace will not actually be needed until $T_{outside}<(T_{heat}-T_{heatoffset})$, or, in this example, until $T_{outside}<60°$.

$T_{cooloffset}$ will typically be a different magnitude parameter than $T_{heatoffset}$, because there are fewer and less robust intrinsic sources of cool than sources of heat in most houses. If $T_{cool}$ is programmed at 72°, the air conditioner may actually be needed when $T_{outide}$ is cooler than the inside temperature, because the intrinsic heat sources may overpower the intrinsic cool sources. In many cases, a $T_{cooloffset}$ value of 5° may be a useful parameter, such that the air conditioner will be needed when $T_{outside}>(T_{cool}+T_{cooloffset})$, for example $T_{outside}>(72°+-5°)$ or, in other words, $T_{outside}>67°$.

The thermal model includes a usage factor UF for each room in the house as described above The HVAC controller includes an energy usage estimator (EUE). The EUE calculates the approximate annual cost of operating the HVAC system, to establish a baseline against which to compare changes which the user makes to the conditioning schedule. The EUE predicts the total number of seconds of heating or cooling needed per hour, to maintain a given temperature differential between the inside temperature and the outside temperature.

For example, assume that it is the heating season, and that the thermal model uses a Theatoffset value of 10° and that it takes 5 seconds of heating per degree difference per hour, to maintain the given temperature differential. (The "per degree difference" means $T_{outside-(Theat}+T_{heatoffset}$.) When $T_{outside}>=T_{heat}-10°$, the model says that there is no heating cost, because the intrinsic heat sources are adequate to avoid needing to run the furnace. Assume that $T_{heat}$ is set at 70°. When $T_{outside}$ is 59°, it takes 5 seconds of furnace operation per hour to keep the room at 70°; when $T_{outide}$ is 58°, it takes 10 seconds of furnace operation per our; and so forth.

The total number of seconds of heating needed for the room over the entire year, is the sum of the seconds for each of the 24 hours per day for each of the 365 days of the year. The total number of seconds of heating for the house, is the sum of the totals for all the rooms. The total cost of heating is expressed as the total seconds of heating—the actual time that the furnace must run during the year.

A. Climate Model Initialization

Figure 8:
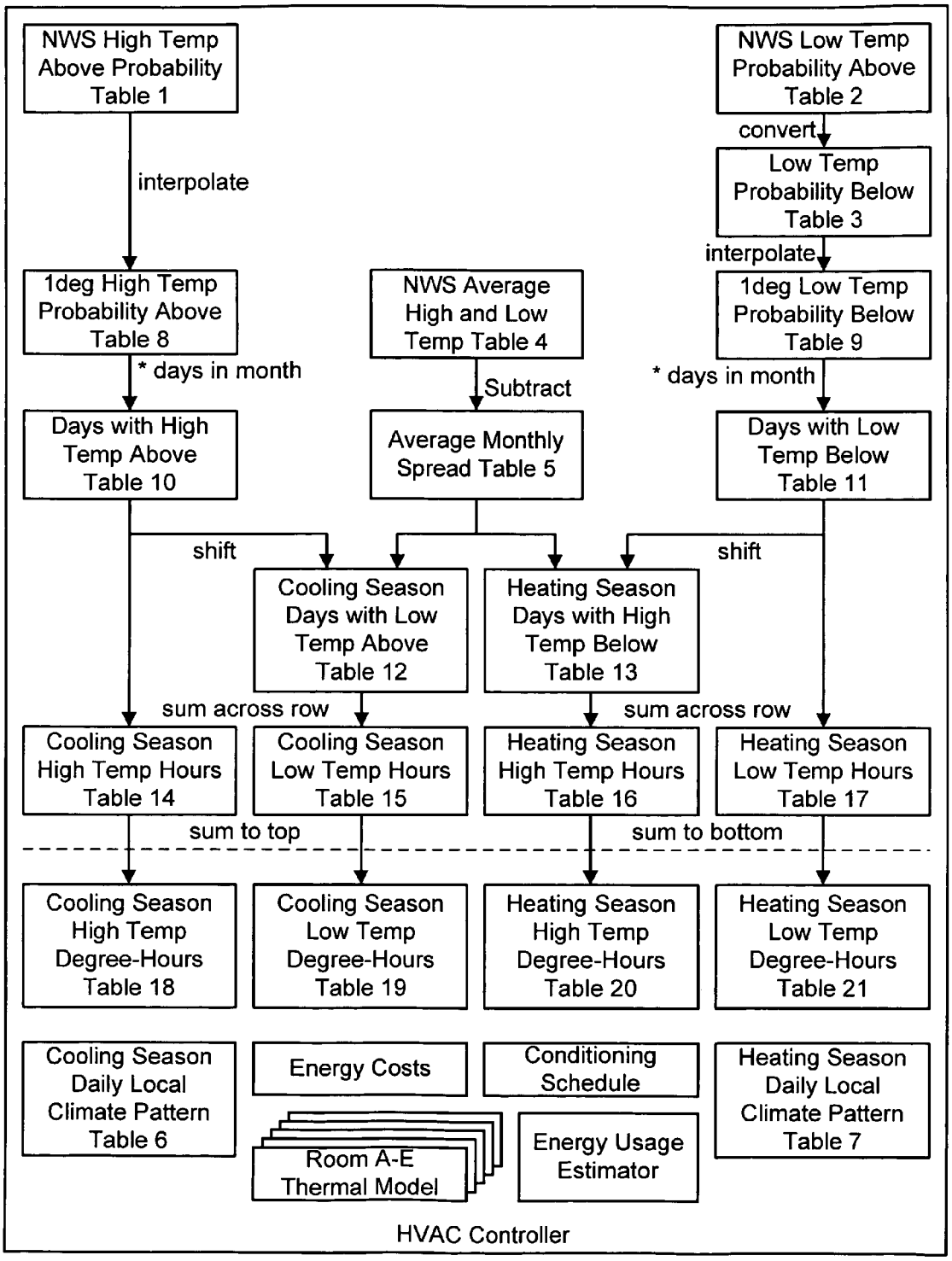
FIG. 8 shows an exemplary HVAC controller in which the present invention may be practiced, illustrating the flow of construction of the various tables used in the energy usage estimation.

The reader should continue to refer to FIG. 8 throughout the following section, in addition to the various Tables to which the text makes reference.

At installation or initialization of the system, the installer selects, from a predefined set, a geographic location whose climate most closely matches that of the local area. Based on this selection, the EUE selects climate data to use in constructing a climate model. In one embodiment, the HVAC Controller contains a variety of climate data. Alternatively, a variety of climate models can be predefined, and the installer selects an appropriate one for loading into the HVAC Controller.

Tables 1-3

Climate data is available from the National Weather Service (NWS), indicating the average distributions of daily high and daily low temperatures for each month of the year, for a variety of locations around the United States. The installer selects one of these predefined locations. If the exact location of this particular building is not covered by the NWS data, the installer can select data for whichever available location most closely matches the climate at this location.

The NWS data is expressed as probabilities that the daily high temperature in a given month will be equal to or greater than each of a set of temperatures, and probabilities that the daily low temperature in a given month will be equal to or greater than each of a set of temperatures.

Based on the selected climatic location, the EUE selects a predefined "High Temperature Above Probability" Table 1, and a predefined "Low Temperature Above Probability" Table 2.

The EUE converts the data in Table 2 into a "Low Temperature Below Probability Table 3, by subtracting each % probability from 100%. Also, the EUE extends Table 3 (as indicated by the rows above the horizontal line) such that it encompasses the entire range over which the HVAC controller user is allowed to set the thermostat or to set a scheduled heat-to or cool-to temperature. If Table 1 does not also cover this range, it, too, would be extended by the EUE.

Tables 4-5

The NWS also provides data indicating the average monthly high and low temperatures for each month of the year, for a variety of locations around the United States.

Based on the selected climatic location, the EUE selects a predefined "Average Monthly Temperatures" Table 4 which gives the average high and average low temperature for each month in that location.

From the data in Table 4, the EUE generates an "Average Monthly Spread" Table 5, giving the difference or temperature spread between the average daily high and the average daily low for each month.

Tables 6-7

The outside temperature exhibits a somewhat sinusoidal pattern over each 24-hour period. The hottest time of day typically occurs at a different time of day during winter than in summer, and so does the coolest time of day. The times at which these occur, and the shapes of the temperature patterns, vary significantly between geographic locations.

Based on the selected climatic location, the EUE selects a predefined "Cooling Season Daily Local Climate Pattern" Table 6 and a predefined "Heating Season Daily Local Climate Pattern" Table 7. The data in these tables are scaled so that the coolest time of the day is represented by the value 0.00 and the warmest time of the day is represented by the value 1.00.

Tables 8-9

The NWS provides the high and low temperature probability data in 5° increments. To improve the accuracy of its predictions, the energy usage estimator interpolates the data in Table 1 to generate a "1° High Temperature Above Probability" Table 8, and interpolates the data in Table 3 to generate a "1° Low Temperature Below Probability" Table 9, each in 1° increments to improve the accuracy of the EUE.

Tables 10-11

From the data in Table 8, the EUE generates a "Monthly Days with High Temp Above—for Cooling" Table 10, containing data which identifies, for each of the temperatures in the range, the likely number of days in each month which will, on average, have their hottest hour above that temperature. It does this by multiplying the probabilities in Table 8 by the number of days in the respective months.

From the data in Table 9, the EUE generates a "Monthly Days with Low Temp Below—for Heating" Table 11, containing data which identifies, for each of the temperatures in the range, the likely number of days in each month which will, on average, have their coldest hour below each temperature in the range.

Table 10 pertains only to the hottest hour of any given day, and Table 11 pertains only to the coldest hour of any given day. Over the course of any particular day, the temperature will, of course, not sit statically at the hottest temperature during cooling season, nor at the coldest temperature during heating season.

Tables 12-13

The EUE generates a "Monthly Days with Low Temp Above—for Cooling" Table 12 by shifting the values in Table 10 downward (toward colder temperatures) by the number of degrees (the "spread") indicated for each respective month in Table 5. The EUE fills with zeroes the upper values which have been left vacant by the downward shifting—those entries which are above the jagged line across the table.

The EUE also generates a "Monthly Days with High Temp Below—for Heating" Table 13 by shifting the values in Table 11 upward (toward warmer temperatures) by the number of degrees indicated for each respective month in Table 5. The EUE fills with zeroes the lower values which have been left vacant by the upward shifting—those entries which are below the jagged line across the table.

Tables 14-17

The EUE generates an "Annual Days with High Temp Above—for Cooling" Table 14 by summing across the rows of Table 10.

The EUE generates an "Annual Days with Low Temp Above—for Cooling" Table 15 by summing across the rows of Table 12.

The EUE generates an "Annual Days with High Temp Below—for Heating" Table 16 by summing across the rows of Table 13.

The EUE generates an "Annual Days with Low Temp Below—for Heating" Table 17 by summing across the rows of Table 11.

Tables 18-21

The EUE generates an "Annual High Temp Degree-Hours Above—for Cooling" Table 18 by summing from each Table 14 entry upward to the top-most entry (which happens to be the value 0.2 for the 105° row) in Table 14. This upper value will be different for different climates. The summation in general is continued upward until the probability is effectively zero. Thus, each Table 18 entry represents the total number of degree-hours for that temperature and any higher temperature. This Table corresponds to the most cooling needed during a 24-hour day.

The EUE generates an "Annual Low Temp Degree-Hours Above—for Cooling" Table 19 by summing from each Table 15 entry upward. This table corresponds to the least cooling needed during a 24-hour day.

The EUE generates an "Annual High Temperature Degree-Hours Above—for Heating" Table 20 by summing from each Table 16 entry downward to the bottom-most entry, or until the probability is essentially zero. Thus each Table 20 entry represents the total number of degree-hours for that temperature and any lower temperature. This table corresponds to the least heating needed during a 24-hour day.

The EUE generates an "Annual Low Temperature Degree-Hours Above—for Heating" Table 21 by summing from each Table 17 entry downward to the bottom or until the probability is essentially zero. This table corresponds to the most heating needed during a 24-hour day.

Figure 9:
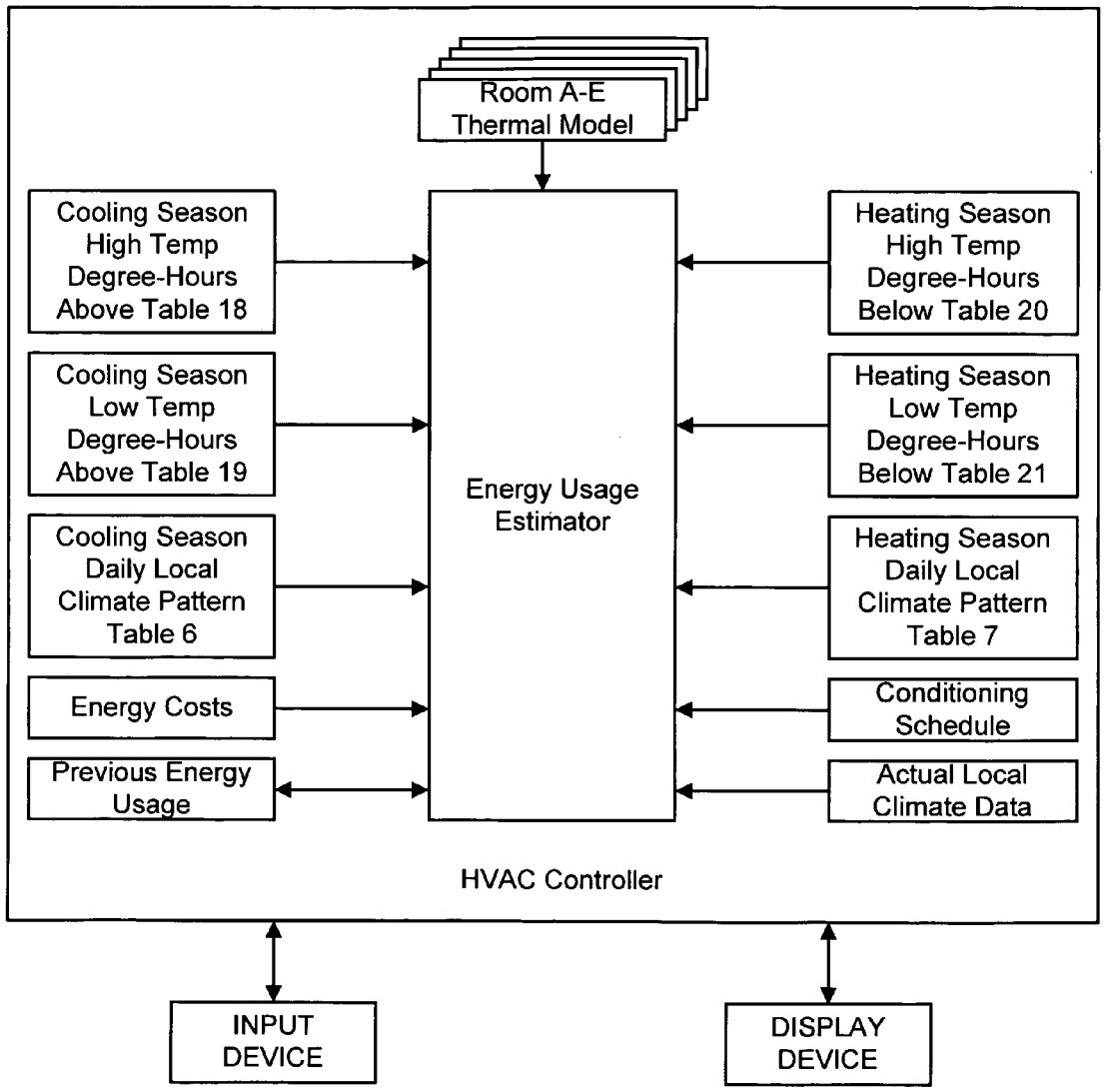
FIG. 9 shows the HVAC controller of FIG. 8 in its run-time configuration, omitting intermediate tables which are not used in the end calculations by the energy usage estimator.

FIG. 9 illustrates in closer detail the interactions between the EUE, the thermal model of the rooms, the per-second energy costs, the conditioning schedule, and the data in Tables 6-7 and 18-21.

In practicality, the EUE can sum downward until it reaches a zero value entry, rather than summing all the way to the very last entry.

B. Energy Usage Estimation Methodology

From this point onward, the only tables that are necessary are Tables 6-7 and 18-21. These tables are either generated by the EUE as described above, or they can be pre-calculated and loaded into the EUE, customizing the EUE for a particular climatic location.

Because the EUE is linear (as defined above), the amount of energy used is directly proportional to the difference between the target temperature (+/− any offset) and the outside temperature. It is this linearity assumption that enables the "column-wise" summing of the degree-hours in the tables to have meaning and utility.

For cooling calculation purposes, Table 18 gives the annual degree-hours at or above each possible temperature for the hottest hour of the day, and Table 19 gives the annual degree-hours at or above each possible temperature for the coolest hour of the day, and Table 6 gives the average daily outside temperature pattern during the cooling season, scaled to a range of 0 to 1.

For heating calculation purposes, Table 20 gives the annual degree-hours at or below each possible temperature for the warmest hour of the day, Table 21 gives the annual degree-hours at or below each possible temperature for the coldest hour of the day, and Table 7 gives the average daily outside temperature pattern during the heating season, scaled to a range of 0 to 1.

From those Tables (18, 19 and 6, or 20, 21, and 7), and for each of the 24 hours of the day, the EUE predicts an energy usage for each hour of the day, by applying a weighted valuation of the high temperature degree-hours table (Table 18 or 20) and the low temperature degree-hours table (Table 19 or 21). The values in the pattern table (Table 6 or 7) indicate the fraction of the weighting which is applied to the high temperature degree-hours table; the remainder (implicit in subtracting the table value from 1.00) of the weighting is applied to the low temperature degree-hours table. For example, to estimate an energy usage for hour 12 for cooling cost estimation purposes, the EUE will estimate that hour's energy usage E as:

$$E=(\text{Table 6[12]}*\text{Table 18 entry})+((1-\text{Table 6[12]})*\text{Table 19 entry})$$

or, in other words:

$$E=(0.65*\text{Table 18 entry})+(0.35*\text{Table 19 entry})$$

The EUE estimates the total number of seconds that the air conditioner will run, and the total number of seconds that the furnace will run, over the course of a year. The EUE then multiplies each of these by its respective cost per second, and sums the results, to give the total annual energy bill. The cost per second of air conditioner operation, and the cost per second of furnace operation, are derived by either of two methods. First, the EUE can ask the homeowner to estimate his annual air conditioning bill and his annual furnace bill, and to estimate his typical cooling season and heating season thermostat settings, then make a pass through the estimation algorithm using these two values, and thereby back into the cost by estimating the total number of seconds of cooling and of heating and dividing those into the costs provided by the homeowner. Alternatively, if the homeowner does not provide these values, default values are provided based on average local costs and typical thermostat settings. Local utility companies typically publish such data. Scaling the local average costs by the square footage of the specific house versus the square footage of a typical house can further refine this estimate. The U.S. Department of Energy also provides average costs for heating and cooling for various U.S. climate zones.

When the user makes a change to the conditioning schedule via the display interface, the EUE calculates the estimated number of seconds of heating and the estimated number of seconds of cooling required by the new schedule, subtracts from those the previously-calculated baseline values, multiplies by the per-second energy costs of heating and cooling, and displays for the user the estimated annual savings or extra costs that will be incurred because of the changes made to the schedule. This gives the user a real-time basis on which to make a schedule change decision which is based on something more than gut feel or vague impression. The homeowner may decide, for example, that it is well worth the financial savings (and concurrent environmental savings) to let the house cool off significantly during the night while his family is asleep. Or, the homeowner may decide that it is well worth the financial cost to keep the house a few degrees warmer during the breakfast hour when his children are getting ready for school.

The EUE provides the difference in cost between the changed settings and previously-calculated baseline values. In one embodiment, a choice is provided for the baseline values. One choice is the initial data used to calibrate the cost. In this mode, the difference is always displayed relative to the temperature settings assumed when calibrating the costs. Therefore, the cost difference will usually only be $0.00 when the user's settings exactly match the default values used for calibration.

A second choice is to display the cost difference relative to the current settings, i.e. those in effect before this schedule editing session began. In this mode, at the start of an editing session, before any changes are made, the cost difference will be $0.00. After the editing session is finished and the schedule changes are accepted, these settings become the new baseline settings for future comparisons.

Other baseline choices can be provided. For example, in one embodiment, complete sets of schedules for all zones in the building can be stored as a single program, and multiple programs can be stored and retrieved. Each such program can be used as a baseline for comparison when changing the settings of another program.

In one embodiment, the method for predicting the total number of seconds of conditioning needed for one year is represented by the following pseudocode:

```
SumCoolingSeconds = 0;
SumHeatingSeconds = 0;
for room = 1 to NumRooms
{ for day = 1 to 7
    { for hour = 0 to 23
        { ; COOLING
            Tcool = CoolSchedule [day, hour, room] ;
            DeltaT = Tcool - Tcooloffset [room] ;
            if DeltaT in range of Table index
            { SumCoolingSeconds += (Table18[DeltaT]
                * UFcool [room] * Table6 [hour] ) /7;
              SumCoolingSeconds += (Table 19 [DeltaT]
                * UFcool [room] * (1-Table6 [hour] )) /7;
            } ; for cooling
            ; HEATING
            Theat = HeatSchedule [day, hour, room] ;
            DeltaT = Theat - Theatoffset [room] ;
            if DeltaT in range of Table index
            { SumHeatingSeconds += (Table20 [DeltaT]
                * UFheat [room] * Table7 [hour] ) /7;
              SumHeatingSeconds += (Table21 [DeltaT]
                * UFheat [room] * (1-Table7 [hour] )) /7;
            } ; for heating
        } ; for hour
    } ; for day
} ; for room
```

CONCLUSION

When one component is said to be "adjacent" another component, it should not be interpreted to mean that there is absolutely nothing between the two components, only that they are in the order indicated.

While the invention has been described in terms of the various data being stored in tables, the actual physical storage method is orthogonal to the invention. Therefore, in the context of this invention, the term "table" should be interpreted to include other equivalent means such as linked lists, databases, circular buffers, and so forth.

And while the invention has been described in terms of an HVAC controller which provides variable scheduling of temperatures and times, it can also be used in an HVAC controller which functions as a simple thermostat. And while the invention has been described in terms of a multi-zone system, it can also be used in a single-zone or whole-house system.

The invention has been described in terms of an embodiment which uses predefined NWS climate data. It can also be used in embodiments which use actual, collected data. For example, for the first year, the EUE could use the NWS-derived tables, and thereafter it could switch to use tables whose entries represent data actually collected by the HVAC controller at this particular building. In some such embodiments, the EUE could gradually phase out the NWS climate data, such as by averaging the NWS data with the collected data for the first N years, and then switching over to only use the collected data after that.

In some embodiments, the HVAC controller can generate the various tables in real time, based on stored copies of the NWS tables. In other embodiments, the various tables are generated beforehand and installed into the HVAC controller at system installation time. In FIG. 8, the dashed line indicates the division between the tables which are actually used by the EUE in calculating energy costs (those below the dashed line), and others which are merely used in generating those tables (those above the dashed line). In some embodiments, the tables below the line can be loaded at system installation time. In other embodiments, different sku's of HVAC controller can be manufactured—one for each local climate, preloaded with that location's tables.

The various features illustrated in the figures may be combined in many ways, and should not be interpreted as though limited to the specific embodiments in which they were explained and shown.

Those skilled in the art having the benefit of this disclosure will appreciate that many other variations from the foregoing description and drawings may be made within the scope of the present invention. Indeed, the invention is not limited to the details described above. Rather, it is the following claims including any amendments thereto that define the scope of the invention.

What is claimed is:

1. A method whereby an HVAC controller estimates a change in energy usage by an HVAC system controlled by the HVAC controller, the method comprising:

maintaining a baseline energy usage for a current HVAC system setting including a condition-to temperature;

changing the HVAC system setting in response to input from a user of the HVAC controller;

maintaining a table indicating one of an estimate of degree-hours which a local climate will be above a temperature in a temperature range and an estimate of degree-hours which the local climate will be below a temperature in a temperature range;

estimating a new energy usage for the changed HVAC system setting, including, looking up the condition-to temperature in the table of estimated degree-hours to determine a number of degree-hours of conditioning which the HVAC system will operate to maintain the condition-to temperature, calculating a cost of operating the HVAC system for the determined number of degree-hours, and determining a difference between the calculated cost and a previously stored cost; and displaying to the user an indication of a difference between the estimated energy usage and the baseline energy usage.

2. The method of claim 1 further comprising:

using the estimated energy usage as the maintained baseline energy usage for use in subsequent estimations.

3. The method of claim 1 further comprising:

maintaining a schedule of HVAC system settings; and wherein the changing of the HVAC system setting comprises changing the maintained schedule.

4. The method of claim 1 wherein the table of estimated degree-hours comprises at least one of:

an annual high temperature degree-hours above for cooling table;

an annual low temperature degree-hours above for cooling table;

an annual high temperature degree-hours below for heating table; and an annual low temperature degree-hours below for heating table.

5. The method of claim 4 further comprising:

maintaining a cooling season daily local climate pattern table;

maintaining a heating season daily local climate pattern table; and using the pattern tables, interpolating hours of the day which are not directly represented in the tables of degree-hours.

6. An HVAC controller for operating at least one of a furnace, an air conditioner, and a heat pump of a building located in a local climate, the HVAC controller comprising:

means for maintaining a schedule;

means whereby a user can make a change to the schedule;

means for operating the at least one of the furnace, air conditioner, and heat pump, in response to the schedule;

means for maintaining a model of the local climate, wherein the model of the local climate includes a table, indexable by temperature over a temperature range, storing data indicating one of an estimated annual total of degree-seconds that the local climate will be above each temperature in the range and an estimated annual total of degree-seconds that the local climate will be below each temperature in the range;

means, responsive to the change being made to the schedule, for estimating a change in cost associated with the change to the schedule, the estimating based on the model of the local climate; and means for displaying the estimated change in cost to the user.

7. The HVAC controller of claim 6 wherein the change to the schedule comprises:

an alteration to an individual setting in the schedule.

8. The HVAC controller of claim 7 wherein the alteration comprises one of:

a change to a temperature setting and a change to a time setting.

9. The HVAC controller of claim 6 wherein the change to the schedule comprises one of:

a switch between a normal mode and a setback mode of thermostat operation;

a comparison of the schedule to a fixed previous setting.

10. The HVAC controller of claim 6 wherein the schedule comprises one of:

a single daily schedule;

a schedule having different settings for at least two days during a week.

11. The HVAC controller of claim 6 wherein the means for estimating further comprises:

means for applying a first climate model for estimating cooling costs and a second climate model for estimating heating costs.

12. The HVAC controller of claim 6 further comprising:

means for selecting the model of the local climate from a plurality of predefined climate models.

13. The HVAC controller of claim 12 wherein:

each of the plurality of predefined climate models includes, a first table indicating, for each of a plurality of months, probabilities that an average daily high temperature during that month will exceed each of a plurality of temperatures in a first range;

a second table indicating, for each of a plurality of months, probabilities that an average daily low temperature during that month will exceed each of a plurality of temperatures in a second range; and a third table indicating, for each of a plurality of months, an average daily high temperature and an average daily low temperature.

14. The HVAC controller of claim 6 further comprising:

means for improving over time an accuracy of the means for estimating, in response to data gathered from operation of the HVAC controller.

15. A method whereby an HVAC controller estimates energy usage of a building's HVAC system under its control, the method comprising:

maintaining a schedule of target temperature ranges;

operating the HVAC system to keep the building's temperature within a current one of the target temperature ranges;

making a change to the schedule in response to user input;

maintaining a local climate model, including maintaining a table indexable by temperature, the table indicating one of an estimate of degree-hours that the local climate is likely to be above the indexing temperature and an estimate of degree-hours that the local climate is likely to be below the indexing temperature;

maintaining a thermal model of the building;

estimating a change in cost caused by the change to the schedule utilizing the local climate model and the thermal model of the building; and displaying an indication of the estimated change in cost to the user.

16. The method of claim 15 further comprising:

maintaining a thermal model of the building; and wherein estimating the energy cost/savings includes utilizing the thermal model.

17. The method of claim 15 wherein estimating the change in cost further includes:

accounting for local climatic differences between heating season and cooling season.

18. A method of estimating an change in cost resulting from a change in a original schedule in an HVAC controller, the HVAC controller operating an HVAC system in a building having a plurality of rooms, the method comprising:

maintaining a first table of data identifying, for each temperature in a high temperature range, a number of degree-hours that daily high temperatures are likely to be above that temperature;

maintaining a second table of data identifying, for each temperature in the high temperature range, a number of degree-hours that daily low temperatures are likely to be above that temperature;

maintaining a third table of data identifying, for each temperature in a low temperature range, a number of degree-hours that daily high temperatures are likely to be above that temperature;

maintaining a fourth table of data identifying, for each temperature in the low temperature range, a number of degree-hours that daily low temperatures are likely to be above that temperature;

using the first and second tables in estimating cooling costs;

using the third and fourth tables in estimating heating costs;

for each day in the schedule, for each hour of that day in the schedule, for each of the rooms, accumulating energy usage by that room at that hour on that day;

comparing the accumulated energy usage to an energy usage that would have resulted from the original schedule to identify the change in cost; and displaying an indication of the change in cost for a user of the HVAC controller.

19. The method of claim 18 further comprising:

maintaining a fifth table of data identifying a cooling season daily outside temperature pattern;

maintaining a sixth table of data identifying a heating season daily outside temperature pattern;

further using the fifth table in estimating cooling costs; and further using the sixth table in estimating heating costs.

* * * * *